US012276078B1

(12) United States Patent
Kruse

(10) Patent No.: US 12,276,078 B1
(45) Date of Patent: Apr. 15, 2025

(54) FOUNDATION PILES, SYSTEMS, ASSEMBLIES, AND METHODS

(71) Applicant: William Charles Kruse, Clark, NJ (US)

(72) Inventor: William Charles Kruse, Clark, NJ (US)

( * ) Notice: Subject to any disclaimer, the term of this patent is extended or adjusted under 35 U.S.C. 154(b) by 0 days.

(21) Appl. No.: 18/634,844

(22) Filed: Apr. 12, 2024

Related U.S. Application Data

(60) Provisional application No. 63/584,828, filed on Sep. 22, 2023.

(51) Int. Cl.
*E02D 5/50* (2006.01)
*E02D 5/30* (2006.01)
*E02D 5/54* (2006.01)

(52) U.S. Cl.
CPC *E02D 5/54* (2013.01); *E02D 5/30* (2013.01)

(58) Field of Classification Search
CPC ..... E02D 5/54; E02D 5/30
See application file for complete search history.

(56) References Cited

U.S. PATENT DOCUMENTS 433,609 A 8/1890 Ames
707,683 A * 8/1902 Farwell ..... E02D 5/803 114/305
777,351 A * 12/1904 Raymond ..... E02D 7/30 175/21
825,599 A * 7/1906 Healy ..... E02D 5/48 405/253
858,742 A * 7/1907 Moran ..... E02D 5/50 405/243
887,175 A * 5/1908 Abbott ..... E02D 5/44 405/239
951,668 A * 3/1910 Welsh ..... E02D 5/385 405/245

(Continued)

FOREIGN PATENT DOCUMENTS

CN 1153847 A 7/1997
CN 102049811 A 5/2011

(Continued)

OTHER PUBLICATIONS

International Search Report and Written Opinion for International Application No. PCT 2024/047541 dated Jan. 3, 2025, 13 pages.

*Primary Examiner* — Edwin J Toledo-Duran
(74) *Attorney, Agent, or Firm* — Knobbe, Martens, Olson & Bear, LLP

(57) ABSTRACT

Foundation pile assemblies disclosed herein can include a first section positioned at a bottom of a foundation pile assembly and a second section coupled to the first section. The first section can include a shell extending along a length of the foundation pile. The shell can have an interior space and an outside surface. A cap can be positioned at an end of the pile assembly. Some embodiments of the foundation pile can have an impact support element positioned within the interior space of the shell to increase the strength of the foundation pile assembly in the vicinity of the impact support element. The initial or, in some instances, full length assembly can be configured on a horizontal or slightly sloped rack on the ground from which the assembly is lofted vertically and installed into the ground.

30 Claims, 39 Drawing Sheets

(56) References Cited

U.S. PATENT DOCUMENTS 978,505 A * 12/1910 Stewart ..... E02D 5/80 52/155
1,140,303 A * 5/1915 Feder ..... E02D 5/54 405/245
1,144,838 A * 6/1915 Griese ..... E02D 3/068 91/299
1,213,441 A * 1/1917 Wilhelmi ..... E02D 5/44 405/237
1,275,470 A * 8/1918 Pruyn ..... E02D 7/30 405/245
1,342,424 A * 6/1920 Cotten ..... E02D 5/52 405/253
1,347,973 A * 7/1920 Rotinoff ..... E02D 7/26 175/323
1,348,994 A * 8/1920 Heckle ..... E02D 7/30 405/253
1,491,832 A * 4/1924 Upson ..... E02D 5/665 405/246
1,532,711 A * 4/1925 McGregor ..... E02D 5/44 405/237
1,558,127 A * 10/1925 Upson ..... E02D 5/72 405/253
1,570,404 A * 1/1926 Rotinoff ..... E02D 7/30 104/2
1,598,300 A * 8/1926 Moran ..... E02D 3/10 405/271
1,629,622 A * 5/1927 Hiley ..... E02D 5/385 405/240
1,650,827 A * 11/1927 Friz ..... E02D 3/02 52/169.1
1,654,644 A * 1/1928 Goldsborough ..... E02D 5/38 405/246
1,675,663 A * 7/1928 Pierce ..... E02D 7/30 405/245
1,681,883 A * 8/1928 Sipe ..... E02D 7/28 405/239
1,771,312 A * 7/1930 Pierce ..... E02D 7/30 405/245
1,775,217 A * 9/1930 Thornley ..... E02D 5/44 405/239
1,778,925 A * 10/1930 Thornley ..... E02D 5/72 405/253
1,830,651 A * 11/1931 Frankignoul ..... E02D 5/385 405/242
1,836,140 A * 12/1931 Upson ..... E02D 7/30 405/245
1,858,707 A * 5/1932 Haage ..... E02D 7/04 173/121
1,890,268 A * 12/1932 Smith ..... E02D 5/385 405/250
1,954,070 A * 4/1934 Cook ..... E02D 5/523 405/253
1,998,643 A * 4/1935 Thornley ..... E02D 7/30 405/245
2,021,735 A * 11/1935 Marshall ..... E02D 5/54 405/251
2,048,252 A * 7/1936 Frankignoul ..... E02D 5/68 405/239
2,050,216 A * 8/1936 Watt ..... E02D 33/00 405/245
2,270,604 A * 1/1942 Roemhild ..... E02D 5/52 285/119
2,288,576 A * 6/1942 Titcomb ..... E02D 5/665 405/251
2,342,243 A * 2/1944 Brizay ..... E02D 7/20 405/226
2,412,239 A * 12/1946 Weber ..... E02D 27/12 405/239
2,465,557 A * 3/1949 Thornley ..... E02D 7/30 405/233
2,554,896 A * 5/1951 Caudill ..... E02D 5/72 405/245
2,598,455 A * 5/1952 Smith ..... E02D 7/10 405/245
2,639,589 A * 5/1953 Smith ..... E02D 7/30 405/245
2,684,577 A * 7/1954 Smith ..... E02D 5/665 405/247
2,698,520 A * 1/1955 Lloyd ..... E04B 1/215 52/423
2,758,575 A * 8/1956 Wampach ..... E02D 7/125 184/29
2,789,419 A * 4/1957 Pickman ..... E02D 5/44 405/239
2,798,363 A * 7/1957 Hazak ..... E02D 7/10 173/132
2,840,993 A * 7/1958 Caudill ..... E02D 7/30 405/246
2,847,830 A * 8/1958 Smith ..... E02D 7/30 405/246
2,881,593 A * 4/1959 Cobi ..... E02D 7/30 242/571.2
2,911,795 A * 11/1959 Cobi ..... E02D 7/30 242/571.2
2,920,456 A * 1/1960 Hazak ..... E02D 5/30 405/245
2,924,949 A * 2/1960 Smith ..... E02D 5/665 405/251
2,972,872 A * 2/1961 Kupka ..... E02D 7/30 405/247
2,988,158 A * 6/1961 Baldwin ..... E03B 3/12 173/132
3,034,304 A * 5/1962 Upson ..... E02D 7/30 405/253
3,041,839 A * 7/1962 Kupka ..... E02D 7/30 405/247
3,115,226 A * 12/1963 Thompson, Jr. ..... E02D 5/806 52/156
3,194,328 A * 7/1965 Fiore ..... E02D 7/28 173/132
3,199,300 A * 8/1965 Fiore ..... E02D 5/523 285/332
3,279,136 A * 10/1966 Smith ..... E02D 5/54 405/244
3,283,519 A * 11/1966 Rusche ..... E02D 7/30 405/247
3,283,832 A * 11/1966 Spannbake ..... E02D 7/10 173/126
3,316,724 A * 5/1967 Tsuzuki ..... E02D 5/523 405/251
3,354,657 A * 11/1967 Turzillo ..... E02D 5/62 52/153
3,395,543 A * 8/1968 Rusche ..... E02D 7/30 405/245
3,526,069 A * 9/1970 Deike ..... E02D 5/805 405/244
3,526,283 A * 9/1970 Gardner ..... E02D 7/28 175/135
3,638,433 A * 2/1972 Sherard ..... E02D 5/72 405/50
3,685,302 A * 8/1972 Fuller ..... E02D 5/44 405/239
3,742,717 A * 7/1973 Wey ..... E02D 5/42 405/238
3,779,025 A * 12/1973 Godley ..... E02D 5/38 405/249
3,851,485 A * 12/1974 Steding ..... E02D 15/04 222/154
3,913,337 A * 10/1975 Merjan ..... E02D 5/54 405/253
3,971,227 A * 7/1976 Godley ..... E02D 5/72 405/253
4,106,298 A * 8/1978 Mathieu ..... E02D 5/385 405/243
4,127,002 A * 11/1978 DeWitt ..... E02D 5/50 405/239
4,132,082 A * 1/1979 Merjan ..... E02D 5/44 405/253

(56) References Cited

U.S. PATENT DOCUMENTS 4,171,176 A * 10/1979 Yamada ..... E04C 5/163 405/257
4,199,277 A * 4/1980 Merjan ..... E02D 5/72 405/253
4,239,419 A * 12/1980 Gillen, Jr. ..... E02D 5/56 405/253
4,349,298 A * 9/1982 Kruse ..... E02D 5/54 405/253
4,405,262 A * 9/1983 Nagashima ..... E02D 13/10 52/126.1
4,408,668 A * 10/1983 Kuhn ..... E02D 13/10 173/128
4,462,716 A * 7/1984 Merjan ..... E02D 7/28 405/253
4,479,550 A * 10/1984 Kuhn ..... E02D 7/02 173/83
4,543,015 A * 9/1985 Kruse ..... E02D 5/54 405/253
4,575,283 A * 3/1986 Guandalini ..... E02D 5/42 405/236
4,707,964 A * 11/1987 Hoyt ..... E02D 27/42 52/165
4,708,530 A * 11/1987 Faber ..... E02D 7/22 405/253
4,725,167 A * 2/1988 Merjan ..... E02D 7/28 405/253
4,818,149 A * 4/1989 Kuehn ..... E02D 15/08 173/DIG. 1
5,449,253 A * 9/1995 Roger ..... E02D 7/28 405/245
5,707,180 A * 1/1998 Vickars ..... E21B 10/44 405/249
5,813,800 A * 9/1998 Doleshal ..... E02D 5/64 405/250
5,826,387 A * 10/1998 Henderson ..... E02D 27/42 405/251
5,862,581 A * 1/1999 Miller ..... F16L 21/08 29/451
6,042,304 A * 3/2000 Manning ..... E02D 5/52 405/243
6,234,716 B1 * 5/2001 Chiaves ..... E02D 29/045 52/87
6,264,403 B1 * 7/2001 Hall ..... E02D 5/54 405/252.1
6,367,849 B1 * 4/2002 Tatsuta ..... F16L 25/0063 285/903
6,468,003 B2 * 10/2002 Merjan ..... E02D 5/66 405/253
6,543,967 B1 * 4/2003 Marshall ..... E02D 5/52 405/249
6,609,856 B1 * 8/2003 Knight ..... E02D 27/48 405/230
6,814,525 B1 * 11/2004 Whitsett ..... E02D 5/38 405/253
7,138,534 B2 * 11/2006 Forlin ..... C07D 301/12 549/531
7,145,481 B2 * 12/2006 Cooper ..... G06F 21/83 341/26
7,494,299 B1 * 2/2009 Whitsett ..... E02D 5/52 405/254
7,707,797 B2 * 5/2010 Henderson ..... F03D 13/22 405/252.1
RE41,737 E * 9/2010 Leem ..... H04B 1/7083 370/335
7,854,451 B2 * 12/2010 Davis, II ..... E21B 17/046 405/252.1
8,579,548 B1 * 11/2013 Schmidt ..... E02D 5/64 405/251
8,734,058 B1 * 5/2014 Schmidt ..... E02D 5/64 405/255
8,864,182 B2 * 10/2014 Buchanan ..... F16L 21/00 285/415
9,181,674 B2 * 11/2015 El Naggar ..... E02D 5/36
9,435,095 B2 * 9/2016 Yan ..... B28B 21/62
9,759,362 B2 * 9/2017 Yarnell ..... F16L 33/26
9,808,893 B2 * 11/2017 McClure ..... B25B 5/147
10,125,466 B2 * 11/2018 Desmeules ..... E02D 5/285
10,344,441 B2 * 7/2019 Gangarao ..... E02D 7/22
10,648,146 B1 * 5/2020 Reulet ..... E02D 7/22
10,676,888 B1 * 6/2020 Kruse ..... E02D 5/526
10,927,988 B2 * 2/2021 O'Neil ..... F16L 43/02
11,142,878 B1 * 10/2021 Aleali ..... E02D 5/54
11,149,396 B2 * 10/2021 Zuckerman ..... E02D 3/12
11,802,591 B2 * 10/2023 Dally ..... F16D 1/02
2005/0031411 A1 * 2/2005 Hensley ..... E01F 13/123 404/11
2005/0199405 A1 * 9/2005 Raunisto ..... E02D 7/10 173/55
2006/0272837 A1 * 12/2006 Steffen ..... E02D 3/068 173/162.2
2012/0014755 A1 * 1/2012 Raunisto ..... E02D 5/38 405/235
2013/0153078 A1 * 6/2013 Twist ..... F16L 9/06 138/173
2015/0354162 A1 * 12/2015 Bonomi ..... E02D 29/045 52/741.15
2016/0122966 A1 * 5/2016 Brugger ..... E02D 5/223 405/255
2018/0230665 A1 * 8/2018 Niroumand ..... E21B 43/04
2019/0071838 A1 * 3/2019 Zhan ..... F16L 9/003
2021/0231156 A1 * 7/2021 Almy ..... F24S 25/617
2021/0301593 A1 * 9/2021 McMillan ..... E21B 1/14

FOREIGN PATENT DOCUMENTS

| | | | |
|---|---|---|---|
| CN | 102971464 | A | 3/2013 |
| CN | 109058604 | A | 12/2018 |
| CN | 112359827 | A | 2/2021 |
| CN | 216515541 | U | 5/2022 |
| CN | 216765851 | U | 6/2022 |
| CN | 217710661 | U | 11/2022 |
| CN | 116591153 | A | 8/2023 |
| EP | 0598457 | A1 | 6/1996 |
| KR | 2002-92305 | Y1 | 10/2002 |
| KR | 10-0702200 | B1 | 3/2007 |
| KR | 10-0888166 | B1 | 3/2009 |
| KR | 10-2009-0117440 | A | 11/2009 |
| KR | 10-2010-0086110 | A | 7/2010 |
| KR | 10-2015-0025698 | A | 3/2015 |
| KR | 10-1575789 | B1 | 12/2015 |
| WO | WO 2002/016701 | A1 | 2/2022 |

* cited by examiner

FOUNDATION PILES, SYSTEMS, ASSEMBLIES, AND METHODS

CROSS REFERENCE TO RELATED APPLICATIONS

This application claims the priority benefit of U.S. Provisional Patent Application No. 63/584,828, filed Sep. 22, 2023, the entirety of which is incorporated by reference here. Any and all applications for which a foreign or domestic priority claim is identified in the Application Data Sheet as filed with the present application are hereby incorporated by reference under 37 CFR 1.57.

BACKGROUND

Field

This disclosure generally relates to foundation piles and pile systems used in deep foundations of buildings, roads, bridges, and other structures, as well as installation methods of the same.

Certain Related Art

At certain building sites, existing subsurface soil (also referred to as subsoil) properties can be inadequate to safely support a large or heavy structure. Deep foundations, such as bearing piles, are used to provide support to structures such as buildings, roads, and bridges. Piles are generally vertical or battered structural elements that are driven into a subsoil. A pile can comprise one or more corrugated steel pipe shells, and/or round steel pipe shells, which are filled with concrete and can have reinforcement components. Depending on the subsoil properties and the designed loads, a quantity of piles can ultimately be installed to support the structure.

Foundation pile capacity is generally a function of cross-sectional area, shape, depth of penetration (tip capacity), and side friction (soil to exterior surface of pile interface-skin friction capacity). Generally, driven piles, also referred to as installed piles, use a pile impact or vibratory hammer to deliver impact or vibration forces to the butt of the pile which transmits energy waves to penetrate the pile tip to the required depth to achieve required capacity, where the butt of the pile can be the top end of the pile and the pile tip can be the bottom end of the pile. The piledriving impact process transmits a range of compressive and tensile stresses or, more generally, dynamic stresses, to the pile member along its length. The range and distribution of these dynamic stresses is a function of a number of conditions and variables, including pile material, pile shape, soil profile and characteristics, pile hammer energy and characteristics, installed depth, and resistance during installation. These dynamic stresses during installation, also referred to as piledriving, are almost always much higher than the static stresses in the pile once the pile is in place and during the pile's service life as a foundation pile. Most all impact-driven foundation piles use structural members consisting of a large amount of material(s) that can include, without limitation, steel, concrete, reinforcing steel, etc., which are necessary to withstand these high stresses at certain locations or zones along their lengths during the piledriving process. The piledriving process is also referred to herein as a hammer-impact process. Geotechnical and/or structural engineers typically design the pile members to be strong enough to resist the highest dynamic stresses during pile hammer impact installation. This often results in the use of heavy, thick wall pipe, heavily reinforced concrete, larger pile cross-sections, and other material-intense piles for the entire length of the pile, which are necessary to resist these high dynamic stresses. These high dynamic stresses during piledriving installation can occur at specific and/or localized locations along the pile length. In many instances, much, or most, of the pile length typically experiences significantly lower stresses during piledriving installation.

SUMMARY OF SOME EXEMPLIFYING EMBODIMENTS

The piles discussed in the present disclosure can take strategic advantage of the fact that in many instances, much, or most, of the pile length can be designed for the actual lower stresses to which it is subjected to while only certain locations or zones are subjected to higher stresses, thereby eliminating the need for an excessive or potentially wasteful amount of material where it is not needed, which in many cases is in most of the pile length. As a result, less material, which can include less reinforcing material, can be used for much, or most, of the pile length which can be subjected to lower stresses during piledriving installation. In some embodiments, more material can be used primarily in or only in specific portions (also referred to herein as sections, regions, or zones) to adequately resist the higher stresses during piledriving installation. Supply chain challenges, escalation in the cost of raw materials, and an increased desire to use less raw materials for environmental purposes, has escalated the need for the disclosed embodiments, which include environmentally friendly, low-cost, high-capacity foundation pile and pile installation processes. Rather than using an intense amount of materials, these innovations can achieve improved pile solutions by employing, among other things, innovative processes that include an internal, removable, and re-usable mandrel; light-weight and minimal thickness corrugated steel pipe or round steel pipe; concrete (which can be made from recycled concrete); and minimal amounts of flat (round) steel plates and reinforcing bars (which can be made from recycled steel). Concrete can be a relatively low-cost construction material, and concrete batch plants are relatively abundant, which often minimizes transport distances and costs. Reinforcing bars and flat steel plates can cost significantly less than steel pipe. Reinforcing bar and steel plate supply warehouses are also relatively abundant, which also can minimize transport distance and costs. A foundation pile that provides effective and superior compressive, tension, lateral and bending capacities using greater amounts of concrete, lesser amounts of steel plate and reinforcing bars, and the least amount of corrugated steel pipe or round steel pipe can provide optimum foundation piles. Moreover, concrete does not degrade due to surrounding soils and elements, and reinforcing bars placed inside the core of a pile can be an extremely efficient structural use of steel, particularly if the reinforcing bars are encased or covered in concrete. On the other hand, steel pipe can corrode when it is installed in certain soils or environments. The disclosed innovations enable the use of greater amounts (volumes) of concrete than steel pipe to create more efficient piles.

In some embodiments, the piles disclosed herein can achieve any or all of the foregoing pile solutions reinforcing specific portions of the pile member and using such reinforced pile members optionally in combination with an internal mandrel, which is removable and repeatedly re-usable. Some embodiments of the foundation piles (also referred to as pile assemblies) disclosed herein can be configured to resist high impact and/or vibratory driving stresses to enable deep penetration to achieve high capacity while using minimal materials. Light weight, low thickness (low thickness to diameter ratio) pipe pile members can be used in lieu of heavy (thick wall) pipe pile members or other higher cost pile types. Strategically reinforcing portions of the pile at optimum locations along the pile length can accommodate higher stresses during pile hammer impact (or vibration) and can permit most of the pile length to use less material. In some embodiments, most of the pile length can use dramatically less pile material. For example, and without limitation, some embodiments can use as much as five times less pile material, or as much as from two times less material to five times less pile material, or as much as from three times to four times less pile material.

For example, the portions of the pile where stresses are significantly lower during pile hammer impact and/or piledriving can use less material, thereby facilitating deep penetration of various pile cross sections such as about 6 inches to about 192 inches in outside diameter. Selection and configuration of a lower material cost yet optimum pile assembly can achieve optimum side (skin) friction capacity and end (tip) bearing capacity. Any embodiments disclosed herein can be configured for deep penetration of a wide range of cross-sectional pile sizes, for example and without limitation, 6 inches or about 6 inches to 36 inches or about 36 inches or more, or up to 48 inches, about 48 inches, or more than 48 inches, or up to or 60 inches, about 60 inches, or more than 60 inches, or up to or 192 inches, about 192 inches, or of any value, approximate value, or range of values in any of the foregoing ranges, in outside diameter.

Advantages of some embodiments can include, for example and without limitation, optimally located and designed reinforced regions that can adequately resist high dynamic stresses and enable the remainder of the pile length to use minimal amount of material. For example, and without limitation, portions of the pile can be reinforced with an impact support element, and can be configured to resist the high, localized stresses such portions can experience during piledriving while also using minimal amounts of material for the pile. As another example, certain portions of the pile can be configured to receive a high strength concrete material while most of the pile can use a concrete material that has a lower strength.

The piles disclosed herein can have several economic advantages. This includes, but is not limited to, utilizing less material, increasing speed of installation, and minimizing the transport of materials. Additionally, the impact support element can be, but is not required to be, fabricated on the ground with high precision and quality, thereby increasing the productivity and efficiency of manufacturing these elements. Furthermore, the impact support element can be connected to the bottom portion of the pile. Additionally, some embodiments of the foundation pile disclosed herein can be configured to contain higher strength concrete in a region or portion of the foundation pile where the stresses during piledriving installation are the highest, such as the region of the foundation pile where the impact support element is positioned. This can optimize the use of higher cost and higher strength concrete by eliminating or reducing the need for such concrete in other portions of the pile. As an example, some embodiments of the pile can have an impact support element including at least a top plate and reinforcing bars that can extend into the remainder of the pile. They can also include higher strength concrete, such as about 9,000 psi or higher, in the portion of the pile or in at least the portion of the pile that includes the impact support element. In some embodiments of this configuration, the more highly reinforced region can withstand the high dynamic piledriving stresses that this region can be subjected to, while the remainder of the pile length, which can be most of the pile length, including those portions that experience lower stresses during piledriving, can use a lower strength concrete and less pile material. The lower strength concrete can be a concrete material having a compressive strength of, for example and without limitation, 5,000 psi or about 5,000 psi compressive strength concrete.

The piles disclosed herein can also have several safety advantages. For example, requiring less work to complete the construction process can result in fewer workers under the piledriving hammer, which is typically the highest risk region during the piledriving operation. The ability for workers to perform some of the work on the ground or while the pile is horizontally positioned gives the workers more control compared to piles that are positioned vertically or in the air. Advantageously, some embodiments of the piles disclosed herein can provide a convenient and cost-effective method to place exterior (circumferential or perimeter) reinforcement to adequately resist high stresses during impact piledriving, thereby increasing the strength of such piles and the overall safety of the pile driving operation.

In some embodiments, the foundation pile assembly can have a concreted first portion, also referred to as a bottom portion or missile. The concreted first portion can be a first shell that is filled with concrete and a reinforcement assembly. The embodiments of the foundation pile assembly that have a bottom portion can have additional advantages. For example, they can be manufactured on the ground. It is noted that concreting the bottom portion on the ground, with the shell in a horizontal or slightly angled position, in contrast to concreting the shell after installation, can enhance quality control and integrity of the concrete. In some embodiments, concreting the bottom portion of a shell on the ground, with the shell in a horizontal or slightly angled position, enables the bottom portion to act as a missile or a battering ram to penetrate hard fill and soil layers. This can be an advantage compared to using a mandrel to drive a hollow bottom, which can be less able to penetrate hard fill and soil layers. In some embodiments, concreting the first portion on the ground, with the shell in a horizontal or slightly angled position, can simplify installation of the bottom portion by enabling the use of lower piledriver leader height thereby enabling the use of conventional cranes or piledriver rigs. In some embodiments, concreting the first portion of a shell on the ground, with the shell in a horizontal or slightly angled position, can significantly reduce overall installation time by eliminating the need to place concrete in the first portion after it is installed, and by eliminating the need to wait for the concrete to cure after the concrete is placed in a driven hollow first portion.

In some embodiments, the foundation pile assembly can be a full-length assembly foundation pile assembly. The full-length assembly foundation pile assemblies can include piles not having any connections or having only minimal connections instead of a plurality of connectable sections that must be connected together. Some embodiments of this type of assembly can have additional advantages. For example, in some embodiments, the entire foundation pile assembly can be lofted and installed in one single action, thereby providing greater safety, faster installation, greater efficiency, and lower installation costs. Some embodiments of the techniques described herein can provide for fewer lofts per pile. In some embodiments, a complete installation of the foundation pile assembly disclosed here can be completed with one loft per pile. In some embodiments, the user can optionally insert a mandrel into the top portion of the pile on the ground, with the pile in a horizontal or slightly angled position, before lofting the pile, thus eliminating the need to insert the mandrel vertically at a high elevation in the air. In some embodiments, an economical, low-cost material single pile member unit can enable the entire foundation pile assembly to be lofted from the ground which can achieve lower transport costs, lower connection costs, faster installation rates, and increased safety.

In some embodiments, the techniques described herein can relate to a subsurface foundation pile assembly for providing support for structures. The foundation pile assembly can include: a perimeter side of a first material defining an interior space; a first end and a second end opposite the first end, the first end coupled to the perimeter side such that the interior space can be surrounded by the perimeter side and the first end; and an impact support element positioned within the interior space. The impact support element can include: a first portion; a second portion coupled to the first portion, the second portion including a reinforcement member or a plurality of reinforcement members. The interior space can include a first space between the first portion and the second end, and a second space between the first portion and the first end. The first space can include a first material and the second space can include a second material in use. In some embodiments, the first and second materials can both be a flowable concrete mix. In some embodiments, the first material and the second material can be different. For example, and without limitation, the first material can be a concrete mix having a compressive strength of from 7000 psi or about 7000 psi to 9000 psi or about 9000 psi, or higher, and the second material can be a concrete mix having a compressive strength of about 5000 psi. In some embodiments, a compressive strength of the first material and the second material can be the same. In some embodiments, the perimeter side can be an interior of a corrugated steel pipe shell, a round steel pipe shell, or other shell type. In some embodiments, the first end can attach to the perimeter side with one or more welds. In some embodiments, the first portion can include or can be a steel plate. The steel plate can have a thickness from 0.5 inch or about 0.5 inch to 3 inches or about 3 inches. In some embodiments, the pile or system can include a plurality of reinforcements, wherein the plurality of reinforcement includes one or more reinforcement bars. The reinforcement bars can have a round cross section or a cross section of another shape. In some embodiments, the plurality of reinforcement bars can be coupled to the first portion via one or more welds, one or more threads, epoxy or other bonding agent or bond, or another attachment method. In some embodiments, the perimeter side can have a cross section that is approximately the same between the first end and the second end. In some embodiments, the substrate foundation pile assembly can comprise multiple corrugated steel pipe shells and/or round steel pipe shells, and the shells of the pile can have different diameters; and/or the perimeter side can have a generally helically corrugated cross section and/or circular cross section. In some embodiments, the first shell of the first portion can be a corrugated steel pipe and/or round steel pipe.

Also disclosed herein are embodiments of a method for providing subsurface reinforcement for a structure. In some embodiments, the method can include placing a first shell of a first length on a surface. The first shell can define an interior space. An end cap can be coupled to the first end of the shell. A user can place an impact support element within the interior space of the shell. In some embodiments, the impact support element can include a first portion and a second portion. The user can create at least one closeable opening on an exterior surface of the shell. In some embodiments, the user can secure a first reinforcement strap on the shell adjacent to the first portion of the impact support element. A first flowable material (which can be uncured concrete) can be inserted into the interior space through the at least one closeable opening such that the flowable material substantially fills the interior space between the end cap and the first portion of the impact support element. In some embodiments, an attachment piece (also referred to as a cover member) can be coupled to the shell to cover the at least one closeable opening. The user can allow the passage of some time for the first flowable material to become a cured material. In some embodiments, the first shell, the impact support element, the end cap, the first reinforcement strap, the attachment piece, and the cured material can form a bottom section. In some embodiments, the user can loft and align the bottom section over a desired location. In some implementations, the user can drive the bottom section in a subsoil in an orientation that is substantially vertical such that between about 6 inches and 36 inches, or any convenient vertical height, of the bottom section is above the ground. In some embodiments, a second shell of a second length can be aligned above the first shell. The second shell can be coupled to the first shell. In some embodiments, a second reinforcement strap can be secured such that the second reinforcement strap spans between the first shell and the second shell. In some embodiments, the user can insert a driving unit into an interior space of the second shell until the driving unit rests on the first portion of the impact support element. The driving unit can be a mandrel. The user can apply a driving force to the driving unit until the bottom (tip) reaches a desirable depth in the subsoil. The driving unit can be removed from the interior space of the second shell. A second flowable material can be inserted into the interior space of the second shell. The user can allow the second flowable material to become a cured material. In some embodiments, placement of the impact support element within the interior space of the first shell occurs when the first shell is on a ground surface. In some embodiments, the placement of the impact support element occurs when the shell is oriented generally horizontally. In some embodiments, the first flowable material is a concrete mix. In some embodiments, allowing the first flowable material to become a cured material requires a passage of about 4 days to about 28 days.

In any embodiments of the piles, systems, and methods disclosed herein, the shell, strap, or other components of the pile can have a corrugated wall along all or a portion thereof, can have a straight wall along all or a portion thereof, or otherwise.

In some embodiments, the techniques described herein relate to a foundation pile assembly for providing support for structures. The foundation pile assembly can include a bottom section, also referred to as a bottom portion. The bottom section can include a first shell, the first shell having an interior space and including a first end and a second end, wherein the second end can be positioned opposite the first end. The bottom section can also include a cap positioned adjacent to the second end. The bottom section can also include an impact support element positioned within the interior space of the first shell. The impact support element can include: a top plate; a plurality of reinforcement bars coupled with the top plate; spiral reinforcement bars surrounding the plurality of reinforcement bars. The impact support element can be positioned within the interior space in an orientation such that the plurality of reinforcement bars are approximately parallel with a longitudinal axis of the first shell. The foundation pile assembly can include a top portion, also referred to as a first portion. The top portion can include at least a second shell defining an interior space. The top portion can be coupled with the bottom portion. The top portion can be coupled at the first end. The bottom section further includes a first material within the interior space of the first shell from about an interior face of the cap to about the top plate. The first material can be configured to be inserted in the bottom portion when the first shell is in a generally horizontal orientation. In some embodiments, the techniques described herein relate to a foundation pile assembly, wherein the top plate can have a thickness of from about 0.5 inches to about 3 inches. In some embodiments, the techniques described herein relate to a foundation pile assembly, wherein the plurality of reinforcement bars can be from #4 to #18 rebar. In some embodiments, the techniques described herein relate to a foundation pile assembly, wherein the plurality of reinforcement bars include six reinforcement bars of about three feet long or longer. In some embodiments, the techniques described herein relate to a foundation pile assembly, wherein the spiral reinforcement bars can include #3 to #8 reinforcement bars.

In some embodiments, the techniques described herein relate to a pile for providing support for structures. The pile can include a bottom section. The bottom section can include: a first shell, the first shell having an interior space having a first volume, the first shell including a first end and a second end, wherein the second end can be positioned opposite the first end. The bottom section can include a cap that can be positioned adjacent to the second end opposite the first end. The bottom section can include an impact support element positioned within the interior space. The impact support element can have a proximal end adjacent to the first end and a distal end opposite the proximal end. A first interior space can be between approximately an interior face of the cap and the proximal end of the impact support element, and a second interior space can be between approximately the proximal end of the impact support element and the first end. The first interior space can include 88% or about 88% to 99% or about 99% of the first volume. A top section can include at least a second shell defining an interior space. The top section can be coupled with the bottom section. The top section can be coupled with the bottom section at the first end. The bottom section can further include a first material within the first interior space of the first shell.

In some embodiments, the techniques described herein relate to a foundation pile for providing support for structures. The pile can include a bottom section. The bottom section can include: a first shell, the first shell having an interior space having a first volume. The first shell can include a first end and a second end, wherein the second end is positioned opposite the first end. The bottom section can include a cap positioned adjacent to the second end opposite the first end. The bottom section can include an impact support element positioned within the interior space. The impact support element can have a proximal end adjacent to the first end and a distal end opposite the proximal end. In some embodiments, the proximal end of the impact support element can be from 1 inch or about 1 inch to 4 feet or about 4 feet away from the first end. The foundation pile assembly can include a top section. The top section can include at least a second shell defining an interior space. The top section can be coupled with the bottom section. The top section can be coupled with the bottom section at the first end. The bottom section can further include a first material within the first interior space of the first shell.

In some embodiments, the techniques described herein relate to a foundation pile for providing support for structures. The pile can include a bottom section. The bottom section can include a first shell. The first shell can have an interior space having a first volume. The first shell can include a first end and a second end, wherein the second end is positioned opposite the first end. The bottom section can include a cap positioned adjacent to the second end opposite the first end. The bottom section can include an impact support element positioned within the interior space adjacent to the first end. In some embodiments, an optional bottom reinforcement element can be positioned within the interior space adjacent to the second end. The optional bottom reinforcement element can include reinforcement bars that are oriented generally parallel with a longitudinal access of the first shell. In some embodiments, the bottom reinforcement element can include spiral bars surrounding the longitudinal bars. The pile can also include a top section. The top section can include at least a second shell defining an interior space. The top section can be coupled with the bottom section. The top section can be coupled with the bottom section at the first end. The bottom section can further include a first material within the first interior space of the first shell.

In some embodiments, the techniques described herein relate to a method for providing foundation piles for a structure. The method can include placing a shell on a generally horizontal surface. The shell can define an interior space and further include a first end and a second end opposite the first end. The method can include creating at least one closeable opening on an exterior surface of the shell, coupling an end cap to the second end of the shell, placing an impact support element within the interior space of the shell. The impact support element can include a first portion and a bottom section. The method can include inserting a first flowable material into the interior space through the at least one closeable opening such that the first flowable material substantially fills the interior space between the end cap and the first portion of the impact support element, coupling a cover member to the shell to cover the at least one closeable opening, securing a first reinforcement strap on the shell adjacent to the first portion of the impact support element, allowing the first flowable material to become a cured material. The shell, the end cap, the impact support element, the first reinforcement strap, the cover member, and the cured material can form a full-length assembly. The method can include inserting a driving unit into an interior space of the shell, lofting and aligning the full-length assembly and the driving unit over a desired location, using a driving mechanism to drive the full-length assembly in a subsoil in an orientation that is generally vertical until the end cap reaches a desirable depth in the subsoil, removing the driving unit from the interior space of the shell, inserting a second flowable material into the interior space of the shell while the shell is in a generally vertical orientation such that the second flowable material substantially fills an interior space of the shell between about the first portion and the first end of the shell, and allowing the second flowable material to become a cured material.

Also disclosed herein are embodiments of a foundation pile assembly that is configured to provide foundation pile support to a structure. In some embodiments, the foundation pile assembly can include a first pile section that can include a shell having a first end, a second end, a circumferential wall extending from the first end of the shell to the second end of the shell, and an interior space within the wall, a cap coupled with a second end of the shell, the second end of the shell configured to be a lowermost end of the shell when the first pile section is being driven into the ground, and an impact support element positioned within the interior space of the shell. Some embodiments of the impact support element can include a first portion that can include a plate of a rigid material and a second portion coupled to the first portion. The second portion can include a plurality of reinforcement members extending in a longitudinal axial direction from a first main surface of the first portion. The impact support element can be positioned within the interior space of the shell so that the plurality of reinforcement members of the second portion extend toward the second end of the shell. In some embodiments, the impact support element can be positioned within the interior space of the shell while the shell is in a generally horizontal orientation. The impact support element can be coupled with an inside surface of the wall of the shell in a desired position to bias the impact support element to remain in the desired position as a first concrete material is added to at least a portion of the interior space within the wall of the shell occupied by the impact support element. The first pile section can be configured such that the first concrete material can be added to at least the portion of the interior space within the wall of the shell occupied by the impact support element when the shell of the first pile section is in a generally horizontal orientation.

Additionally, any embodiments of the devices, systems, and methods disclosed herein can include, in additional embodiments, one or more of the following features, components, and/or details, in any combination with any of the other features, components, and/or details of any other embodiments disclosed herein: wherein the first shell comprises a helically corrugated steel pipe or round steel pipe, or any combination thereof; wherein the foundation pile assembly includes a second pile section, the second pile section having a shell configured to be coupled with the shell of the first pile section at the first end of the shell of the first pile section; wherein the first pile section can be a bottom pile section and the second pile section can be a top pile section; wherein the foundation pile assembly includes a plurality of reinforcement straps coupled with an outside surface of the shell of the first pile section and an outside surface of the shell of the second pile section, where the shell of the second pile section couples with the shell of the first pile section so that the plurality of reinforcement straps overlap a joint between the shell of the first pile section and the shell of the second pile section; wherein the cap can be coupled to the shell of the first pile section with one or more welds on an outside surface of the wall of the shell; wherein the first portion comprises a steel plate; wherein the second portion of the impact support element comprises a plurality of straight reinforcement bars and at least one coil shaped reinforcement bar surrounding the plurality of straight reinforcement bars; wherein impact support element comprises a short structural member; wherein the plurality of reinforcement members of the impact support element have a generally round cross-section; wherein the plurality of reinforcement members can be coupled to the first portion with one or more welds or other type of bond or attachment means; wherein the first concrete material can be a high strength concrete material having a compressive strength of at least 5,000 psi; wherein first pile section can be configured to receive a second concrete material in the interior space of the shell of the first pile section above the first portion of the impact support element; wherein the first concrete material can be a high strength concrete material having a compressive strength of at least 7,000 psi; wherein the foundation pile assembly includes a plurality of reinforcement straps coupled with an outside surface of the shell of the first pile section adjacent to or overlapping a portion of the shell where the impact support element can be positioned; wherein the shell has one or more openings in the wall of the shell configured to receive a flowable concrete mix therethrough and one or more covers configured to be coupled with the shell to cover the one or more openings after the concrete mix has been added to the interior space of the shell; and/or wherein the second pile section can be configured to be coupled with the first pile section before the first pile section is completely driven into a subsurface soil.

Also disclosed herein are embodiments of a method for making a foundation pile assembly. In some embodiments, the method can include placing a first shell of a first foundation pile section on a surface in a generally horizontal orientation, wherein the first shell has an interior space, the first shell further that can include a first end and a second end opposite the first end, coupling an end cap to a second end of the first shell, placing an impact support element within the interior space of the first shell when the first shell can be in the generally horizontal orientation, the impact support element that can include a first portion and a second portion, creating at least one closeable opening on an exterior surface of the first shell, securing a first plurality of reinforcement straps on the first shell adjacent to the impact support element, inserting a first flowable material into the interior space of the shell through the at least one closeable opening such that the first flowable material substantially fills the interior space between the end cap and the first portion of the impact support element, coupling a cover member to the first shell to cover the at least one closeable opening, lofting and aligning the foundation pile section over a desired location, and driving the foundation pile section in a subsoil in an orientation that can be generally vertical.

In some embodiments, the method can include coupling a second shell of a second foundation pile section to the first shell of the first pile section when the first end of the first shell of the first pile section can be above a surface of the ground and the second end of the first shell of the first pile section can be in the ground. In some embodiments, the method can include coupling a second plurality of reinforcement straps to an outside surface of the first shell and the second shell such that the second plurality of reinforcement straps span between the first shell and the second shell. In some embodiments, the method can include inserting a driving unit through an interior space of the second shell until the driving unit contacts the first portion of the impact support element of the first pile section and applying a driving force to the driving unit until the second pile section reaches a desirable depth in the ground. In some embodiments, the method can include filling the interior space of the second shell with a second concrete material after the driving unit has been removed.

BRIEF DESCRIPTION OF THE DRAWINGS

Various examples are depicted in the accompanying drawings for illustrative purposes and should in no way be interpreted as limiting the scope of the examples. Various features of different disclosed examples can be combined to form additional examples, which are part of this disclosure.

FIG. 1B-1 illustrates the foundation pile assembly of FIG. 1B with an optional bottom reinforcement element according to the embodiment of the foundation pile assembly as shown in FIG. 1.

FIG. 1P-1 illustrates the complete foundation pile assembly of FIG. 1P with an optional bottom reinforcement element according to the embodiment of the foundation pile assembly shown in FIG. 1.

DETAILED DESCRIPTION

Figure 1:
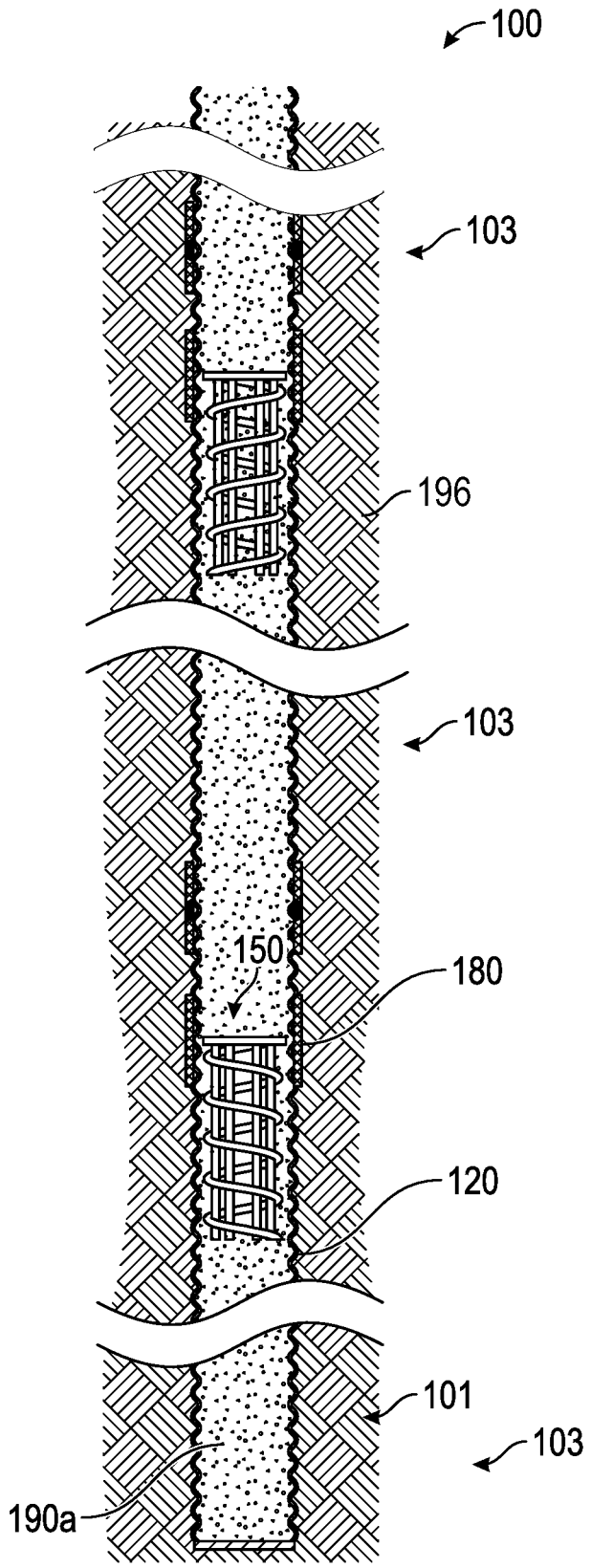
FIG. 1 illustrates a complete foundation pile assembly, including a plurality of impact support elements, in use according to an embodiment of a foundation pile assembly.

The various features and advantages of the systems, devices, and methods of the technology described herein will become more fully apparent from the following description of the examples illustrated in the figures. These examples are intended to illustrate the principles of this disclosure, and this disclosure should not be limited to merely the illustrated examples. The features, components, and other details of the illustrated examples can be modified, combined, removed, or substituted as will be apparent to those of ordinary skill in the art upon consideration of the principles disclosed herein.

As discussed above, a need exists for improved and more efficient foundation piles or pile assemblies that can accommodate various soil conditions. The various embodiments of the foundation piles (also referred to as pile assemblies) disclosed herein can allow for foundations piles to be manufactured and installed more efficiently, to be subject to a superior quality control and inspection process, and to allow the user to select and configure a lower material cost pile assembly that achieves an optimum combination of side (skin) friction capacity and end (tip) bearing capacity.

Disclosed herein are embodiments of foundation pile assemblies 100 and foundation pile sections 103. In some embodiments, the pile assemblies 100 can include one or more pile sections 103. The pile section 103 can be a bottom section 101 (also referred to herein as a bottom pile section), one or more top sections 102 (also referred to herein as top pile sections), and/or other sections described herein. As will be discussed, any of the sections discussed herein can have an impact support element configured to strengthen a portion of the pile section where stresses during installation can be the highest. Though, as will be apparent, some embodiments of the pile sections 103 disclosed herein can be made without an impact support element. Although the present disclosure may refer to certain sections as the top section, such reference does not imply that the top section is the upper most section and/or there cannot be another section on top of the top section. Any of the pile assemblies disclosed here can have any number of pile sections 103. For example, while the top section 102 can be the upper most section in some embodiments, additional sections can be added to (e.g., above) the top section 102.

FIG. 1 illustrates one example embodiment of a complete foundation pile assembly 100. As shown, the foundation pile assembly 100 can include a plurality of pile sections 103. Some embodiments of the foundation pile assembly 100 can include only one pile section. In any embodiments, one or more or, in some embodiments, all of the pile sections 103 can include an impact support element. As mentioned, the foundation pile assembly 100, or any other foundation pile assembly disclosed herein, can include one or a plurality of pile sections 103. Any of the pile sections 103 can be positioned in any of a variety of positions in the foundation pile assembly 100. For example, a pile section 103 can be positioned at the bottom of the foundation pile assembly 100 and can be referred to as a bottom section 101 (where the bottom refers to the bottom of the foundation pile assembly when the foundation pile assembly is installed in the ground). Similarly, for example, a pile section 103 can be positioned at the top of the foundation pile assembly 100 and can be referred to as a top section 102 (where the top refers to the top of the foundation pile assembly when the foundation pile assembly is installed in the ground). Additionally, as mentioned, a top pile section 102 can be positioned above but adjacent to a bottom pile section, with another top pile section 102 being coupled to an upper end of the top pile section 102 that is coupled to the bottom pile section. In some embodiments, each foundation pile section 103 can have, but is not required to have, a shell (such as shell 120), a flowable material that hardens with a passage of time (such as a first cured material 190*a*, which can be concrete), a reinforcement strap (such as reinforcement strap 180), an impact support element (such as an impact support element 150), and/or other elements.

Figure 1A:
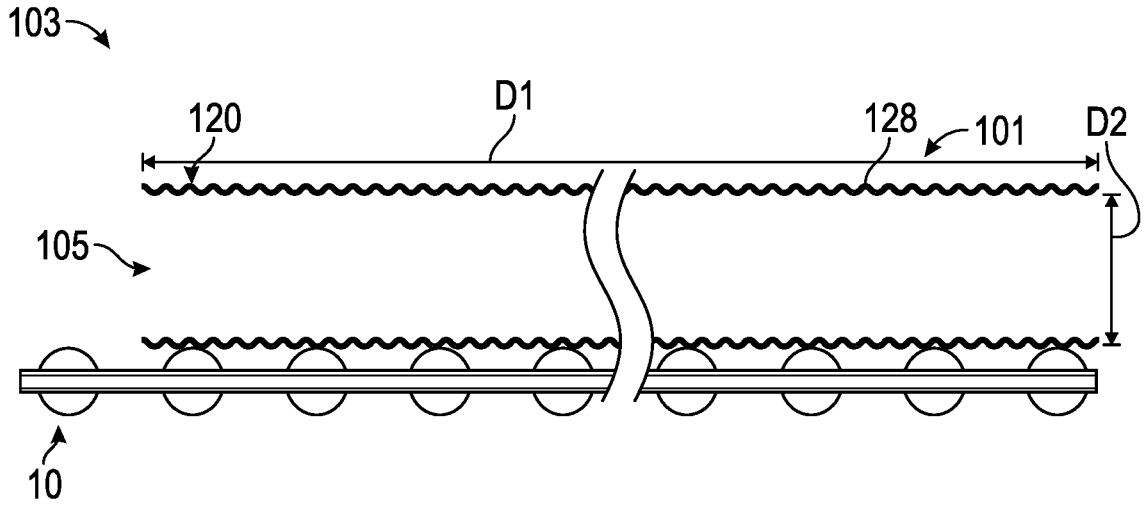
FIG. 1A illustrates a side view of a first shell on a rack according to an embodiment of the foundation pile assembly shown in FIG. 1.

FIG. 1A illustrates a side section view of an embodiment of a foundation pile section 103 at an initial stage of fabrication. As mentioned, any embodiments of the foundation pile assembly 100 disclosed herein can include one or a plurality of foundation pile sections 103. As will be described, depending on its intended use and position in the overall pile assembly, each pile section 103 can have a variety of different components and elements. In any embodiments, each pile section 103 can include a shell 120. For the pile sections 103 that are to be used as a bottom section 101, the pile section 103 or bottom section 101 can include a shell 120, a cap 110 (also referred to herein as an end cap or bottom cap), an impact support element 150, and other components and elements that will be described. FIG. 1A shows an illustration of a bottom section 101 in an early stage of production. The bottom section 101 can be used by itself and be the only pile section 103 in the foundation pile assembly 100, or can be used with any number and/or combination of other pile sections 103, including without limitation other bottom sections 101, top sections 102, or other pile sections.

As shown in FIGS. 1A-1I, the embodiment of the bottom section 101 shown therein can have a shell 120, a cap 110, and an impact support element 150, in addition to other components and elements to be described. Any of the embodiments of the pile sections 103 disclosed herein, including any embodiments of the bottom section 101, can be fabricated and/or assembled on a rack 10. The shell 120 can be made from corrugated steel pipe (CSP) or round steel pipe (RSP). The steel can be a carbon steel and/or other alloy, grade and/or type of steel. Any embodiments of the corrugated steel pipe shells disclosed herein can have a helix angle from 4 or about 4 degrees to 45 degrees or about 45 degrees. The corrugated steel pipe shells and round steel pipe shells of some embodiments of the pile sections disclosed herein have lighter weight and have lesser thickness than the shells used in conventional pile systems. The shell thickness to shell diameter ratio can be very low. Depending on the soil and environmental conditions, in some embodiments, the thickness of the shell can be equal to or less than about 0.75% of the diameter of the shell. In some embodiments, the thickness of the shell can be as low as 0.125% or lower of the diameter of the shell. The following Table 1 shows nonlimiting examples of different sizes and thicknesses of lightweight pipes (low thickness to diameter ratio pipes) that can be used as the shell in some embodiments of the pile sections 103 disclosed herein.

TABLE 1

| Example Diameter of CSP or RSP (inches) | Example Thickness of CSP or RSP (inches) |
|---|---|
| 6 | 0.0450 (or 18 gauge) |
| 7 | 0.0525 (or 17 gauge) |
| 8 | 0.0600 (or 16 gauge) |
| 9 | 0.0675 (or 15 gauge) |
| 10 | 0.0750 (or 14 gauge) |
| 11 | 0.0825 |
| 12 | 0.0900 (or 13 gauge) |
| 13 | 0.0975 |
| 14 | 0.1050 (or 12 gauge) |
| 15 | 0.1125 |

TABLE 1-continued

| Example Diameter of CSP or RSP (inches) | Example Thickness of CSP or RSP (inches) |
|---|---|
| 16 | 0.1200 (or 11 gauge) |
| 17 | 0.1275 |
| 18 | 0.1350 (or 10 gauge) |
| 19 | 0.1425 |
| 20 | 0.1500 (or 9 gauge) |
| 21 | 0.1575 |
| 22 | 0.1650 (or 8 gauge) |
| 23 | 0.1725 |
| 24 | 0.1800 (or 7 gauge) |
| 25 | 0.1875 |
| 26 | 0.1950 (or 6 gauge) |
| 27 | 0.2025 |
| 28 | 0.2100 (or 5 gauge) |
| 29 | 0.2175 |
| 30 | 0.2250 (or 4 gauge) |
| 31 | 0.2325 |
| 32 | 0.2400 (or 3 gauge) |
| 33 | 0.2400 (or 3 gauge) |
| 34 | 0.2400 (or 3 gauge) |
| 35 | 0.2400 (or 3 gauge) |
| 36 | 0.2400 (or 3 gauge) |
| 48 | 0.2400 (or 3 gauge) |
| 60 | 0.2400 (or 3 gauge) |
| 72 | 0.2400 (or 3 gauge) |
| 84 | 0.2400 (or 3 gauge) |
| 96 | 0.2400 (or 3 gauge) |
| 108 | 0.2400 (or 3 gauge) |
| 120 | 0.2400 (or 3 gauge) |
| 144 | 0.2400 (or 3 gauge) |
| 156 | 0.2400 (or 3 gauge) |
| 168 | 0.2400 (or 3 gauge) |
| 180 | 0.2400 (or 3 gauge) |
| 192 | 0.2400 (or 3 gauge) |

Although the various embodiments of the piles disclosed herein are discussed with respect to a corrugated shell, such as corrugated steel pipe (CSP), other types of pipes, such as round steel pipe (RSP), can be used in combination with the piles discussed in the present disclosure.

The shell 120 can have an inside surface and an outside surface. The outside surface can also be referred to as a perimeter side 128. In some embodiments, the perimeter side can be an exterior surface of a pipe having a generally circular cross section. The shell 120 can be manufactured to have a variety of different light (low) thicknesses within the range shown in the above table. The perimeter side 128 can be configured to contact a subsurface element such as subsurface soil 196 (also referred to as subsoil 196) as discussed further below. In some embodiments, the perimeter side 128 of the shell 120 can include a plurality of corrugations configured to increase the friction of the casing with the surrounding soil. The corrugations can be helically arranged along a length of the shell 120. In certain embodiments, the corrugations can include a pitch distance from 1 inch or about 1 inch to 5 inches or and about 5 inches where the pitch distance is the distance between one crest to an adjacent crest. In some embodiments, the corrugations can include a corrugation depth from ¼ inch or approximately ¼ inch to 1 inch or about 1 inch. Each of the above dimensions is considered to be illustrative and not limiting. U.S. Pat. No. 10,676,888, the entirety of which is incorporated by reference here, describes embodiments of corrugated shell bearing piles and some advantages of using corrugated shell bearing piles. Any embodiments of the foundation piles (or foundation pile assemblies), components thereof, and/or methods of use thereof disclosed herein can have any combination of the components, features, and/or details of any of the embodiments of the piles, including without limitation, the corrugated shell bearing piles, disclosed in U.S. Pat. No. 10,676,888, which components, features, and/or details are hereby incorporated by reference as if fully and explicitly set forth herein.

The length of the shell 120 can be any length up to 90 feet or about 90 feet or it can be shorter or longer, for example and without limitation, up to 100 feet or about 100 feet, or up to 110 feet or about 110 feet, or up to 120 feet or about 120 feet, or shorter or longer. The shell 120 can be steel. The shell 120 can be manufactured to have different diameters, for example, and without limitation, between 6 inches or about 6 inches to 36 inches or about 36 inches, or up to 48 inches, about 48 inches, or more than 48 inches, or up to or 60 inches, about 60 inches, or more than 60 inches, or up to or 192 inches, about 192 inches, or of any value, approximate value, or range of values in any of the foregoing ranges, as needed for the desired loading capacity. For example, larger diameter shells (or pipes) can increase the loading capacity of the foundation piles.

In any embodiments disclosed herein, the impact support element can have an overall length in a lengthwise direction that is from 3%, about 3%, or less than 3%, to 13%, about 13%, or less than 13% of an overall length of the shell that the impact support element is positioned within, or of any values or ranges of values in any of the foregoing ranges.

A user can place the shell 120 on a rack 10. Although FIG. 1A illustrates the rack 10 including a plurality of rollers, such rollers are for illustration purposes and are not necessary. Also disclosed herein are embodiments of a rack that do not have any rollers. As will be discussed in more detail with respect to FIG. 9A and FIG. 9B, the rack 10 can be manufactured from different materials.

Figure 1B:
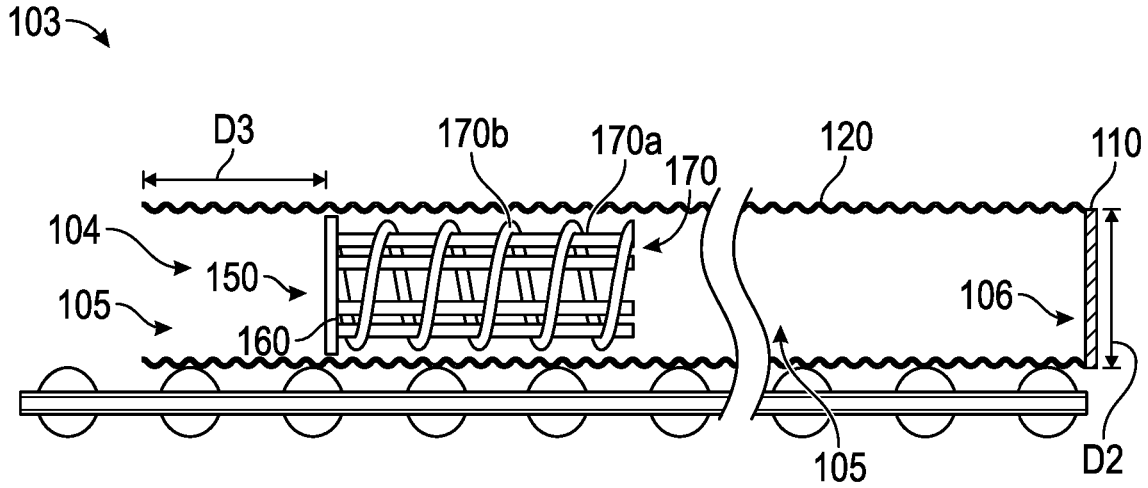
FIG. 1B illustrates a side view of the shell of FIG. 1A with an impact support element placed in the interior of the shell, and an end cap, according to the embodiment of the foundation pile assembly shown in FIG. 1.
Figures 1, 1B:
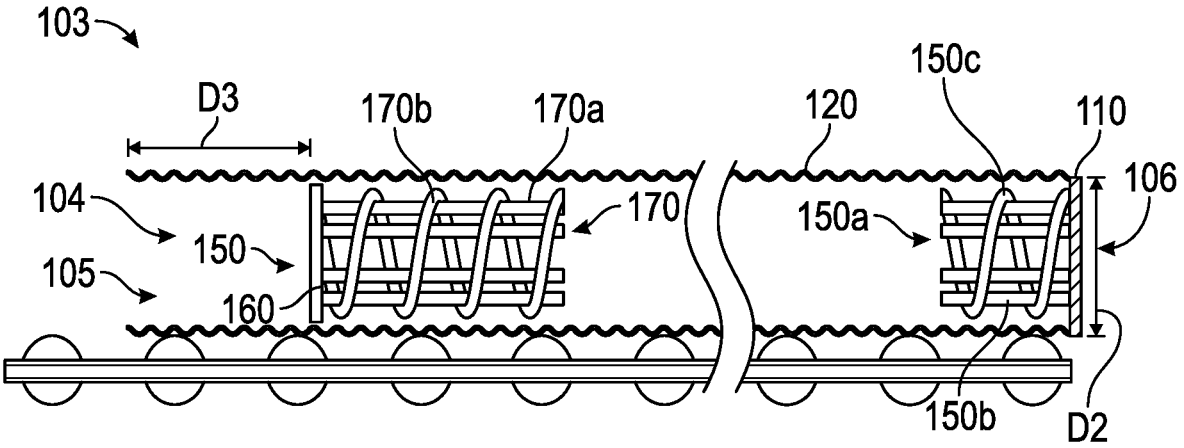

FIG. 1B illustrates a side view of a portion of the foundation pile section 103, including the first shell 120 and an impact support element 150 positioned within an interior space of the first shell 120. Additional details regarding the impact support element 150 will be described below. As with any embodiments of the foundation pile section disclosed herein, the shell 120 of the embodiment of the foundation pile section shown in FIG. 1B can have a first end, a second end, a circumferential wall extending from the first end to the second end thereof, and an interior space within the wall. Additionally, the foundation pile section 103 can have a first end 104 and a second end 106, where the second end 106 is opposite the first end 104.

The foundation pile section 103 can include a cap 110, also referred to as an end cap, that can be positioned at the second end of the foundation pile section 103 or the second end of the shell 120. In some embodiments, the cap can be a flat, circular plate of sufficient thickness to withstand the impact with the subsurface soil. In some embodiments, the cap can also have a circumferential wall that is coupled with the circular plate. In some embodiments, the cap 110 can extend in a lengthwise direction (e.g., 3 inches, about 3 inches, or more than 3 inches, 5 inches, about 5 inches, or more than 5 inches) beyond the second end of the shell for additional (tip embedment) support. In some embodiments, the cap can have an end surface that improves the ability of the end cap to penetrate into the subsoil. For example and without limitation, in any embodiments of the cap disclosed herein of any foundation pile section embodiments, the end cap can have a pointed or generally pointed end surface, or a spherical or curved end surface. The cap 110 can be the same or different material than the shell 120. The cap 110 can be coupled to the shell 120 through any of a variety of different mechanisms. For example, the cap 110 can be welded to the shell 120 or mechanically fastened to the shell 120. The cap 110 can be attached to the shell 120 permanently, or it can be attached to the shell 120 such that it is removable (prior to loft). In some embodiments, the dimension D2 of the cap 110 is the same (matching cross-section) size, or slightly larger in size (cross-section), as the outside diameter of the first shell 120.

FIG. 1B-1 illustrates a side section view of a portion of the foundation pile section 103, including the first shell 120 with an impact support element 150 positioned in the interior space of the first shell 120 and a bottom reinforcement element 150*a* positioned at the second end 106 of the shell 120. In some embodiments, the bottom reinforcement element 150*a* can be coupled with the cap. The bottom reinforcement element can be configured to increase the strength of a second end portion of the foundation pile section, to improve the ability of the foundation pile section to withstand the forces resulting from the impact of the second end of the foundation pile section with the subsurface material. The optional bottom reinforcement element 150*a* can include a plurality of different reinforcement bar members, including any number of straight reinforcement members 150*b* and one or a plurality of curved reinforcement members 150*c* either surrounding (as shown) or inside of all or some of the straight reinforcement members 150*b*, or in any other desired arrangement. For example, in some embodiments, at least some of the reinforcement bars can be straight and can extend in a lengthwise direction within the interior space of the shell (i.e., generally parallel with the longitudinal axial centerline of the shell and the foundation pile section). In some embodiments, the reinforcement bars 150*b* can extend in a direction that is generally perpendicular to an inside facing surface of the cap 110. In any embodiments disclosed herein, the straight and/or curved reinforcement bars of the bottom reinforcement element 150*a* can be coupled with the cap. In any embodiments, as with any embodiments of the impact support element, the straight reinforcement bars of the bottom reinforcement element 150*a* can be arranged in an array. In some embodiments, any of the reinforcement bars can be circular, spiral, etc. or a combination of the foregoing. In any embodiments of the impact support element and/or the bottom reinforcement element, any of the reinforcement bars can be made from rebar in any desired thickness.

FIG. 1B-1 illustrates an embodiment of a bottom reinforcement element 150*a* that includes a plurality of straight reinforcement members 150*b* arranged in a circular array and at least one curved reinforcement member 150*c* surrounding an outside surface of the straight reinforcement members 150*b* arranged in the circular array. In some embodiments, the curved reinforcement member 150*c* can be spiral as illustrated in FIG. 1B-1. The reinforcement bar members of the optional bottom reinforcement element 150*a* can extend to any suitable length in a direction parallel to the plane of the shell 120 in the interior space of the shell 120. In some embodiments, the optional bottom reinforcement element 150*a* can be connected to or coupled with the cap 110. In some embodiments, the optional bottom reinforcement element 150*a* can be connected to the cap 110 with one or more welds. In some embodiments, the bottom reinforcement element 150*a* can provide a range of advantages. For example, and without limitation, in some embodiments, the optional bottom reinforcement element 150*a* can provide additional reinforcement at the bottom end of the foundation pile section 103 and provide additional strength to the foundation pile section 103 when a portion of the foundation pile section 103 is being driven into the subsurface material, including in very dense soil or rock. It is noted that any or all embodiments of the foundation piles disclosed herein can be constructed and used with or without the optional bottom reinforcement element 150*a*.

As mentioned, though not required, any embodiments of the foundation pile sections disclosed herein can include an impact support element 150. The impact support element 150 can be fabricated prior to being positioned inside the interior space of the shell 120. In some embodiments, the impact support element 150 can be placed in the interior space of the shell 120 on the ground while the shell 120 is in a horizontal or slightly angled position. The impact support element 150 can be placed in the interior space of the shell 120 before the shell 120 or the foundation pile section is driven subsurface. The impact support element 150 can include a first portion 160 (also referred to herein, with regard to any impact support element embodiments disclosed herein, as an upper portion or an upper element) and a second portion 170 (also referred to herein, with regard to any impact support element embodiments disclosed herein, as a lower portion or lower element). The first portion 160 can be or can include a plate or other rigid support element that can extend across an interior space of the shell 120. The first portion 160 can be manufactured to have a variety of thicknesses, shapes, and materials. In some embodiments, the first portion 160 can be a plate having a thickness of 1 inch, about 1 inch, or more than 1 inch, or having a thickness of 2 inches, about 2 inches, or more than 2 inches, or having a thickness of 3 inches, about 3 inches, or more than 3 inches, or having a thickness of 4 inches, about 4 inches, or more than 4 inches, or having a thickness of 5 inches, about 5 inches, or more than 5 inches, or from 1 inch or about 1 inch to 5 inches, about 5 inches, or more than 5 inches, or of any value, approximate value, or range of values within any of the foregoing ranges. In some embodiments, the first portion 160 can be circular or any appropriate or desired shape. In some embodiments, the first portion 160 can be manufactured from steel or other suitable materials. In some embodiments, the size and or dimension of the first portion 160 can correspond to the shape (or interior circumference) of the shell. For example, and without limitation, in some embodiments, the first portion 160 can extend across all or substantially all of the interior space of the shell so that a first main surface of the first portion 160 is generally perpendicular to a longitudinal axial centerline of the shell 120. In some embodiments, the first portion 160 can extend across 85% or more or about 85% or more of the interior space of the shell 120, or across 99% or more or about 99% or more of the interior space of the shell 120, or so that the first portion 160 can be welded to an inside surface of the shell at two or more portions or points on the first portion 160 or otherwise secured to an inside surface of the shell at two or more portions or points on the first portion 160. In any embodiments, the first portion of the impact support element can be configured to withstand the impact forces imparted directly on the first portion of the impact support element from a mandrel or otherwise when the foundation pile section is being driven in the ground.

In some embodiments, as mentioned, the impact support element 150 or a portion of the impact support element 150 can be coupled to with the shell 120. For example, and without limitation, in some embodiments, the impact support element 150 or a portion of the impact support element 150 can be coupled to with the shell 120 by welding the impact support element 150 or a portion of the impact support element 150 to an inside surface of the shell 120. In some embodiments, the first portion 160 of the impact support element 150 and/or the second portion 170*b* of the impact support element 150 can be welded to the shell 120.

The impact support element 150 can include a second portion 170. In some embodiments, the second portion 170 can include one or more reinforcement members or reinforcement bar members of different thicknesses and materials that are coupled to the first portion 160 by any of a variety of methods or using any of a variety of fastening elements, including, without limitation, welding. For example, the second portion 170 can include one or a plurality of straight reinforcement member 170*a* (e.g., 4, 5, 6, 7, 8 or more straight reinforcement members 170*a*) and one or more curved reinforcement members 170*b*. In any embodiments of the impact support element disclosed herein, at least some of the straight reinforcement members 170*a* can be arranged in a circular array. One or a plurality of additional straight reinforcement members 170*a* can be positioned within the circular array of straight reinforcement members 170*a* or outside of the circular array of straight reinforcement members 170*a*. For example, and without limitation, some embodiments of the impact support element 150 can have a straight reinforcement member 170*a* positioned to be generally coaxial with the longitudinal axial centerline of the shell. Any embodiments of the impact support element disclosed herein can also have at least one curved reinforcement member 170*b* or two or more curved reinforcement members 170*b* surrounding an outside surface of the straight reinforcement members 170*a* arranged in the circular array.

Any of the straight reinforcement members 170*a* and/or the curved reinforcement members 170*b* can be threaded rods or reinforcement bar members, such as rebar rods (also referred to herein as reinforcement bars) ranging from #3 rebar to #18 rebar. The second portion 170 of some embodiments of the impact support element can include a plurality of straight reinforcement members 170*a* and one or more or a plurality of curved reinforcement member(s) 170*b* (or spiral/bent). The straight reinforcement members can extend at an angle that is perpendicular to the top plate (corresponding to the first portion 160). The round (or spiral) reinforcement bars can surround the straight reinforcement bars. The round or spiral reinforcement bars can range from #3 rebar to #18 rebar. In some embodiments, the bottom section of the entire impact support element 150 or the entire impact support element 150 can be fabricated in the shop or in the field. The spiral reinforcement bars can be welded (or tack welded) to the straight reinforcement bars and/or the first portion 160. In some embodiments, the spiral reinforcement bars can be coupled with the straight reinforcement bars utilizing other mechanisms, such as tie wires. In some embodiments, the reinforcement bars can have a generally round cross section. In some embodiments, the reinforcement bars of the bottom section can be welded to the first portion 160. Other attachment mechanisms, such as the use of adhesive and/or threaded connections can also be utilized. In some embodiments, the straight reinforcement bars can be coupled with the first portion such that the straight reinforcement bars are oriented parallel with the longitudinal axial centerline of the first shell.

In some embodiments, the impact support element(s) can include an H beam coupled with the first portion and extending away from a distal facing surface of the first portion, a pipe coupled with the first portion and extending away from a distal facing surface of the first portion, one or more threaded members coupled with the first portion and extending away from a distal facing surface of the first portion, or any other structural member that increases the strength of the foundation pile section in the region of the impact support element or steel plate. In any embodiments disclosed herein, the second portion of the impact support element can be relatively short compared to the overall length of the section (e.g., 3%, approximately 3%, or less than 3% of the overall length of the pile section, or 5%, approximately 5%, or less than 5% of the overall length of the pile section, or 8%, approximately 8%, or less than 8% of the overall length of the pile section, or 13%, approximately 13%, or less than 13% of the overall length of the pile section, or from 3% or approximately 3% to 13% or approximately 13%, or more than 13% of the overall length of the pile section, or of any value, approximate value, or range of values within any of the foregoing ranges).

The impact support element 150 can be positioned in the interior space of the shell 120. Although the impact support element is described in various embodiments with respect to utilizing reinforcement bars in the bottom section, the use of such reinforcement bars is not necessary. For example, in some embodiments, a short steel pipe section or any steel cross section (such as a short H section or any surplus steel) that can provide the required strength can be used to manufacture the bottom section of the impact support element. In some embodiments, the reinforcement assembly 150 can consist of a number of reinforcement bars such that the total cross-sectional area of the reinforcement bars is typically 2% or about 2% to 4% or about 4% of the cross-sectional area of the shell 120. In some embodiments, the reinforcement assembly 150 can include a reinforcing spiral around the perimeter of the reinforcing bars to form a rebar cage assembly that can be about 3 feet to about 6 feet in length and can be attached to and underneath first portion 160. In some embodiments, values such as thickness of the first plate, the length of the reinforcement members, and/or number of reinforcement members disclosed herein can vary from the stated values, for example and without limitation, as much as 5%, 10%, 20%, or more than 20% of the stated values.

In some embodiments, the impact support element 150 can have an overall length of 3 feet or approximately 3 feet, or 4 feet or approximately 4 feet, or from 2 feet or approximately 2 feet or less than 2 feet to 5 feet or approximately 5 feet or more than 5 feet, or of any value within these ranges. In some embodiments, the impact support element 150 can have an overall length that is 3% or approximately 3% of a length of the shell that the impact support element 150 is positioned within, or from 13% or approximately 13% of a length of the shell that the impact support element 150 is positioned within, or of any value or range of values in any of the foregoing ranges.

The impact support element 150 can have a proximal end and a distal end. In some embodiments, the first portion 160 can be proximally positioned relative to the second portion 170, which can be positioned closer to the second end of the foundation pile section (i.e., closer to the lowermost or bottom end of the foundation pile section when the foundation pile section is completely or partially in the ground) than the first portion 160. In some embodiments, the first portion 160 can be offset from the first end of the shell 120 so as to create a space from the proximal or first end of the shell to a top surface of the impact support element. This offset distance is represented by D3 in FIG. 1B.

In some embodiments, the first section of the impact support element can be offset from the first or proximal end of the shell by a distance D3 of from 1 inch or about 1 inch to 4 feet or about 4 feet away from the first end 104 of the foundation pile assembly 100, or from 6 inches or less to 2 feet or approximately 2 feet or more than 2 feet, or from 1 foot or about 1 foot to 4 feet or approximately 4 feet or more than 4 feet, or from 6 inches or less to 1 foot or approximately 1 foot, or from 1 foot or approximately 1 foot or less than 1 foot to 3 feet or approximately 3 feet away from the first end 104 of the foundation pile section 103, or of any values or ranges of values within any of the foregoing ranges.

In some embodiments, the impact support element 150 can be positioned within the interior space 105 of the first shell 120 such that it creates a first interior space and a second interior space. The first interior space can be the space between the first portion 160 and the interior face of the cap 110 at the second end of the foundation pile section. The second interior space can be the interior space between the first portion 160 of the impact support element 150 and the first end 104 (i.e., the space corresponding to dimension D3 in FIG. 1C). In some embodiments, the first interior space can have a first volume that is 88%, about 88%, or less than 88% to 99%, about 99%, or more than 99% of a total internal volume of the interior space 105 of the shell 120, or of any values or ranges of values within any of the foregoing ranges. In some embodiments, the second interior space can have a second volume that is 1% or about 1% to 12%, about 12%, or more than 12% of a total internal volume of the interior space 105 of the shell 120, or of any values or ranges of values within any of the foregoing ranges, of the total internal volume of the interior space 105 of the shell 120.

In some other embodiments, the impact support element 150 can be moved within the interior space 105 closer to the first end 104 or farther away from the first end 104 such that the combination of volumes corresponding to the first interior space and the second interior space varies. For example, the first interior space can have a first volume that can be 85% or about 85% or 82% or about 82% or 75% or about 75% of the total volume of the interior space 105, and the second interior space can have a second volume that can be 15% or about 15% or 18% or about 18% or 25% or about 25% of the total volume of the interior space 105. In some embodiments, as discussed further below, the first interior space can be filled with a flowable material that can be different from the flowable material that is used to fill the second interior space.

In any embodiments of the foundation support sections disclosed herein, the pile can be configured such that a higher strength concrete is added to the shell in an upper portion of the shell, around the impact support element, in a portion of the shell where the impact support element is positioned, and/or in a portion of the shell where the impact support element is positioned plus an additional 10%, 20%, or 30% of the length of the portion of the shell having the impact support element therein. In some embodiments, a lower strength or lower cost concrete material can be used to fill the remaining portion(s) of the shell.

Figure 1C:
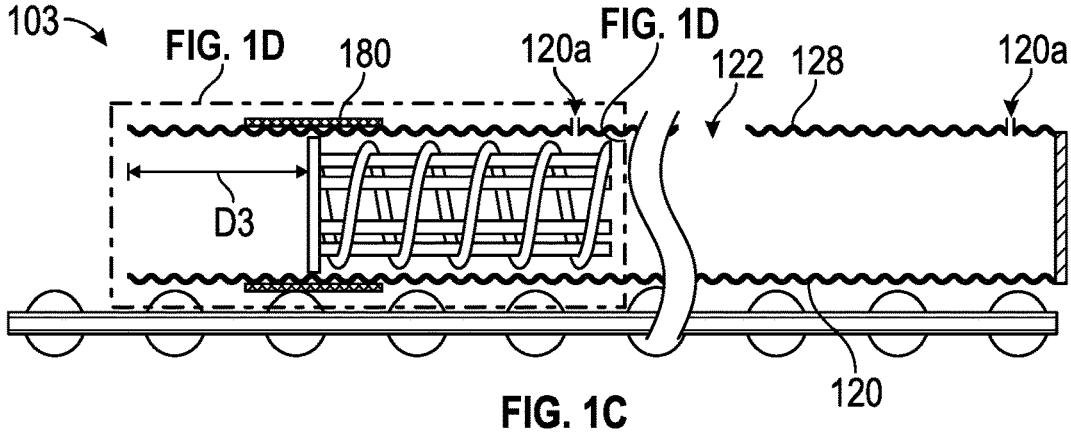
FIG. 1C illustrates a cut-out and attachment of a reinforcement strap according to the embodiment of the foundation pile assembly as shown in FIG. 1.

FIG. 1C illustrates a side view of an embodiment of some components of the foundation pile assembly 100. In some embodiments, the user can make one or more minor penetration(s) or bolt hole(s), such as penetration 120*a* to allow for air escape. In some embodiments, the user can create or the shell can have one or more openings. In some embodiments, the openings can be closed, covered, or sealed off by cover elements, which can be portions of the pipe (corrugated or otherwise). The closeable openings can be, without limitation, a cut-out such as the first cut-out 122. In any embodiments disclosed herein, the one or more cut-outs formed in the shell can be prefabricated openings or can be openings cut out of the wall of the shell after fabrication of the shell. The closeable openings can be made through the wall of the shell 120. In some embodiments, the closable openings can be made close to or near the first end 104 or the second end 106. The closeable openings can be used to accommodate placing a flowable material (e.g., concrete) into the interior of shell 120 by providing an opening for the flowable material to pass through to enter the interior space.

One or more reinforcement straps 180 can be coupled to the perimeter side (i.e., outside surface) 128 of the shell 120. In any embodiments of the foundation support sections disclosed herein, the reinforcement straps 180 can be 4 feet or about 4 feet long, or 5 feet or about 5 feet long, or from 3 feet or about 3 feet to 6 feet or about 6 feet long, or more than 6 feet long, or from 4 feet or about 4 feet to 7 feet or about 7 feet long, or any values or ranges of values in any of the foregoing ranges. In any embodiments of the foundation support sections disclosed herein, the reinforcement straps 180 can be long enough to extend at least 1 foot or about 1 foot, or 2 feet or about 2 feet past the first portion 160 in the distal direction (i.e., toward the bottom end of the pile section). In some embodiments of the foundation support sections disclosed herein, the reinforcement straps can include steel plates. In some embodiments, the reinforcement straps 180 can include an arc quadrant cutout from the same type of material as is used for the shell 120. In some embodiments, the inner face of the reinforcement straps 180 can be placed on and aligned with the exterior surface of the shell 120. The longitudinal sides of the reinforcement straps 180 (parallel with a longitudinal axis of the shell 120) can be welded to the perimeter side of the shell 120. In some embodiments, two 90-degree arc quadrant cutout reinforcement straps 180 are welded on opposite sides of the shell 120 and spaced at equidistant arc intervals. It is noted that, if the user determines more reinforcement straps 180 are necessary, additional cutouts can be coupled to the perimeter side of the shell 120. For example, a set of three straps can be attached at 60 degrees apart to provide more reinforcement.

The reinforcement straps can include or be made from steel or any suitable material to provide additional reinforcement to the shell 120. In any embodiments of the foundation support sections disclosed herein, the reinforcement straps 180 can be positioned along a length direction of the shell 120 and around an outside surface of the shell 120. The reinforcement straps 180 can provide additional strength to the shell 120 at or adjacent to the area of the shell 120 where the impact support element is positioned (e.g., around, or adjacent to the area of the shell 120 where the first portion 160 of the impact support element is positioned). In any embodiments of the foundation support sections disclosed herein, the reinforcement straps 180 can be positioned where the foundation pile section 103 experiences higher relative stresses compared to other portion of the foundation pile section when the foundation pile section is being driven into the ground. Additionally, in any embodiments of the foundation support sections disclosed herein, the reinforcement straps 180 can be positioned so as to overlap a joint between adjacent foundation pile sections that are joined end to end. For example, in some embodiments, the reinforcement straps can be position and be long enough to extend in both directions relative to the joint between adjacent foundation pile sections by 1 foot, about 1 foot, or more than 1 foot, 2 feet, about 2 feet, or more than 2 feet, 3 feet, about 3 feet, or more than 3 feet, 4 feet, about 4 feet, or more than 4 feet, 5 feet, about 5 feet, or more than 5 feet, or from 1 foot or about 1 foot to 2 feet or about 2 feet, or from 1 foot or about 1 foot to 3 feet or about 3 feet, or of any values or ranges of values within any of the foregoing ranges, on both sides of the joint.

Additionally, in any embodiments of the foundation support sections disclosed herein, the reinforcement straps 180 that extend over a joint between two adjacent foundation support piles can also be long enough to extend past a portion of an impact support element in one of the foundation pile sections, such as the first portion of the impact support element. In any embodiments of the foundation support sections disclosed herein, the reinforcement straps 180 that extend over a joint between two adjacent foundation pile sections, as described above, can be long enough to extend past a portion of an impact support element in one of the foundation pile sections, such as the first portion of the impact support element, by 1 foot, about 1 foot, or more than 1 foot, 2 feet, about 2 feet, or more than 2 feet, 3 feet, about 3 feet, or more than 3 feet, 4 feet, about 4 feet, or more than 4 feet, 5 feet, about 5 feet, or more than 5 feet, or from 2 feet or about 2 feet to 6 feet or about 6 feet, or from 2 feet or about 2 feet to 5 feet or about 5 feet, or of any values or ranges of values within any of the foregoing ranges, past a portion such as the first portion of the impact support element.

In any embodiments of the foundation support sections disclosed herein, reinforcement straps 180 can extend on both sides of an impact support element, such as the first portion of the impact support element, regardless of whether the reinforcement straps 180 also cover a joint. Such reinforcement straps that extend on both sides of an impact support element can be in addition to or in the alternative to any straps that cover a joint between adjacent foundation pile sections. In any embodiments of the foundation support sections disclosed herein, reinforcement straps 180 can extend in a first direction toward the first end of the foundation pile section by 6 inches or about 6 inches, 1 foot, about 1 foot, or more than 1 foot, 2 feet, about 2 feet, or more than 2 feet, 3 feet, about 3 feet, or more than 3 feet, 4 feet, about 4 feet, or more than 4 feet, 5 feet, about 5 feet, or more than 5 feet, or from 2 feet or about 2 feet to 6 feet or about 6 feet, or from 2 feet or about 2 feet to 5 feet or about 5 feet, or of any values or ranges of values within any of the foregoing ranges, past a portion such as the first portion of the impact support element. In any embodiments of the foundation support sections disclosed herein, reinforcement straps 180 can extend in a second direction toward the second end of the foundation pile section by 1 foot, about 1 foot, or more than 1 foot, 2 feet, about 2 feet, or more than 2 feet, 3 feet, about 3 feet, or more than 3 feet, 4 feet, about 4 feet, or more than 4 feet, 5 feet, about 5 feet, or more than 5 feet, or from 2 feet or about 2 feet to 6 feet or about 6 feet, or from 2 feet or about 2 feet to 5 feet or about 5 feet, or of any values or ranges of values within any of the foregoing ranges, past a portion such as the first portion of the impact support element.

In any embodiments of the foundation support sections disclosed herein, reinforcement straps 180 can extend in a second direction toward the second end of the foundation pile section by 1 foot, about 1 foot, or more than 1 foot, 2 feet, about 2 feet, or more than 2 feet, 3 feet, about 3 feet, or more than 3 feet, 4 feet, about 4 feet, or more than 4 feet, 5 feet, about 5 feet, or more than 5 feet, or from 2 feet or about 2 feet to 6 feet or about 6 feet, or from 2 feet or about 2 feet to 5 feet or about 5 feet, or of any values or ranges of values within any of the foregoing ranges, past a distal end of the second portion of the impact support element.

In any embodiments of the foundation support sections disclosed herein, reinforcement straps 180 can extend further in the second direction than in the first direction. In some embodiments, the stresses exerted on the foundation pile section past the first portion of the impact support element (i.e., below the first portion of the impact support element) can be significantly greater than the stresses exerted on the foundation pile section above the first portion of the impact support element. In any embodiments, reinforcement straps can be added to any portion of the shell where the foundation pile section experiences higher relative stresses compared to other portions of the foundation pile section when the foundation pile section is being driven into the ground.

Figure 1D:
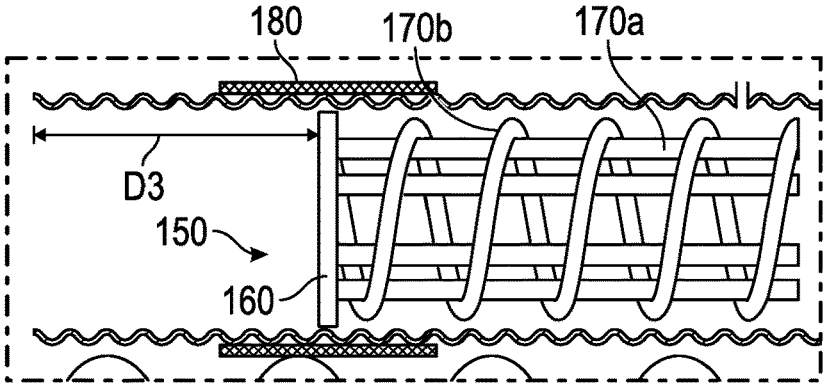
FIG. 1D illustrates a detail of FIG. 1C according to the embodiment of the foundation pile assembly as shown in FIG. 1.

Notably, the reinforcement strap 180 can be connected to the shell 120 while the foundation pile assembly 100 is in a horizontal or substantially horizontal orientation, such as when the shell is supported on a rack or on the ground, where the horizontal orientation refers to an orientation parallel to the plane of the horizon. In other embodiments of the method of using the foundation pile, the reinforcement strap 180 can be connected to the shell 120 while the foundation pile assembly 100 is in any desired orientation, including without limitation, a vertical or substantially vertical orientation. An advantage of performing many of the steps disclosed herein including, without limitation, filling the shell with concrete and attaching the reinforcement strap when the shell is in a horizontal or generally horizontal orientation, such as on a rack or on a ground surface, is that this arrangement can allow for a user to easily access the reinforcement straps 180 and the shell 120 for positioning and attachment, such as welding, and thus facilitates a quality connection and allows for easy access for inspection of such connection. Consequently, this arrangement can enhance the overall quality of the foundation pile assembly 100. FIG. 1D illustrates a detailed view of a section of FIG. 1C. Preferably, in some embodiments, the impact support element 150 is positioned closer to the first end 104 of the shell 120 than the second end 106.

Figure 1E:
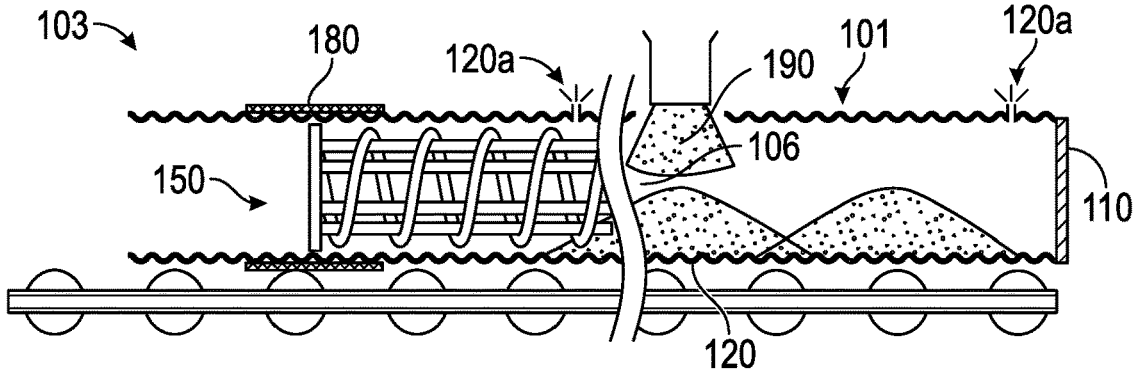
FIG. 1E illustrates filling the first shell with a flowable material through a cut-out according to the embodiment of the foundation pile assembly as shown in FIG. 1.

FIG. 1E illustrates a side view of some components of the foundation pile section 103 and illustrates a flowable material being added to the interior space within the shell 120. The user can utilize the closeable openings through the perimeter side 128 of the shell 120 to insert a first flowable material 190 in the shell 120 such that the interior space between the first portion 160 and the interior surface of the cap 110 is filled, or substantially filled, with the first flowable material 190. In some embodiments, the first flowable material 190 can be a flowable concrete mix having a strength of from 4000 psi or about 4000 psi to 9000 psi or about 9000 psi, or it can be a concrete mix having a compressive strength of higher than 9000 psi. In some embodiments, the first flowable material 190 can have a reasonably moderate high slump such as from 3 inches or about 3 inches to 5 inches or about 5 inches, or 3 inches or about 3 inches to 10 inches or about 10 inches, or higher, or of any value, approximate value, or range of values in any of the foregoing ranges. In some embodiments, the first flowable material 190 can have a slump such as from 3 inches or about 3 inches to 5 inches or about 5 inches. The user can fill, or substantially fill, the interior space 105 of the foundation pile section, which can be a bottom section 101, between about the first portion 160 of the impact support element 150 and the inside face of the cap 110 with the first flowable material 190 when a bottom section 101 is at a non-vertical orientation, for example and without limitation, when the shell 120 is in a horizontal or slightly angled position, such as when the shell 120 is positioned on the rack 10, when at least a portion of the shell 120 is supported by the rack 10, or when the shell 120 is on the ground, or otherwise. The perimeter side 128 of the shell 120 can define an interior space 105. In some embodiments, the first flowable material can be advanced into the interior space 105 via gravity and adhere to and bond with the interior of the shell 120 and the components of the impact support element, in addition to other components or elements within the shell, without the need for any centrifugal spinning or any type of spinning or rotation. In some embodiments, the bottom section 101, also referred to as bottom portion, can include the shell 120, the impact support element 150, the cap 110, the first flowable material 190 (or a first cured material 190*a* discussed below), one or a plurality of reinforcement straps 180, and a cover member 126. The bottom section 101 can be a bottom pile sub-assembly or a sub-assembly to the foundation pile assembly 100.

In some embodiments, the bottom section 101 can include one or a plurality of reinforcement straps 180 such as one, two, three, or any plurality of reinforcement straps 180. As discussed above, the reinforcement straps 180 can be positioned about the outside surface of the shell to provide additional strength to the foundation pile section. In some embodiments, a second shell 130 can be coupled to the shell 120, such as in an end-to-end arrangement. The second shell 130 and/or a second foundation pile section can be coupled to the shell 120 while the bottom section 101 is on the rack 10 or after the bottom section has been driven into the soil. In some embodiments, the user can place one or more impact support elements 150 and one or more closable openings on the additional shell 130. The second shell and/or the second foundation pile section or any additional pile sections used in a foundation pile assembly can have any of the same components, features, dimensions, and/or any of the details of any of the embodiments of the foundation pile sections disclosed herein, including for example and without limitation, any of the embodiments of the foundation pile section 103 described above. For example and without limitation, the second shell and/or the second foundation pile section or any additional pile sections used in a foundation pile assembly can have any embodiments of the impact support element, reinforcement straps disclosed herein, and/or any other components, features, dimensions, and/or any of the details of any of the embodiments of the foundation pile sections disclosed herein, including for example and without limitation, any of the embodiments of the foundation pile section 103 described above. In other embodiments, the second shell and/or the second foundation pile section or any additional pile sections used in a foundation pile assembly can be formed within the impact support element and/or other components of any embodiments of the foundation pile section 103 described above.

In embodiments where the additional shell 130 is coupled to the shell 120 while the bottom section 101 is on the rack, a flowable material, such as a flowable concrete mix, can be added to the second shell 130 in that orientation. The second shell 130, or any additional shell coupled with the second shell 130, can be the same, similar or different material and size than the first shell 120. For example, the first shell 120 can be a corrugated steel pipe and the second shell 130 can also be a corrugated steel pipe. As another example, the first shell 120 can be a corrugated steel pipe and the second shell 130 can be a round steel pipe or vice versa. Other combinations can also be used.

Figure 1F:
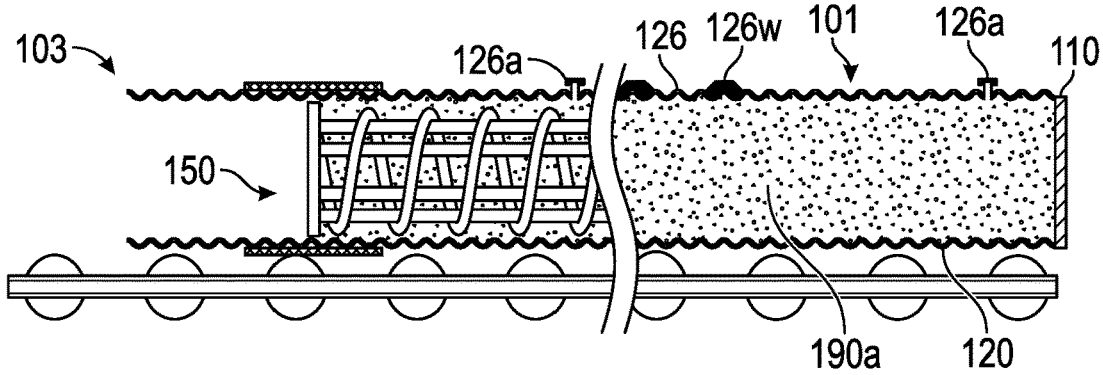
FIG. 1F illustrates an attachment piece connected at the cut-out and a complete bottom portion according to the embodiment of the foundation pile assembly as shown in FIG. 1.

FIG. 1F illustrates a side view of some components of the foundation pile assembly 100 that correspond to the bottom section 101. As can be seen, the cut-out (also referred to herein as an opening) on the surface of the shell 120, such as closeable opening shown as first cut-out 122 and/or the penetration 120*a* shown in FIG. 1E, can be at least partially closed or covered. In some embodiments, the closable openings can be, for example and without limitation, fully closed or covered with one or more cover members, such as cover member 126 and/or 126*a*. The cover member 126 can be an attachment piece that attaches to the shell 120. The cover member 126 can be made from or include any suitable material, such as a section of straight wall or corrugated wall pipe the same as or similar to the shell. As such, in some embodiments, the cover member 126 can be made from the same material as the shell 120. For example, the cover member 126 can be a quadrant of the shell 120. The cover member 126 can be coupled to the shell 120 through an attachment element 126*w*. The attachment mechanism 126*w* can be or include any of a variety of elements such as welds, fasteners, adhesive, or other suitable coupling mechanisms. The cover member 126*a* can include any suitable material. In some embodiments, the user can insert a bolt or a similar piece to cover or close the penetration 120*a*. The user can allow the flowable material to cure or harden into a first cured material 190*a*. In some embodiments, the user can allow the passage of a sufficient time, for example and without limitation, about 4 to 28 days, for the flowable material to harden and at least partially cure. Once the flowable material achieves adequate strength, the foundation pile section 103 can be ready to be driven in subsurface soil.

Figure 1G:
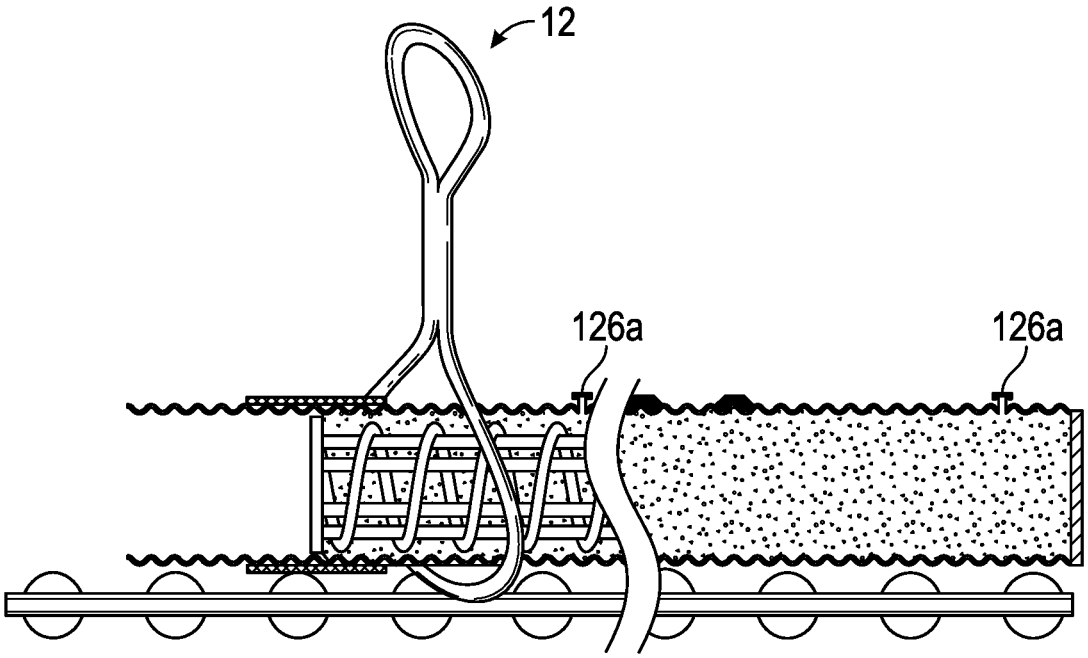
FIG. 1G illustrates a first strap around the bottom portion according to the embodiment of the foundation pile assembly as shown in FIG. 1.
Figure 1H:
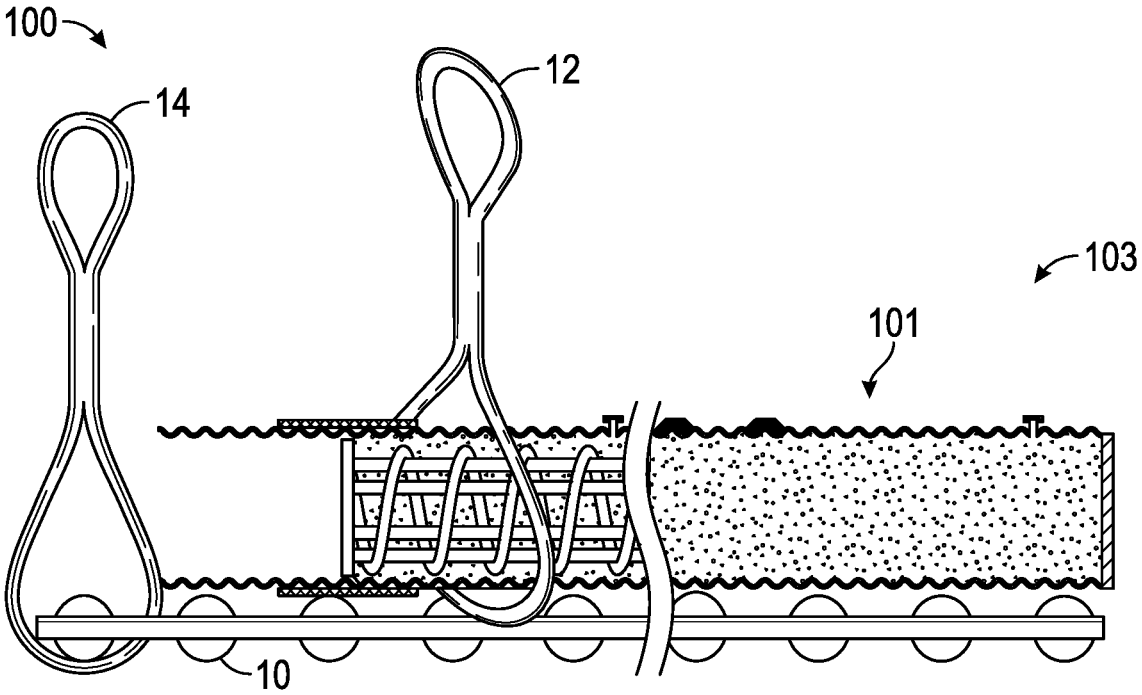
FIG. 1H illustrates the first strap of FIG. 1G and a second strap according to the embodiment of the foundation pile assembly as shown in FIG. 1.

FIGS. 1G-1H show a variety of different methods to loft the foundation pile section 103 and/or the rack 10. For example, a lofting strap 12 can be wrapped around the bottom section 101. In some embodiments, as can be seen in FIG. 1H, a second lofting strap 14 can be wrapped around the rack 10. In embodiments where a second lofting strap 14 is used, one strap can be used to loft the bottom section 101 while, optionally, another strap can simultaneously loft the rack so that the bottom section 101 is not stressed during the loft. In some embodiments, a rig can be used to loft the bottom section 101 and the rack 10 to reduce the stress on the bottom of the bottom section 101.

Figure 1I:
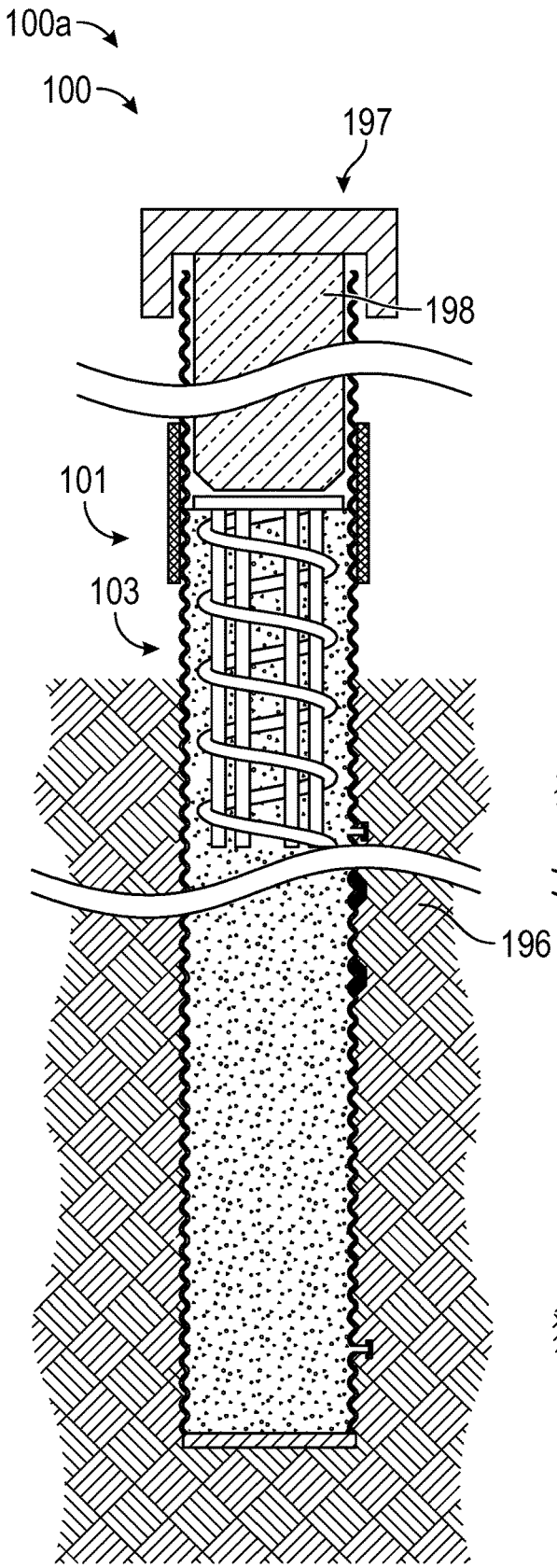
FIG. 1I illustrates driving the bottom portion into the subsurface soil using a mandrel according to the embodiment of the foundation pile assembly as shown in FIG. 1.
Figure 1J:
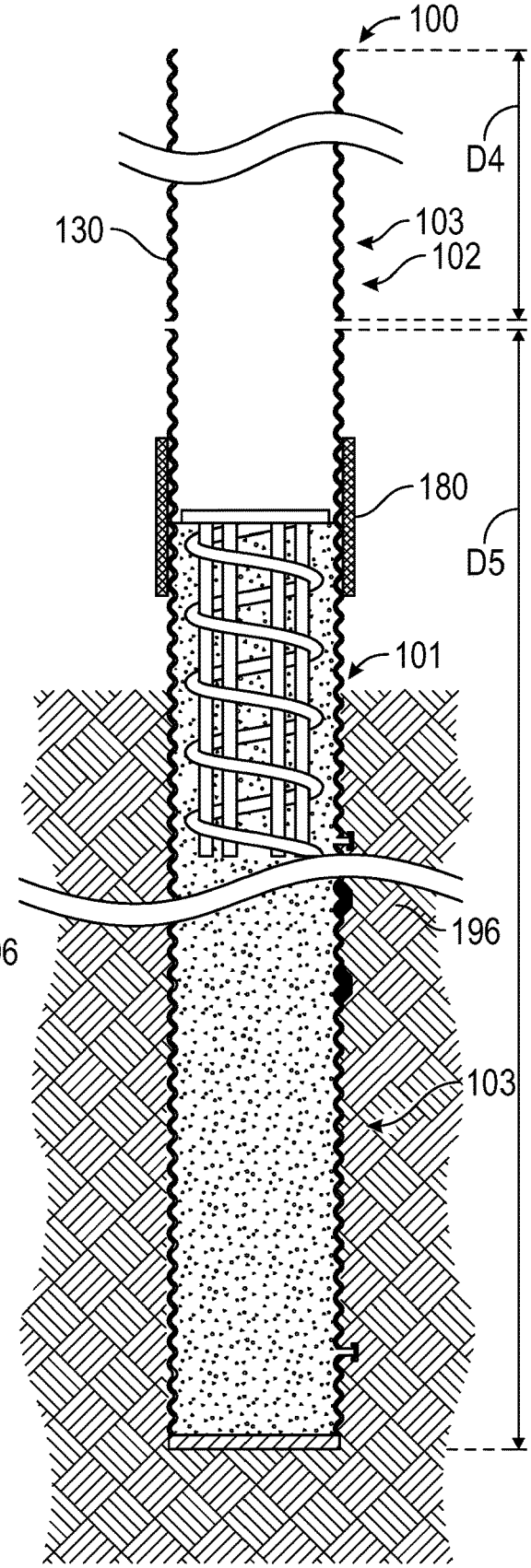
FIG. 1J illustrates the foundation pile assembly of FIG. 1I driven into the subsurface soil with a second shell positioned above the bottom portion according to the embodiment of the foundation pile assembly as shown in FIG. 1.

FIG. 1I illustrates a side section view of an embodiment of the foundation pile section 103, which is an embodiment of a bottom pile section 101, in a subsurface position, or partially subsurface position. FIG. 1I illustrates the embodiment of the foundation pile section being mechanically forced down into the subsurface soil 196 with a drive mechanism 197. The subsurface soil 196 can include miscellaneous fill, silt, peat, clay, sand, gravel, rocks, boulders, bedrock and/or rock stratum, or any other subsurface material or any combinations thereof. Any embodiments of the foundation pile sections disclosed herein can be configured to be driven to any of the foregoing subsurface materials. In some installations, the subsurface soil into which some embodiments of the foundation pile sections disclosed herein can be driven can be located in a river delta or alluvial deposition or other location lacking a rock stratum.

In some embodiments, the drive mechanism 197 can be a hammer, such as a pressure hammer or an impact hammer. In some embodiments, the drive mechanism 197 can be a vibrational driving mechanism. A mandrel 198 can apply a driving force and transfer the downward exerting force from the drive mechanism 197 to the first portion 160, thereby forcing the bottom section 101 down in the ground. The mandrel 198 can be made from any suitable material. For example, the mandrel 198 can be or can include a steel shaft. In some embodiments, the drive mechanism 197 and the mandrel 198 can be supported by a crane. The drive mechanism 197 can exert a continuous or intermittent force on the bottom section 101. The drive mechanism 197 can drive, vibrate and/or push the bottom section 101 in subsurface soil 196. The amount or duration of the force that is exerted on the bottom section 101 can vary. For example, and without limitation, in some embodiments, the force from the drive mechanism 197 can continue until the point where the first end of the foundation pile section is from 6 inches or about 6 inches to 36 inches or about 36 inches, or any convenient height, above the ground surface.

FIGS. 1I-1P illustrate a foundation pile assembly 100 having multiple pile sections at various stages of the installation process, including an embodiment of a method of driving the pile assemblies into the ground. In some embodiments, the foundation pile assembly 100 can include a bottom section 101 and a top section 102. The pile system can, in some embodiments, include a bottom section 101 and one or a plurality of top sections. In some embodiments, the foundation pile assembly 100 can include a bottom section 101 and one or more additional foundation pile sections 103 that can have any of the components, features, and other details of any embodiments of the foundation pile sections disclosed herein. The pile system can, in some embodiments, include as many bottom assemblies as are needed to drive the pile system to the desired depth. In some embodiments, the foundation pile assembly can include a foundation pile section that includes only a shell such as shell 130 illustrated in FIG. 1J, that can be coupled with the adjacent foundation pile section and filled with a second flowable material (or additional and/or different flowable materials) after the shell 130 is driven into the ground.

Figure 1K:
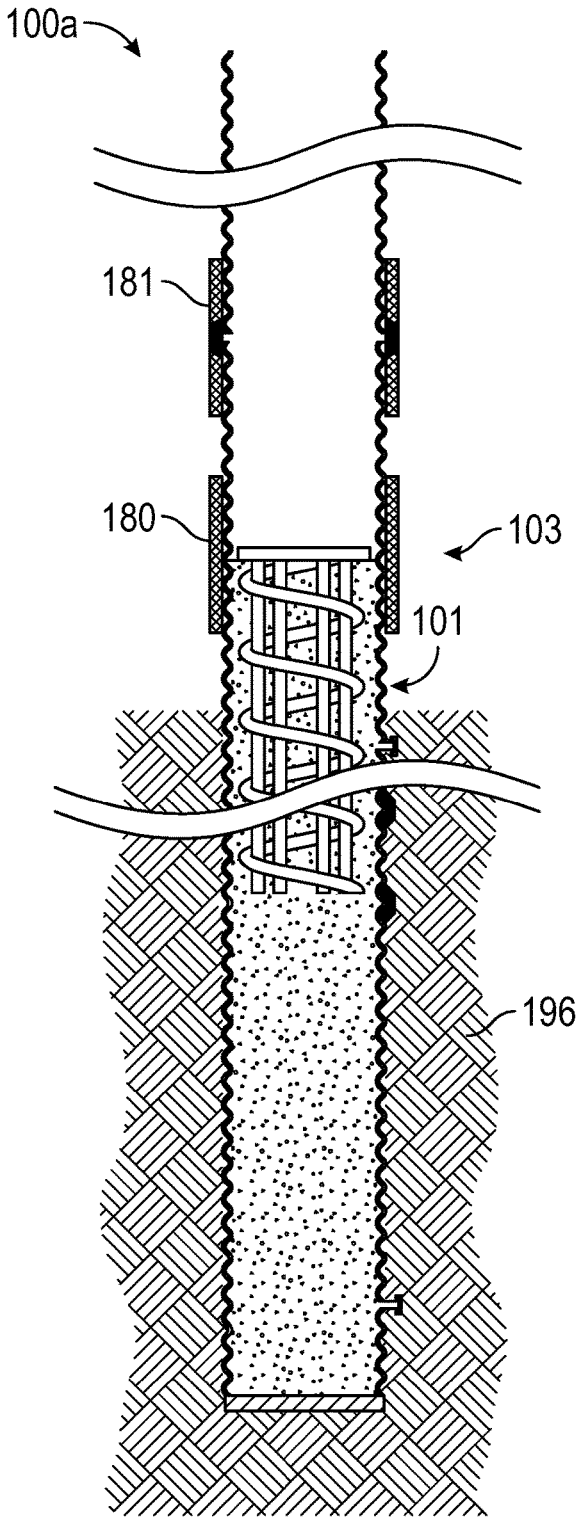
FIG. 1K illustrates attaching the first shell with the second shell according to the embodiment of the foundation pile assembly as shown in FIG. 1.
Figure 1L:
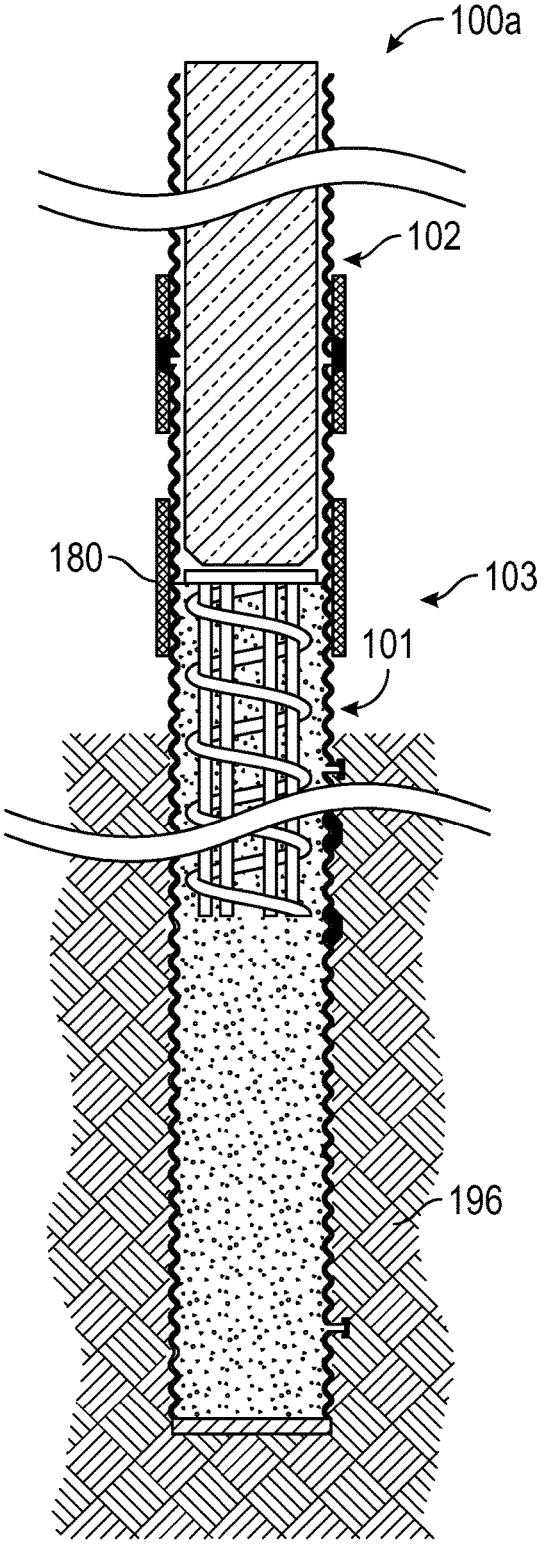
FIG. 1L illustrates the mandrel positioned in the second shell according to the embodiment of the foundation pile assembly as shown in FIG. 1.
Figure 1M:
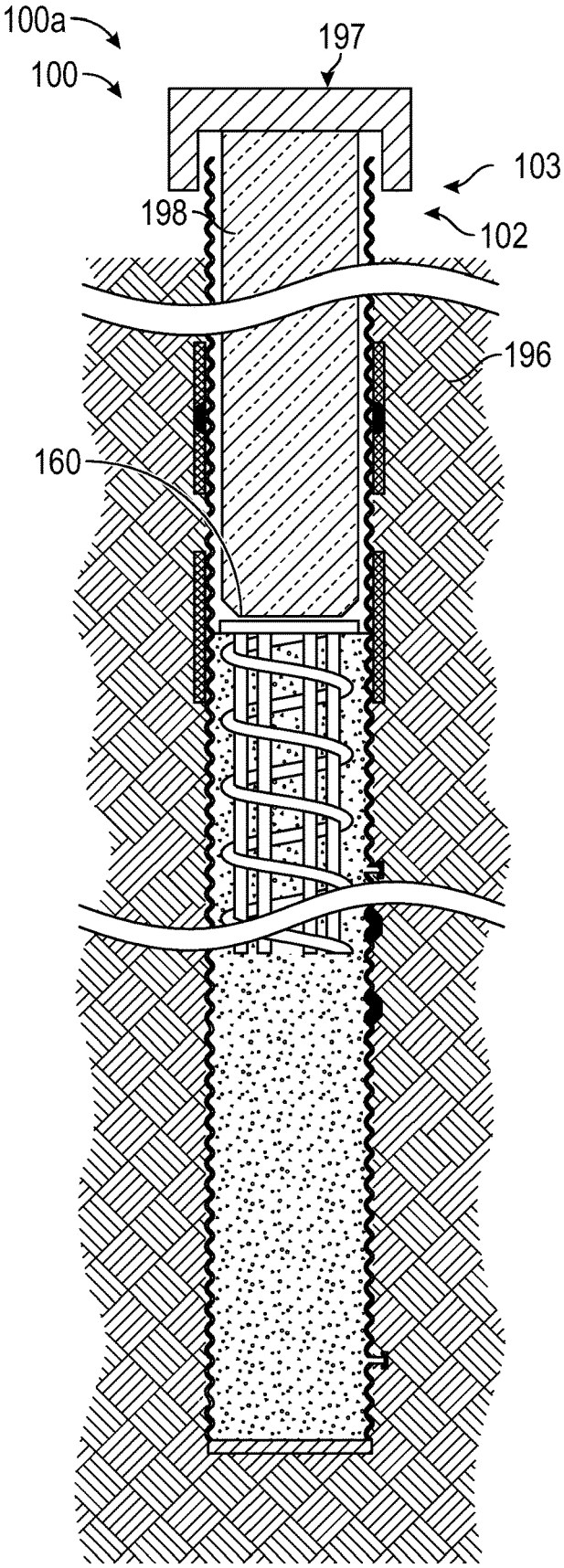
FIG. 1M illustrates a driving mechanism driving the first and the second shell according to the embodiment of the foundation pile assembly as shown in FIG. 1.
Figure 1N:
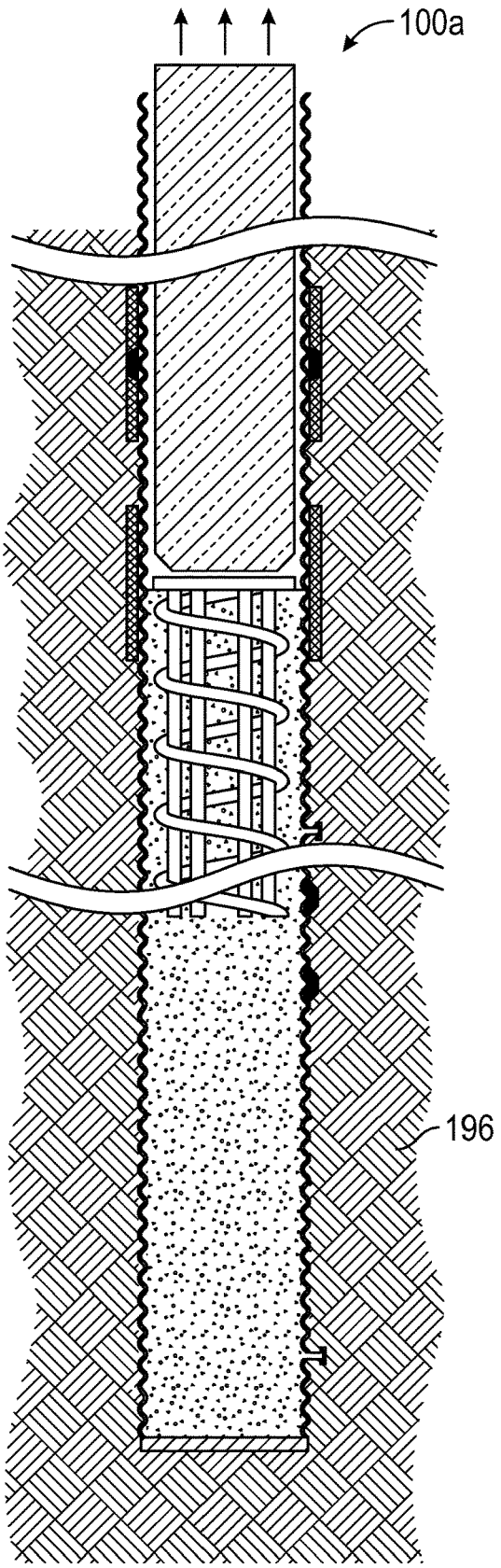
FIG. 1N illustrates removing the mandrel according to the embodiment of the foundation pile assembly as shown in FIG. 1.
Figure 1O:
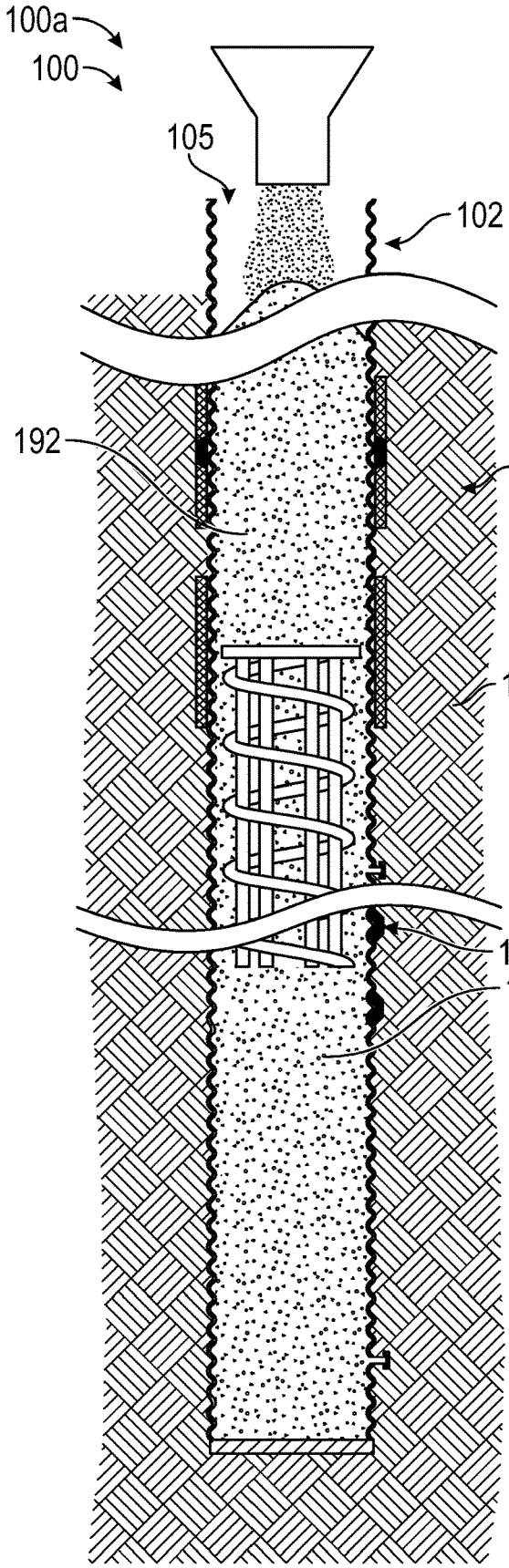
FIG. 1O illustrates filling a top portion with a second flowable material according to the embodiment of the foundation pile assembly as shown in FIG. 1.

In some embodiments of the pile system, the top section 102 can further include one or a plurality of reinforcement straps, for one or a plurality of second reinforcement straps 181 illustrated in FIG. 1K, that can be used to couple additional shells with each other and/or reinforce a junction between the end portions of adjacent shells. In any embodiments disclosed herein, the second reinforcement straps can be the same as or have any of the same lengths, positions, or other details of any other reinforcement strap embodiments disclosed herein, including without limitation any embodiments of the reinforcement straps 180 disclosed herein.

In some embodiments, the second shell 130 can be the uppermost shell in the foundation pile assembly 100. In some embodiments, the second shell 130 can be an intermediate shell in the foundation pile assembly, with one or more shells or foundation pile sections positioned above the second shell 130. In any embodiments disclosed herein, the foundation pile assembly can include one foundation pile section, two or more foundation pile sections, three or more foundation pile sections, four or more foundation pile sections, or otherwise. Any of the foundation pile sections, including the top section 102, can be coupled to any other of the foundation pile sections, including for example and without limitation, the bottom section 101, using any of a variety of different coupling mechanisms. For example, any of the foundation pile sections, including the second shell 130 of the top section 102, can be coupled to any of the other foundation pile sections, including the first shell 120 of the bottom section 101, by mechanical attachment means which can include welds, bolts or other fasteners, one or more reinforcement straps, and/or other suitable fastening means. The second reinforcement strap 181 can be configured to be the same or similar material as the reinforcement strap 180. In some embodiments, the reinforcement strap 181 can be a vertically cut quadrant or portion of a pipe made of the same or similar material as the shell 120 or the second shell 130. The reinforcement strap 181 can span between the first shell 120 and the second shell 130 and can overlap either of the shells per any of the details listed herein for any other embodiments of the reinforcement straps disclosed herein. For example, and without limitation, the second reinforcement strap 181 can be positioned such that about half of the strap extends below the joint on the outer surface of the shell 120 and the other half of the reinforcement strap 180 extends above the joint on the outer surface of the shell 130.

In some embodiments, the second shell 130 can be the same or a different shape and diameter as shell 120. For example, the second shell 130 can have a diameter that is larger (or smaller) than the diameter of the first shell 120. In some embodiments, the first shell 120 can be aligned with the second shell 130. Additional shells can be added to the second shell 130 if, for example, additional shells are needed for additional strength at any point along a length of the shell. In theory, the ability to add one or more top shells or top pile sections to the foundation pile assembly (which can include one or a plurality of foundation pile sections) allows the piles disclosed herein to reach an unlimited depth by adding additional shells to the pile system or assembly. For example, in some embodiments, a 50-foot bottom section (corresponding to depth D5 in FIG. 1J) plus an additional 50-foot second shell or foundation pile section (corresponding to depth D4 in FIG. 1J) allows for installation of a 100-foot-deep foundation pile assembly. As another example, an 80-foot bottom section plus an additional 80-foot shell allows for installation of a 160-foot-deep foundation pile assembly. Similarly, an 80-foot bottom section plus an additional 80-foot shell or foundation pile section plus yet another 80-foot shell or foundation pile section coupled with the previous 80-foot shell or foundation pile section allows for installation of a 240-foot-deep foundation pile. Thus, combinations of a variety of different lengths of shells can be used to achieve a desired depth, penetration, and/or resistance. Any of the top foundation pile sections, second pile sections, or additional pile sections of any embodiments of the foundation pile assemblies disclosed herein can have one or more impact support elements positioned within the shells of such sections. The impact support elements, where present, can be positioned in any of the positions as described herein for any other pile section embodiments, such as the embodiments of the bottom pile sections.

A mandrel 198 can contact the foundation pile section 103 at, for example without limitation, the first portion 160 of the impact support element and can transfer the downward exerting force from the drive mechanism 197 to the foundation pile section 103 until the foundation pile section 103 is at or around a desired depth, penetration, and/or resistance. At this point, in some embodiments, the user can place a second flowable material, such as a flowable mix of concrete, until the flowable material fills or substantially fills the interior space 105 corresponding to the top section 102, or the section above the first portion of the impact support element. The second flowable material 192 can be a flowable concrete mix of any desired strength. The second flowable material 192 can have the same, similar, or different properties as the first flowable material 190. For example, in some embodiments, the second flowable material 192 can be a concrete mix having a strength of 5000 psi or about 5000 psi, or from 5000 psi or about 5000 psi to 9000 psi or about 9000 psi, or of any value, approximate value, or range of values within any of the foregoing ranges. In some embodiments, the strength of the second flowable material 192 can be 5000 psi or about 5000 psi or can be 9000 psi or up to about 9000 psi or higher than 9000 psi. The second flowable material can be inserted when the top section 102 is in a generally vertical orientation. In some embodiments, the interior space 105 can be filled or substantially filled with flowable concrete mix with no additional steel reinforcement or rebar placed above the first portion of the impact support element. In some other embodiments, the user can place additional reinforcements based on structural and/or design requirements. For example, if deeper penetration is necessary, the user can place another impact support element in the interior space 105 or the interior space of the shell 130 and add another shell to the top section 102 (added shell cycle repeated) so the pile can be driven to a deeper depth.

The bottom section 101 can be completely inserted in the subsurface soil 196, and at least a portion of the top section 102 can be inserted in the subsurface soil 196. The user can allow a certain duration until the second flowable material cures and turns into a second cured material 192*a*. In some embodiments, the second flowable material cures when it hardens after the passage of a desirable length of time. Once the desirable length of time passes, the second flowable material 192 hardens to become the second cured material 192*a* that can possess the desirable compressive strength and be used to support the structure above it. The desired length of time can vary. For example, and without limitation, the desired length of time or the cure time can be about 1 day or about 2 days or about 3 days or about 4 days or 10 days or 28 days.

Figure 1P:
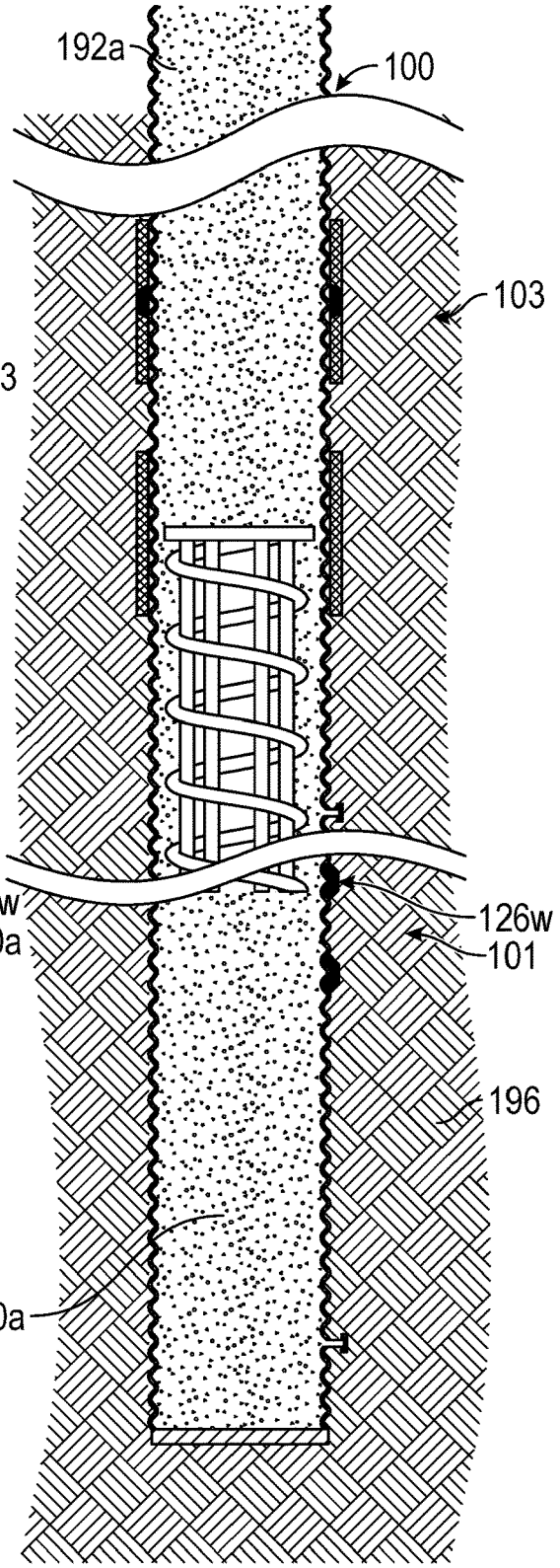
FIG. 1P illustrates a complete foundation pile assembly in use according to the embodiment of the foundation pile assembly shown in FIG. 1.
Figures 1, 1P:
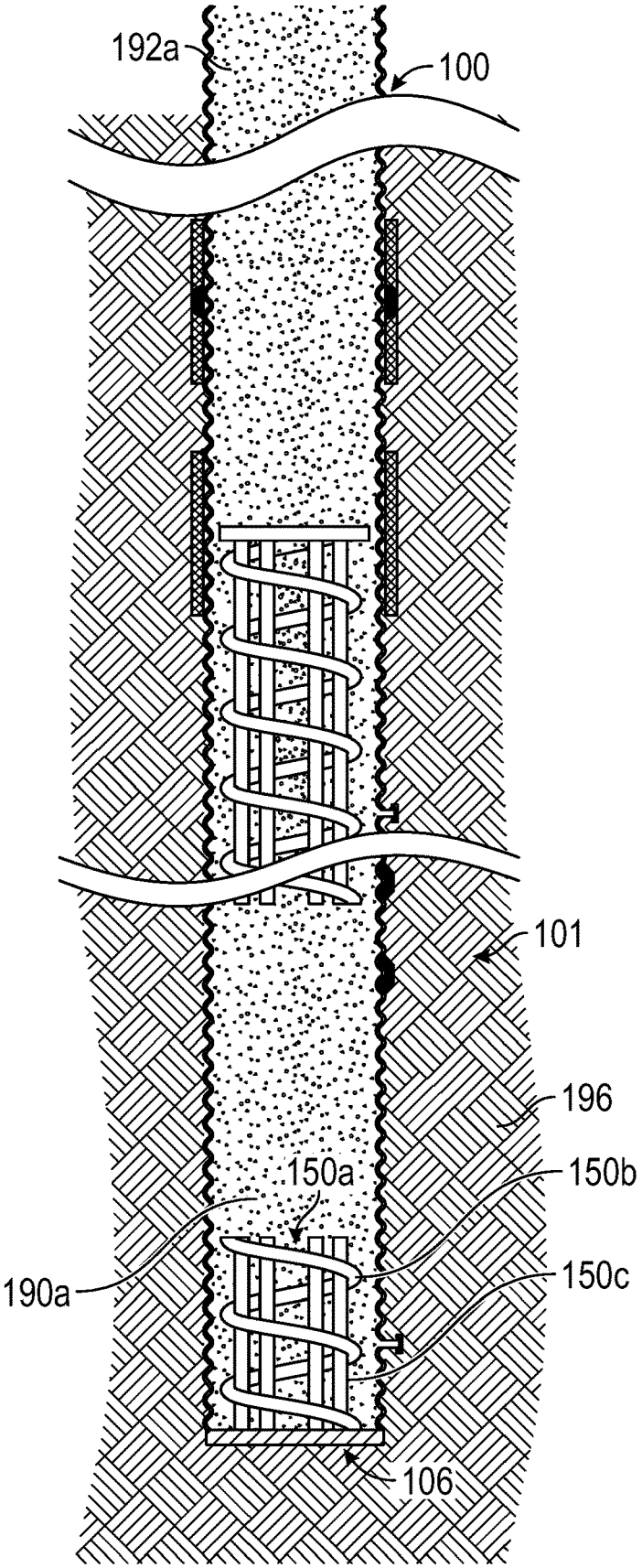

FIG. 1P-1 illustrates the complete foundation pile assembly of FIG. 1P with the addition of a bottom reinforcement element 150*a* positioned at the second end 106 of the embodiment of the foundation pile assembly shown in FIG. 1P-1. As discussed earlier, the optional bottom reinforcement element 150*a* can further strengthen the foundation pile assembly 100. This can be helpful particularly when the user is driving the foundation pile assembly 100 in dense soils or rocks.

FIG. 2A through FIG. 8C illustrate additional embodiments foundation pile sections and/or foundation pile assemblies. Any embodiments of the foundation pile sections or foundation pile assemblies shown in FIGS. 2A through 8C can have any of the components, features or other details of any of the other embodiments of the foundation pile sections or foundation pile assemblies shown in any of FIG. 1A through 1P-1 or described herein in any combination with any of the components, features, or details of any of the embodiments of the foundation pile sections or foundation pile assemblies shown in FIGS. 2A through 8C. Further, any other pile section embodiments or pile assembly embodiments disclosed herein can have any of the components, features or other details of any of the other embodiments shown in FIGS. 1A through 1P-1 in any combination with any of the components, features, or details of such other foundation pile section or foundation pile assembly embodiments. Thus, any and all features, elements, properties, etc. disclosed with respect to the embodiments of FIG. 1A through FIG. 1P-1 can be equally applied to other embodiments of the present disclosure. Similarly, any and all features, elements, properties, etc. of any of the embodiments shown in FIG. 2A through FIG. 8C can be equally applied to any of the embodiments of the foundation pile sections or foundation pile assemblies shown in FIG. 1A through FIG. 1P-1. Additionally, any of the fabrication or installation steps or details disclosed with regard to any other foundation pile section or foundation pile assembly embodiments disclosed herein can be used with some embodiments of the foundation pile sections or foundation pile assemblies shown in FIG. 2A through FIG. 2B and vice-versa.

Figure 2A:
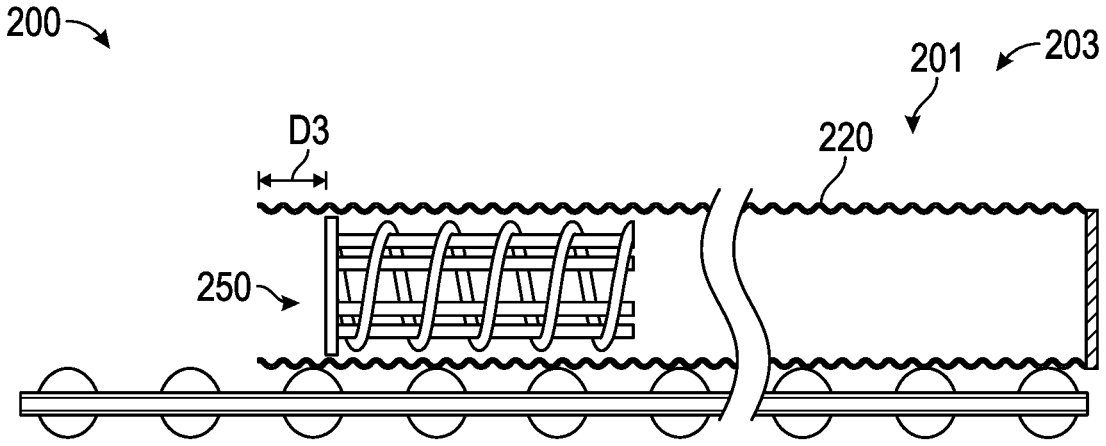
FIG. 2A illustrates a bottom portion of a foundation pile assembly according to another embodiment.
Figure 2B:
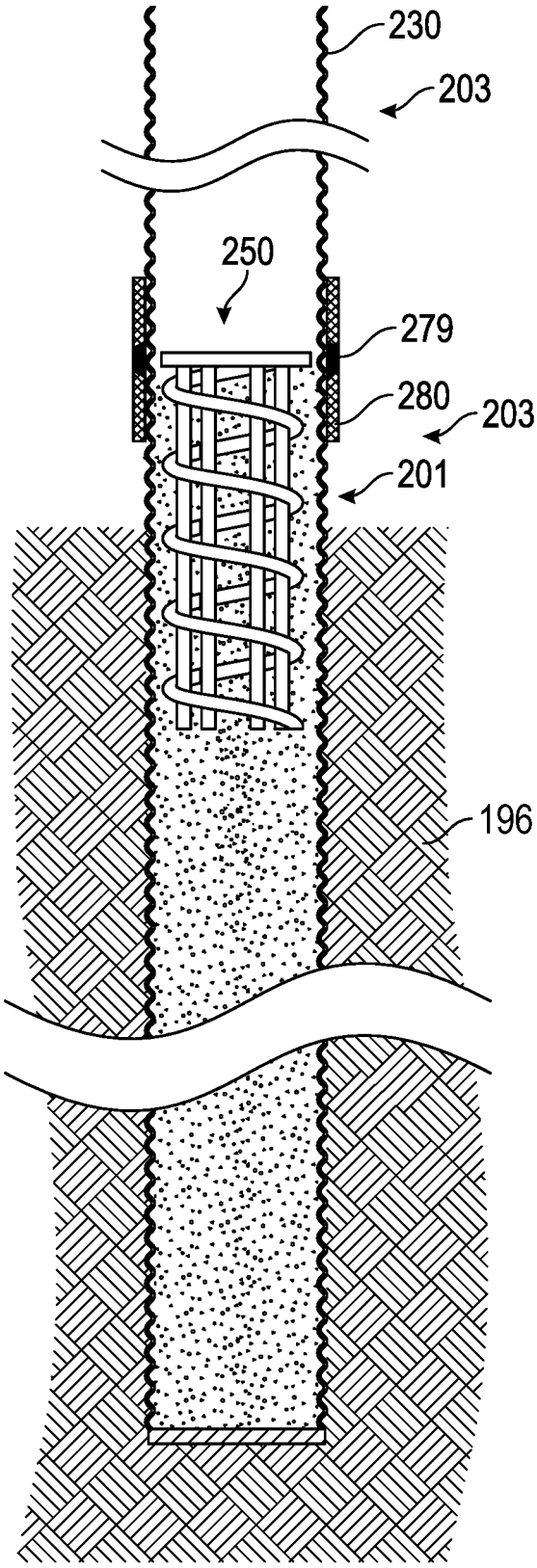
FIG. 2B illustrates the foundation pile assembly of FIG. 2A driven in the subsurface soil according to the embodiment of the foundation pile assembly as shown in FIG. 2A.

FIG. 2A through FIG. 2B illustrate another embodiment of a foundation pile assembly. The foundation pile assembly 200 can include a plurality of pile sections. As shown in FIG. 2A, the embodiment of the foundation pile assembly 200 shown in FIG. 2A can include a pile section 203, which can be a bottom section 201 of the foundation pile assembly 200. An impact support element 250 can be positioned at a dimension D3 from the butt, also referred to as the top end, of a first shell 220 as shown in FIG. 2A. In some embodiments, the first section of the impact support element can be offset from the proximal end of the shell by a dimension D3 of from 1 inch or about 1 inch to 4 feet or about 4 feet away from the first end 104 of the foundation pile assembly 100, or from 6 inches or less to 2 feet or approximately 2 feet or more than 2 feet, or from 1 foot or about 1 foot to 4 feet or approximately 4 feet or more than 4 feet, or from 6 inches or less to 1 foot or approximately 1 foot, or from 1 foot or approximately 1 foot or less than 1 foot to 3 feet or approximately 3 feet away from the first end 104 of the foundation pile assembly 100, or of any values or ranges of values within any of the foregoing ranges.

FIG. 2B illustrates the bottom section 201 driven at least partially into the ground. A second shell 230 can be coupled with the bottom section 201 via one or more connections 279. In some embodiments, the one or more connections 279 can include one or more welds or other suitable mechanisms. One or a plurality of reinforcement straps 280 can be positioned over the connection 279 or over the joint between the adjacent shells to connect the second shell 230 to the bottom section 201 while the bottom section 201 is in a vertical or substantially vertical orientation. In some embodiments, the applicable steps of installing the foundation pile sections or foundation pile assemblies of any of the embodiments of FIG. 1A through 8C in the ground can be used to install any of the embodiments of the foundation pile sections or foundation pile assemblies shown in FIGS. 2A through 2B in the ground to achieve a complete foundation pile assembly that is driven in the ground.

FIGS. 3A through 3D illustrate another embodiment of a foundation pile assembly 300 undergoing an example embodiment of a method of manufacturing the foundation pile assembly 300. Any embodiments of the foundation pile sections or foundation pile assemblies shown in FIGS. 3A through 3D can have any of the components, features or other details of any of the other embodiments of the foundation pile sections or foundation pile assemblies shown or described herein in any combination with any of the components, features, or details of any of the embodiments of the foundation pile sections or foundation pile assemblies shown in FIGS. 3A through 3D. Further, any other pile section embodiments or pile assembly embodiments disclosed herein can have any of the components, features or other details of any of the other embodiments shown in FIGS. 3A through 3D in any combination with any of the components, features, or details of such other foundation pile section or foundation pile assembly embodiments. Additionally, any of the fabrication or installation steps or details disclosed with regard to any other foundation pile section or foundation pile assembly embodiments disclosed herein can be used with some embodiments of the foundation pile sections or foundation pile assemblies shown in FIG. 3A through FIG. 3D and vice-versa.

Figure 3A:
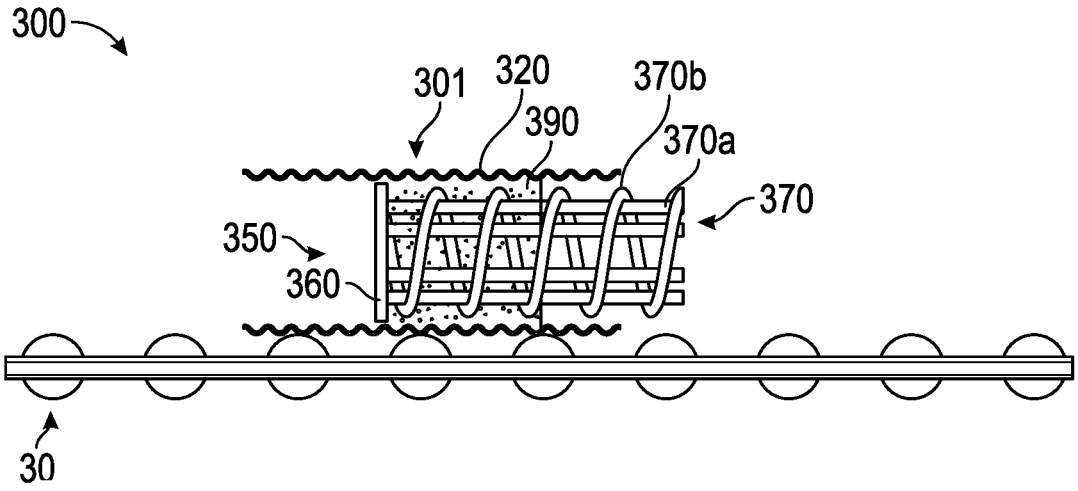
FIG. 3A illustrates a first portion of the foundation pile assembly on a rack according to another embodiment.
Figure 3B:
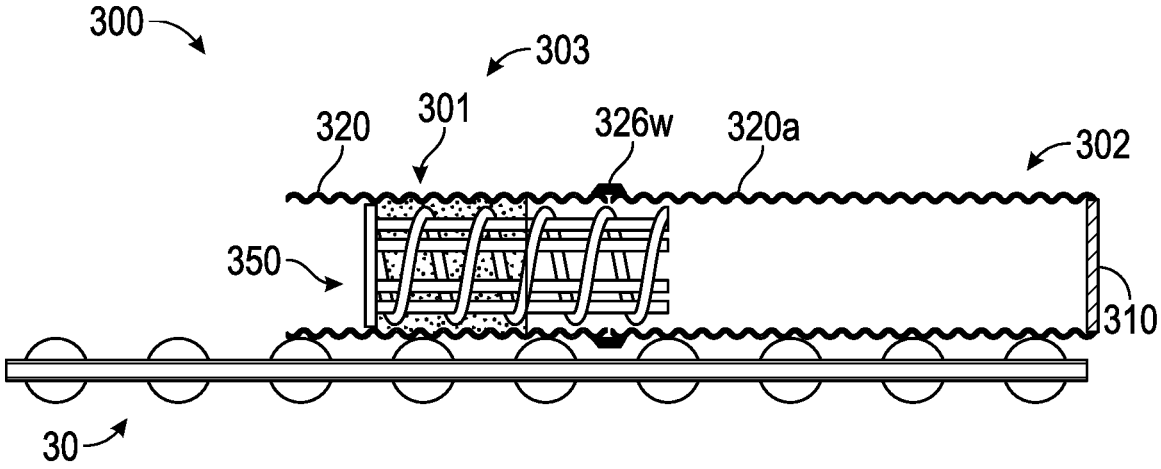
FIG. 3B illustrates a second portion of the foundation pile assembly connected to the first portion according to the embodiment of the foundation pile assembly as shown in FIG. 3A.
Figure 3C:
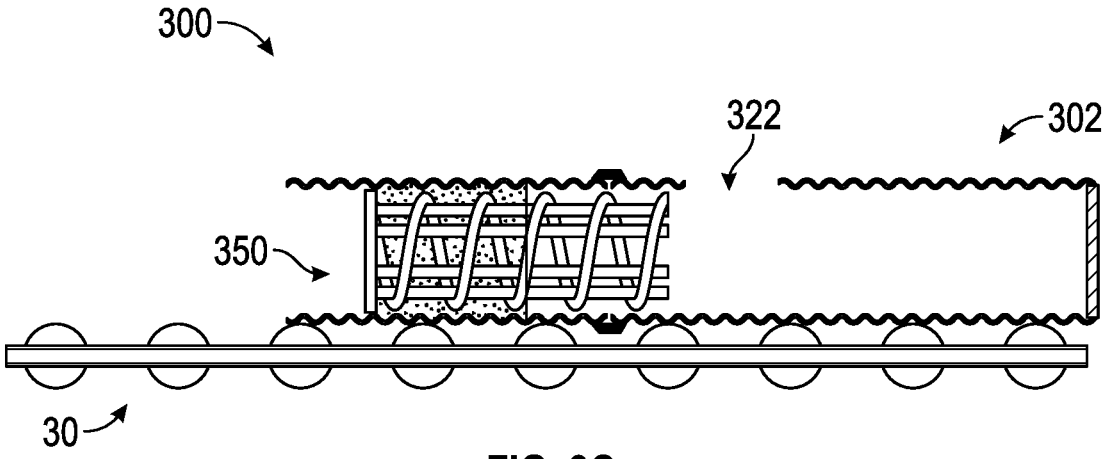
FIG. 3C illustrates a cut-out in the second portion of the foundation pile assembly according to the embodiment of the foundation pile assembly as shown in FIG. 3A.
Figure 3D:
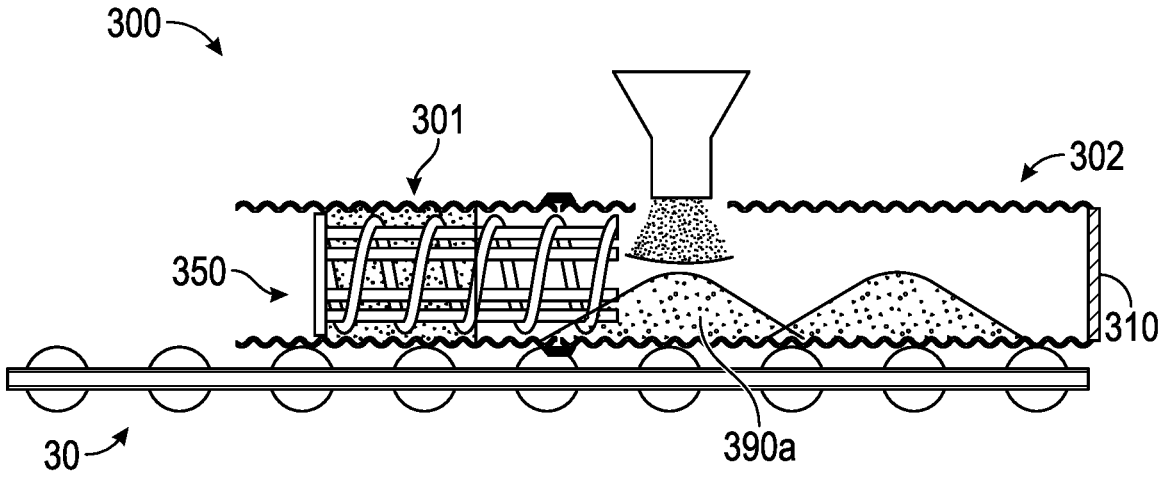
FIG. 3D illustrates filling the second portion of the foundation pile assembly with a flowable material according to the embodiment of the foundation pile assembly as shown in FIG. 3A.

In some embodiments, the pile assembly 300 shown in FIG. 3A can include one or a plurality of pile sections 303.

For example, and without limitation, some embodiments of the foundation pile assembly 303 can include a first pile section 301 and a second pile section 302. The second pile section 302 can be coupled with the first pile section 301.

In some embodiments, the first pile section 301 can have a shell 320 and an impact support element 350 positioned partially in the shell. The embodiment of the impact support element 350 can have any of the components, features, and details of any embodiments of the impact support element of any embodiments of the foundation pile sections disclosed herein. The first portion 360 can be positioned inside the shell. The second portion 370 can extend past the distal end of the shell 320. For example and without limitation, the second portion 370 can extend past the distal end of the shell 320 by 6 inches or about 6 inches, or 1 foot or about 1 foot, or 2 feet or about 2 feet or more than 2 feet, or from 1 foot or about 1 foot to 3 feet or about 3 feet, or from 1 foot or about 1 foot to 2 feet or about 2 feet, or of any value or approximate value or range of values in any of the foregoing ranges.

In some embodiments, the impact support element can be positioned within the shell 320 such that the first portion 360 of the impact support element 350 is offset inwardly relative to the first end of the shell and such that the second portion 370 extends past a second end of the shell.

In some embodiments, the first portion 360 of the impact support element 350 can be offset from the first or proximal end of the shell 320 by a distance of 1 inch or about 1 inch to 4 feet or about 4 feet from the first end 104 of the foundation pile assembly 100, or from 6 inches or less to 2 feet or approximately 2 feet or more than 2 feet, or from 1 foot or about 1 foot to 4 feet or approximately 4 feet or more than 4 feet, or from 6 inches or less to 1 foot or approximately 1 foot, or from 1 foot or approximately 1 foot or less than 1 foot to 3 feet or approximately 3 feet, or of any values or ranges of values within any of the foregoing ranges.

In some embodiments, the shell 320 can have a length of 3 feet or about 3 feet, 5 feet or about 5 feet, 7 feet or about 7 feet or more than 7 feet, or any value or range of values within any of the foregoing ranges, or any desired or suitable length. The second shell 320*a* can be any length. In other embodiments, for example and without limitation, the length of the second shell 320*a* can be 40 feet or about 40 feet, 80 feet or about 80 feet, 120 feet or about 120 feet, or from 80 feet, about 80 feet, or less than 80 feet to 120 feet, about 120 feet, or more than 120 feet, or any value or range of values in any of the foregoing ranges.

As with any foundation pile section embodiments disclosed herein, in some embodiments, the shell 320 can be supported on a rack 30, on a ground surface, or otherwise during one or more steps of the assembly process. In some embodiments, the user can place the first flowable material 390, horizontally or vertically, inside the interior space such that the first flowable material 390 surrounds about 50%, but not the entirety, of a second portion 370 of the impact support element 350 (which includes a first portion 360 and a second portion 370) to form an impact assembly portion 301. The second portion 370 can include straight reinforcement members 370*a* and one or a plurality of (e.g., two) curved reinforcement members 370*b*. In some embodiments, during fabrication, the impact assembly portion 301 can rest, horizontally or substantially horizontally, on a rack 30 where it can be coupled to a second shell 320*a* via connection 326*w*. Allowing a user to make the connection 326*w* while the impact assembly portion 301 and the second shell 320*a* are in a horizontal or substantially horizontal orientation can contribute to making a better-quality connection, greater efficiency, and allow for easy access for inspection, among other benefits.

The connection 326*w* can be any suitable type of connection. For example, where the first shell 320 meets the second shell 320*a*, one or more welds can be applied to the circumference of the joint to provide an adequate attachment mechanism. Additionally, one or more reinforcement straps can be applied to an outer surface of the shell at the joint between the adjacent shells.

In some embodiments, a cap 310 can be coupled to the second shell 320*a*. In some embodiments, the cap 310 can be coupled to the second shell 320*a* with one or more welds. For example, and without limitation, the user can make one or more cut-outs 322 (also referred to herein as openings) in the shell and insert a second flowable material 390*a* such that the second flowable material 390*a* surrounds the remaining section of the second portion 370 of the impact support element 350. This arrangement can allow the impact assembly portion 301 to form a strong bond with the second shell 320*a* and also strengthen the joint between the first and second shells or any adjacent shells. As with any other embodiments, in some embodiments, the cap can be configured to facilitate penetration into the ground substrate. For example, and without limitation, some embodiments of the cap can be curved or pointed on the bottom portion thereof.

After adding the cap, the user can continue to substantially fill the interior space of the second shell 320*a*. Once the first and second flowable materials cure and achieve adequate strength, the user can proceed with lofting and driving the foundation pile assembly 300 in the same or similar manner as discussed earlier.

Figure 4A:
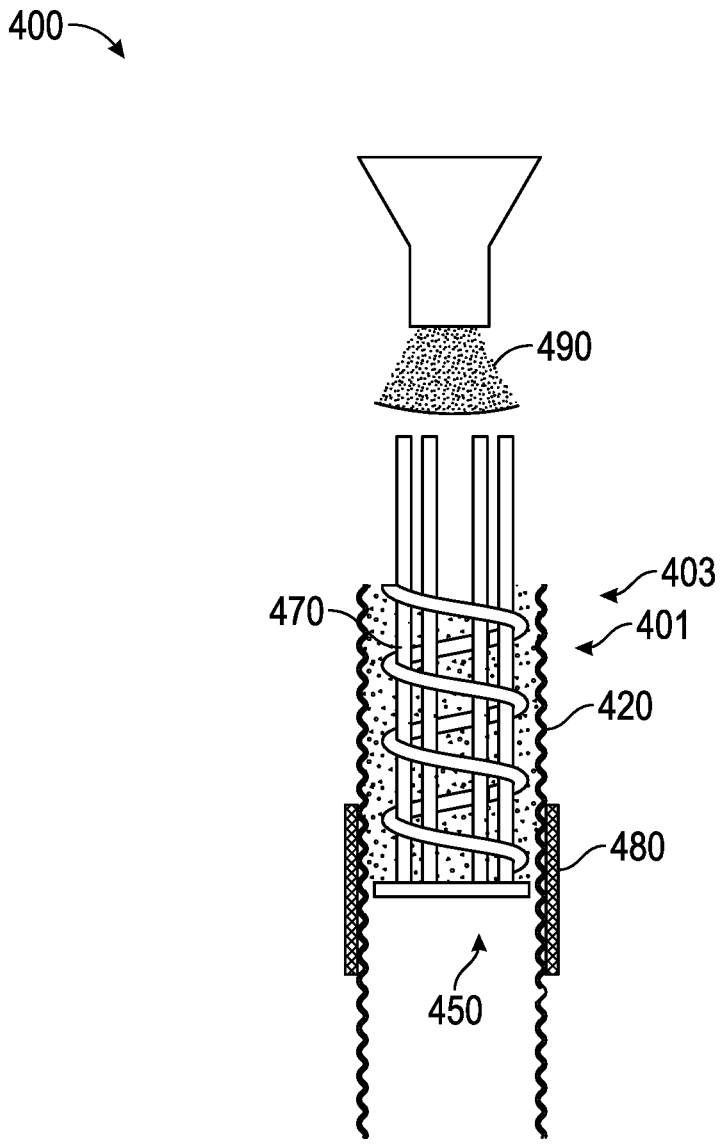
FIG. 4A illustrates filling a first portion of the foundation pile assembly according to another embodiment.
Figure 4B:
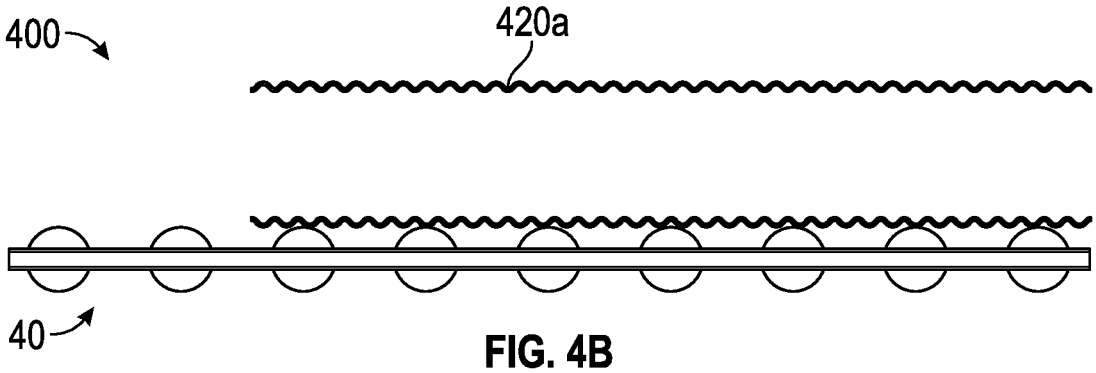
FIG. 4B illustrates a second portion of the foundation pile assembly on a rack according to the embodiment of the foundation pile assembly as shown in FIG. 4A.
Figure 4C:
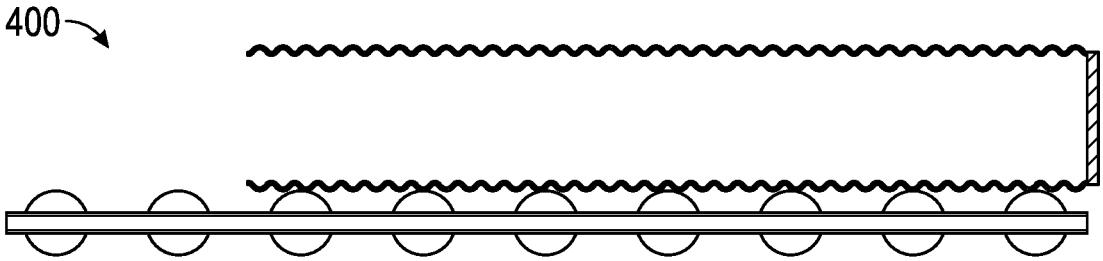
FIG. 4C illustrates an end cap at the second portion of the foundation pile assembly according to the embodiment of the foundation pile assembly as shown in FIG. 4A.
Figure 4D:
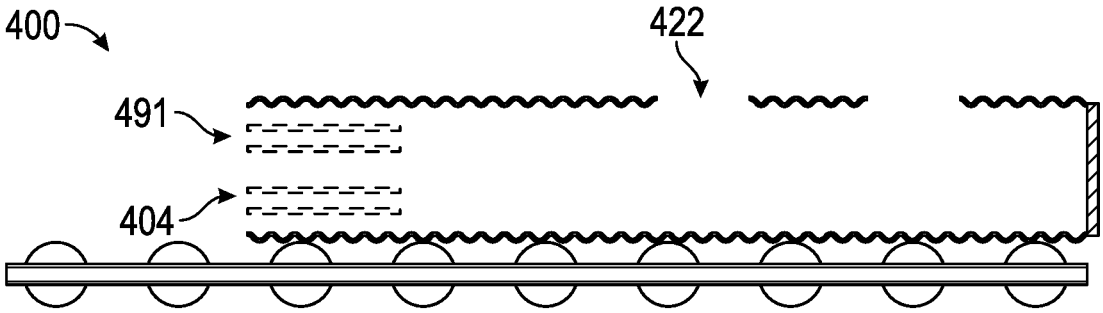
FIG. 4D illustrates a cut-out and a plurality of sleeves (round cavities) in the second foundation portion according to the embodiment of the foundation pile assembly as shown in FIG. 4A.
Figure 4E:
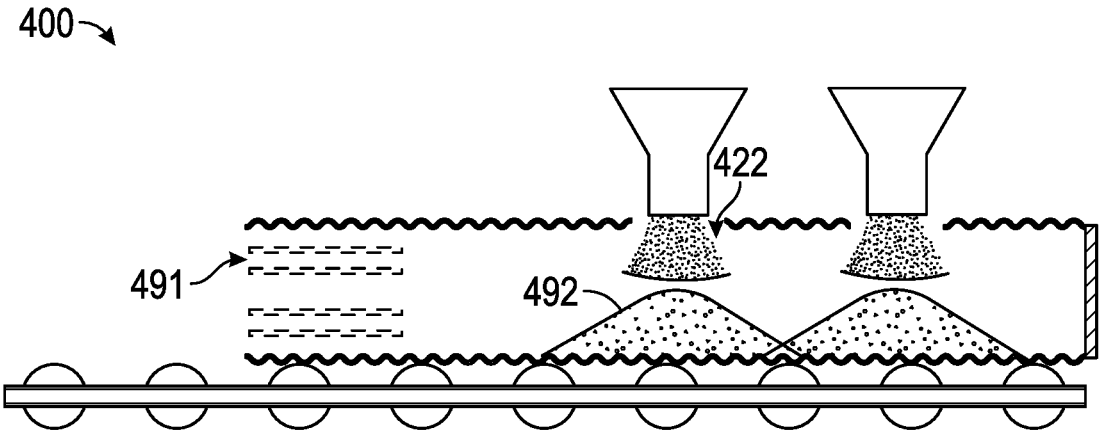
FIG. 4E illustrates filling the second foundation portion with a flowable material according to the embodiment of the foundation pile assembly as shown in FIG. 4A.
Figure 4F:
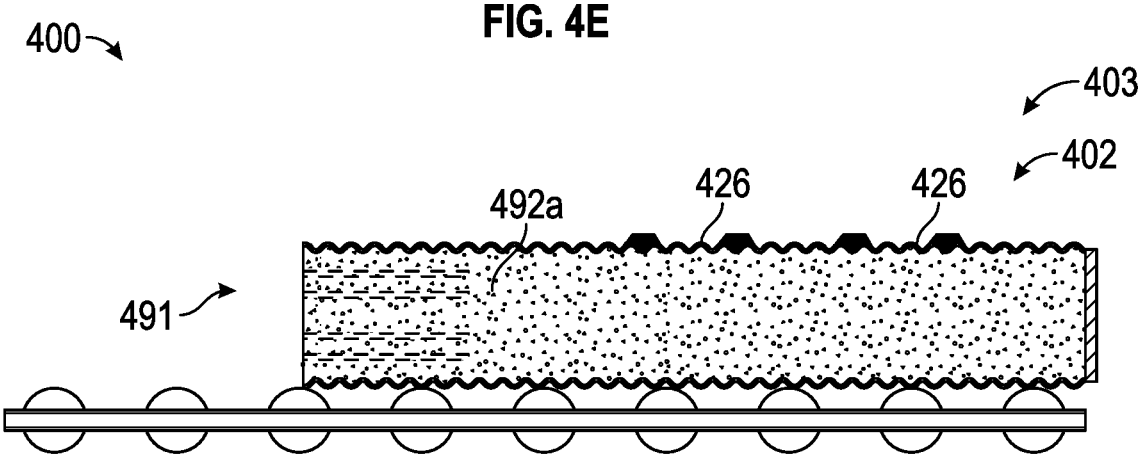
FIG. 4F illustrates attachment pieces on the cut-outs according to the embodiment of a foundation pile assembly shown in FIG. 4A.
Figure 4G:
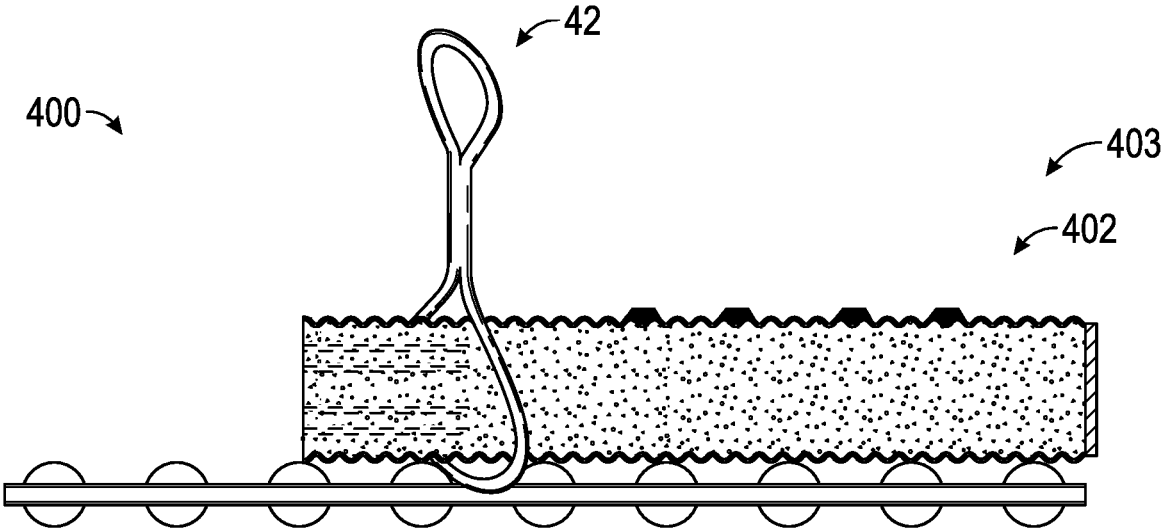
FIG. 4G illustrates a first strap around the second foundation portion according to the embodiment of the foundation pile assembly as shown in FIG. 4A.
Figure 4H:
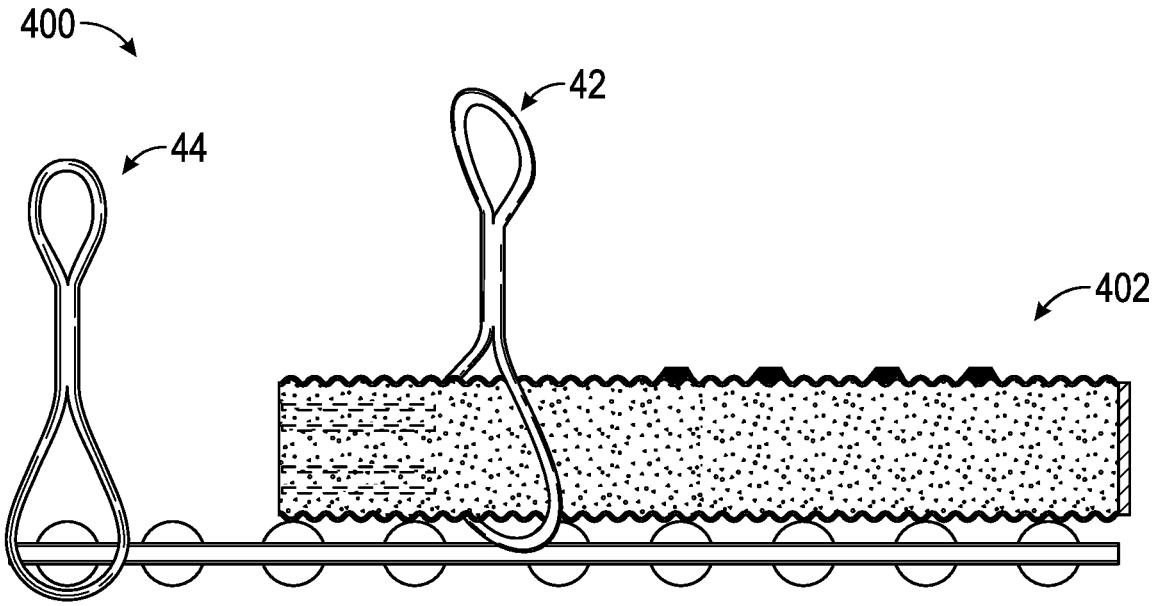
FIG. 4H illustrates a second strap configured to loft a rack according to the embodiment of the foundation pile assembly as shown in FIG. 4A.
Figure 4I:
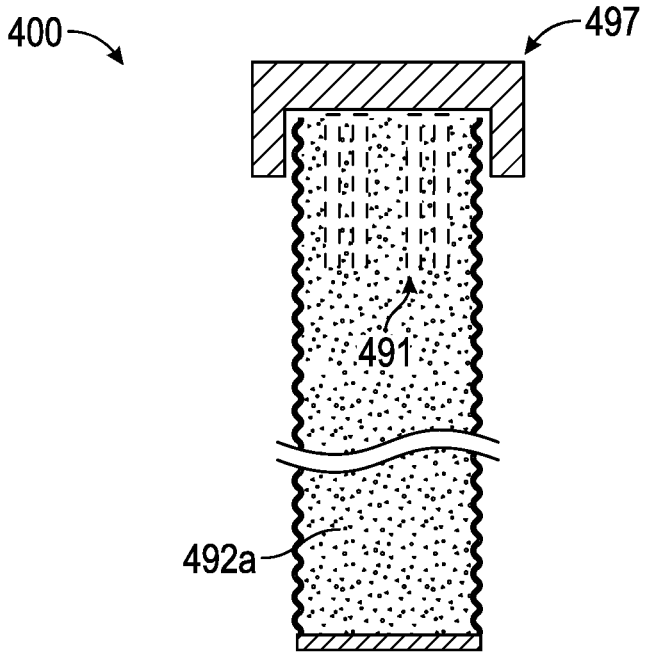
FIG. 4I illustrates a driving mechanism configured to drive the second foundation portion according to the embodiment of the foundation pile assembly as shown in FIG. 4A.
Figure 4J:
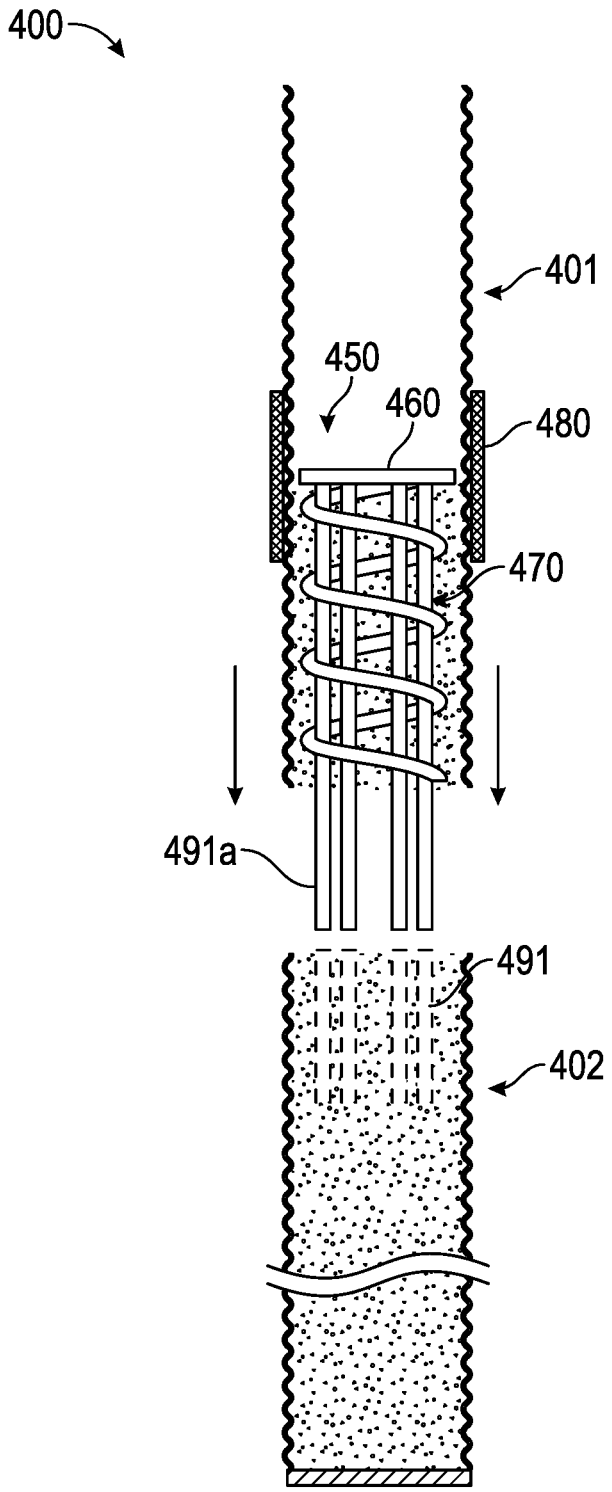
FIG. 4J illustrates placing the first foundation portion on the second foundation portion according to the embodiment of the foundation pile assembly as shown in FIG. 4A.
Figure 4K:
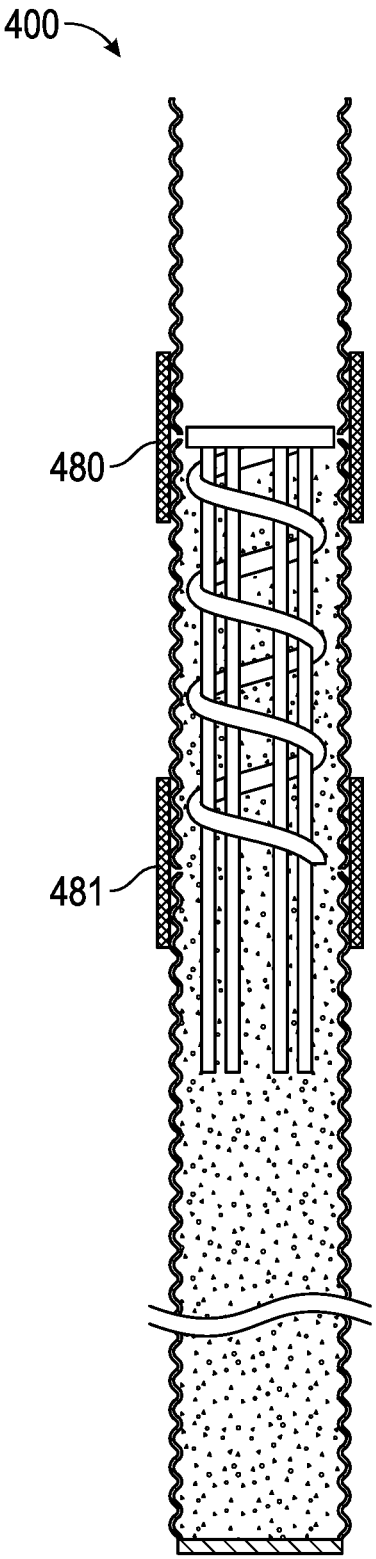
FIG. 4K illustrates placement of reinforcement straps between the first and second foundation portions according to the embodiment of the foundation pile assembly as shown in FIG. 4A.
Figure 4L:
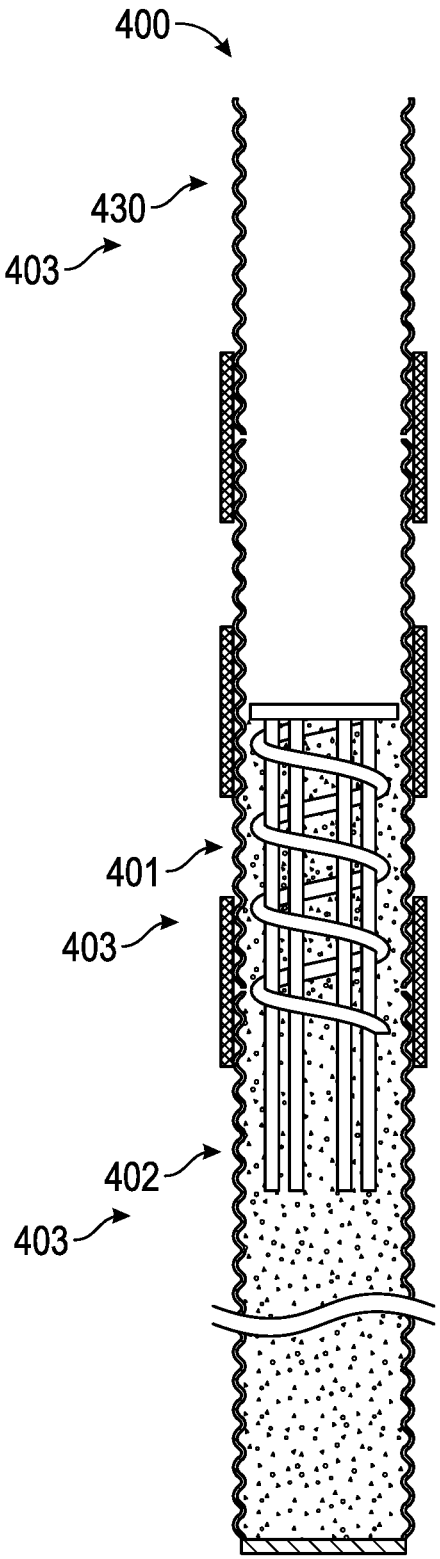
FIG. 4L illustrates attachment of a top portion to the first and second foundation portions according to the embodiment of the foundation pile assembly as shown in FIG. 4A.
Figure 4M:
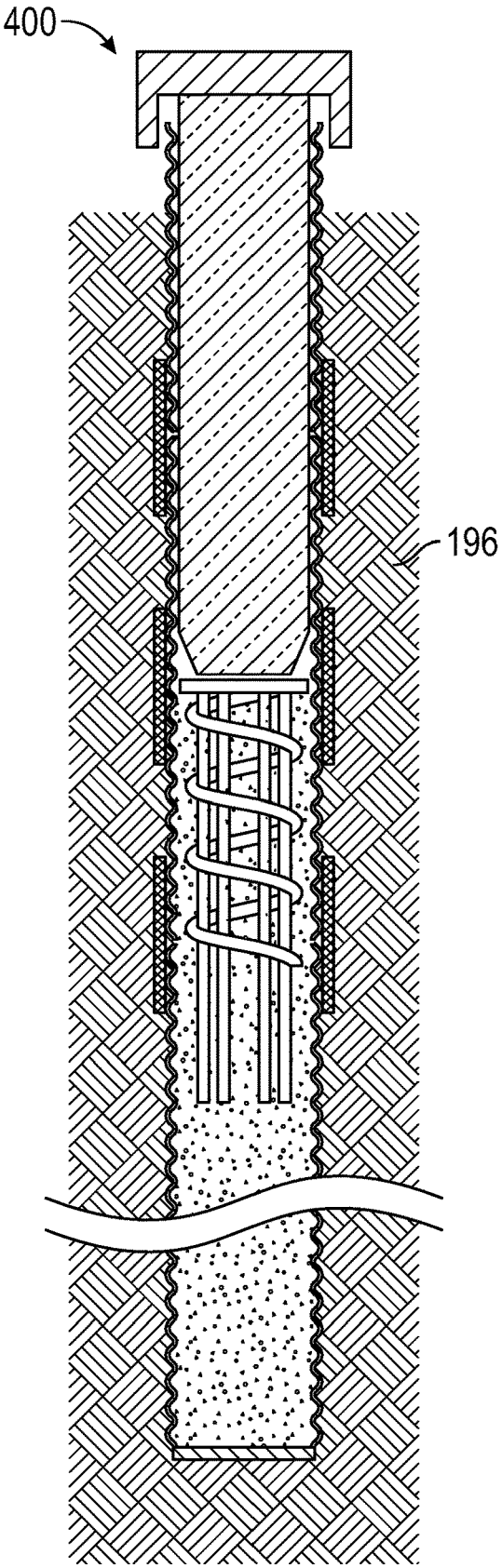
FIG. 4M illustrates driving the foundation pile assembly into the subsurface soil according to the embodiment of the foundation pile assembly as shown in FIG. 4A.
Figure 4N:
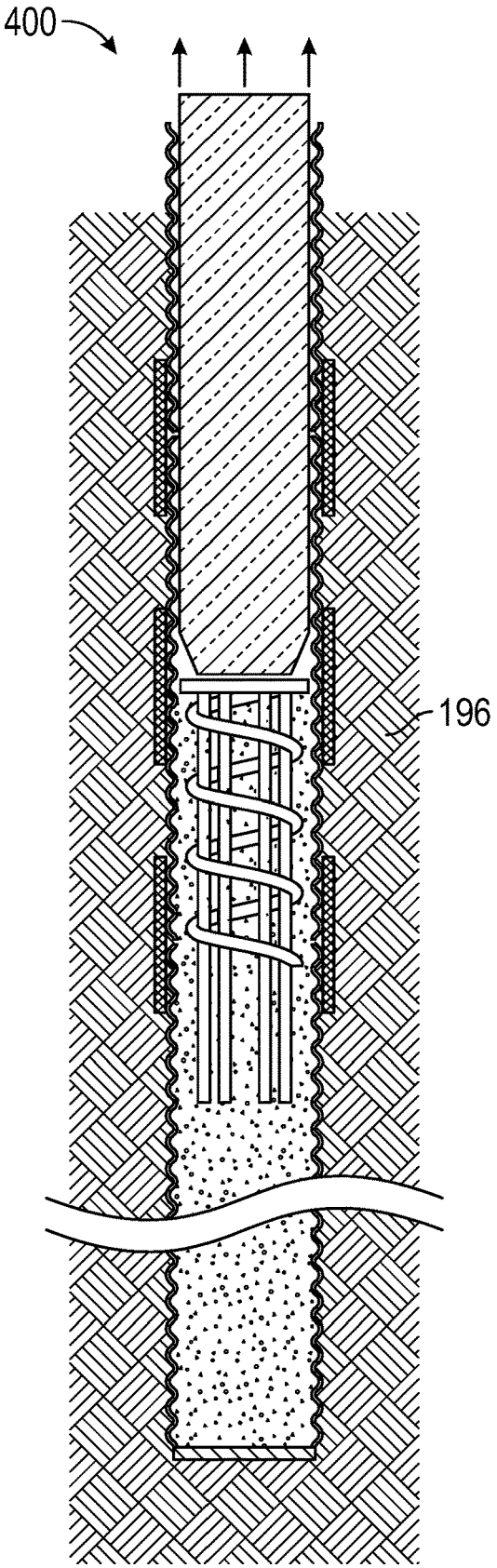
FIG. 4N illustrates removing the mandrel of the driving mechanism from the foundation pile assembly according to the embodiment of the foundation pile assembly as shown in FIG. 4A.
Figure 4O:
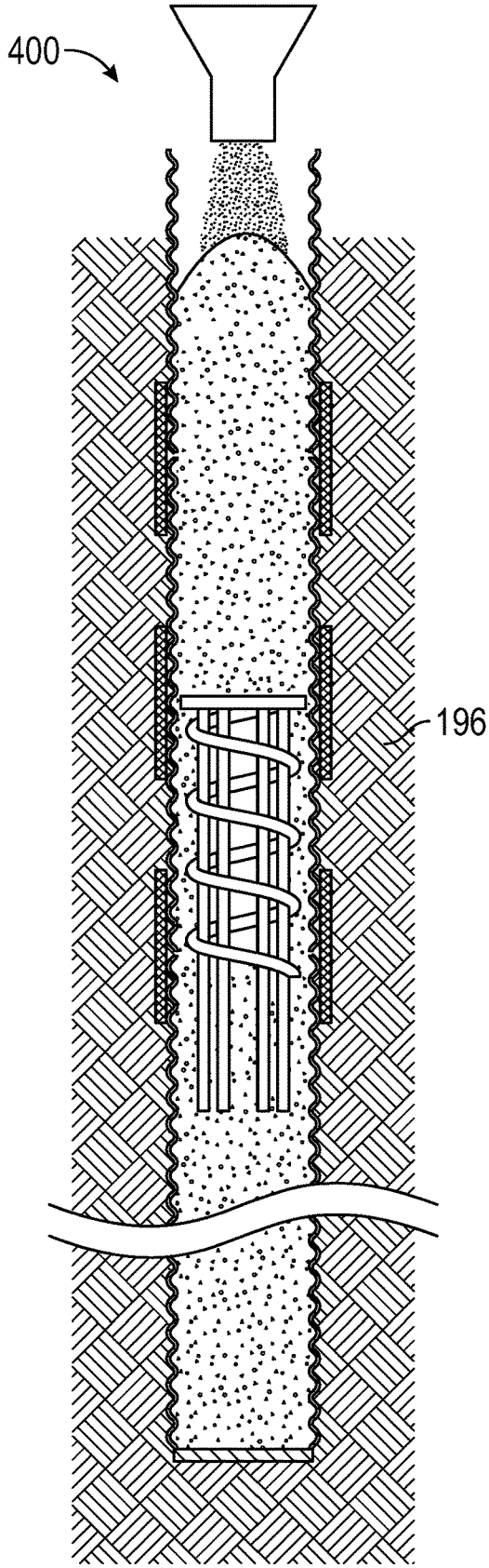
FIG. 4O illustrates filling the top portion with a flowable material according to the embodiment of the foundation pile assembly as shown in FIG. 4A.
Figure 4P:
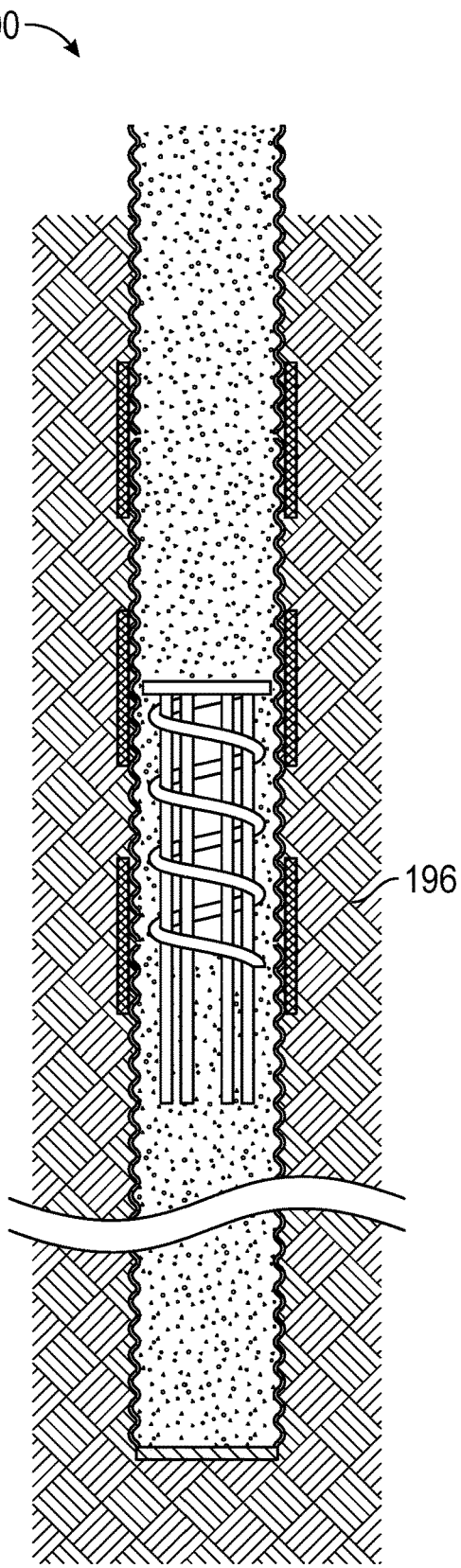
FIG. 4P illustrates a complete foundation pile assembly according to the embodiment of the foundation pile assembly as shown in FIG. 4A.

FIG. 4A through FIG. 4P illustrate another embodiment of a foundation pile assembly 400. Any embodiments of the foundation pile sections or foundation pile assemblies shown in FIGS. 4A through 4P can have any of the components, features, or other details of any of the other embodiments of the foundation pile sections or foundation pile assemblies shown or described herein in any combination with any of the components, features, or details of any of the embodiments of the foundation pile sections or foundation pile assemblies shown in FIGS. 4A through 4P. Further, any other pile section embodiments or pile assembly embodiments disclosed herein can have any of the components, features, or other details of any of the other embodiments shown in FIGS. 4A through 4P in any combination with any of the components, features, or details of such other foundation pile section or foundation pile assembly embodiments. Additionally, any of the fabrication or installation steps or details disclosed with regard to any other foundation pile section or foundation pile assembly embodiments disclosed herein can be used with some embodiments of the foundation pile sections or foundation pile assemblies shown in FIG. 4A through FIG. 4P and vice-versa.

In some embodiments, the pile assembly 400 can include a plurality of pile sections 403, such as an impact support section 401, the bottom section 402, and/or other sections. A small length of a shell 420 can be used to house an impact support element 450. Some embodiments of the impact support element 450 can have any components, features, or other details of any other embodiments of impact support elements disclosed herein, in any combination with any components, features, or other details disclosed herein for impact support element 450. In some embodiments, shell 420 can be a transition or sleeve connecting bottom section 402 to second shell 430. In some embodiments, the short transitional connection length of the shell 420 can be 3 feet, about 3 feet, or less than 3 feet, or 5 feet, about 5 feet, or less than 5 feet, 7 feet, about 7 feet, less than 7 feet, or greater than 7 feet in length, or 10 feet or about 10 feet or more in length, or any other suitable length. The length can be selected to optimize the connection between bottom section 402 and second shell 430. One or more reinforcement straps 480 can be coupled to the outside surface of the shell 420 and can further strengthen the foundation pile assembly 400 at the zone of impact where the impact support element is subject to the force of a driving mechanism.

The user can place a first flowable material 490, horizontally or vertically, inside the interior space of the shell 420 such that a portion of a second portion 470 that is positioned in the shell 420 is surrounded with a first flowable material 490 while the other portion of the second portion 470 that extends beyond an end of the first shell 420, referred to as an uncovered rebar section 491*a*, remains uncovered. In some embodiments, a second shell 420*a* can rest on a rack 40 in a horizontal or substantially horizontal orientation (or other orientation, as desired, including a vertical orientation) where a user can place a sleeve portion 491 in a first end 404 of the second shell 420*a*. The sleeve portion 491 can provide a housing to receive the uncovered rebar section 491*a*. In some embodiments, the sleeve portion 491 can include a plurality of pipes. For example, and without limitation, it can include 4 or 6 or 8 or any other suitable number of pipes. In some embodiments, the number of pipes can correspond to the number of straight reinforcement bars in the impact support element 450. In some embodiments, the plurality of pipes can have a diameter of about 0.5 inch to about 5 inches. Other sizes and shapes can also be used.

With reference to FIG. 4E, a second flowable material 492 can be advanced through one or more cut-outs or openings 422 and can surround the perimeter of the sleeve portion 491. However, the interior space of the sleeve portion 491 (not shown in the figures) can remain hollow or substantially hollow. After a suitable passage of time, such as without limitation about 3 or 4 days, the second flowable material 492 can turn into a second cured material 492*a*. One or more cover members 426 can be used to close the one or more cut-outs 422. Once all steps for fabrication of the bottom section is complete, the bottom section 402 can be lofted and driven into the ground.

In some embodiments, a first strap 42 and/or a second strap 44 can be used to loft the bottom section 402. A driving mechanism 497 can be used to drive the bottom section 402 until a suitable portion of the bottom section 402 is above the ground surface. In some embodiments, the portion of the bottom section 402 above the ground surface can correspond to a length of about 3 feet, though this can more or less depending on the site conditions. As discussed earlier, the sleeve portion 491 can be configured to receive the uncovered rebar section 491*a*. Optionally, a user can place an adhesive material within the hollow interior of the sleeve portion 491 to facilitate receiving and bonding to the uncovered rebar section 491*a*. The adhesive material can be glue, anchoring adhesive, epoxy or any other suitable material. As can be seen in FIG. 4J, the user can loft and position the impact support section 401 above the bottom section 402 and allow the two assemblies to mate by inserting the uncovered rebar section 491*a* into the sleeve portion 491. The user can attach one or more reinforcement straps 481 around an outside of the shells at the joint, as per any other embodiments disclosed herein, to further strengthen the connection of the impact support section 401 with the bottom section 402. The reinforcement strap(s) 481 can be attached with one or more welds and/or mechanical connections and/or other suitable mechanisms.

In some embodiments, a second shell 430 can be connected to the impact supporting section 401, and the foundation pile assembly 400 can be driven in the subsurface soil 196 in a manner similar to other embodiments of the present disclosure discussed earlier and as illustrated in FIG. 4L through FIG. 4P. Alternatively, the second shell 430 can be coupled to the impact support section 401 while the impact support section 401 rests on a horizontal (or substantially horizontal) rack 40 and prior to mating with the bottom section 402.

FIG. 5A through FIG. 8C illustrate additional embodiments of foundation pile assemblies. Some embodiments shown in FIG. 5A through FIG. 8C can be referred to as full-length foundation pile assemblies. A full-length assembly can allow for a foundation pile assembly to be assembled horizontally and/or on the ground without a need to install any additional shell sections while the pile is being driven or when the pile is in a vertical orientation. A full-length foundation pile assembly can have several advantages. The following are some example (non-limiting) advantages of a full-length assembly. The full-length assembly can allow the foundation pile assembly to be constructed with minimal connections and allows the entire pile assembly to be lofted and driven in the subsurface soil in a single action, thus increasing the speed of installation and overall efficiency of the operation. Additionally, the full-length assembly can increase the safety of the construction process by reducing the steps that are required for a complete installation of a foundation pile assembly. The process of completing an installed foundation pile assembly requires less lofts per pile and can result in less transportation. The process can be completed by inserting the mandrel into the shell while the shell is on the ground which can eliminate the need to insert the mandrel vertically at a high elevation in the air.

Referring to FIGS. 5A through 50, another embodiment of a foundation pile assembly 500, also referred to as a full-length foundation pile assembly 500, is illustrated. In some embodiments, the foundation pile assembly 500 can be referred to as a full-length foundation pile assembly. Any embodiments of the foundation pile sections or foundation pile assemblies shown in FIGS. 5A through 50 can have any of the components, features, or other details of any of the other embodiments of the foundation pile sections or foundation pile assemblies shown or described herein in any combination with any of the components, features, or details of any of the embodiments of the foundation pile sections or foundation pile assemblies shown in FIGS. 5A through 50. Further, any other pile section embodiments or pile assembly embodiments disclosed herein can have any of the components, features or other details of any of the other embodiments shown in FIGS. 5A through 50 in any combination with any of the components, features, or details of such other foundation pile section or foundation pile assembly embodiments. Additionally, any of the fabrication or installation steps or details disclosed with regard to any other foundation pile section or foundation pile assembly embodiments disclosed herein can be used with some embodiments of the foundation pile sections or foundation pile assemblies shown in FIG. 5A through FIG. 5O and vice-versa.

Figure 5A:
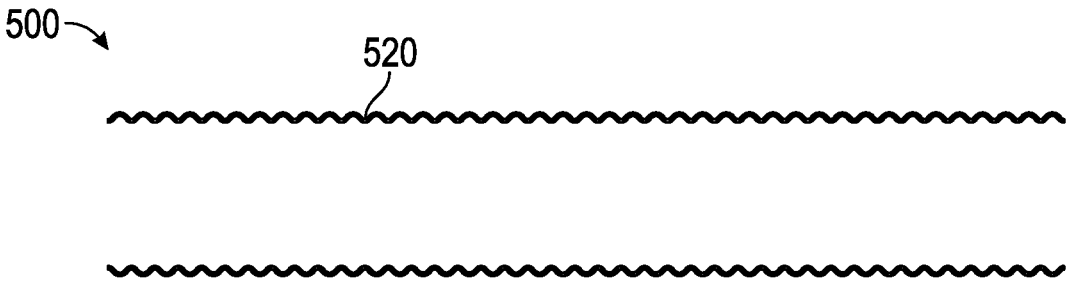
FIG. 5A illustrates a side view of a first shell according to another embodiment.
Figure 5B:
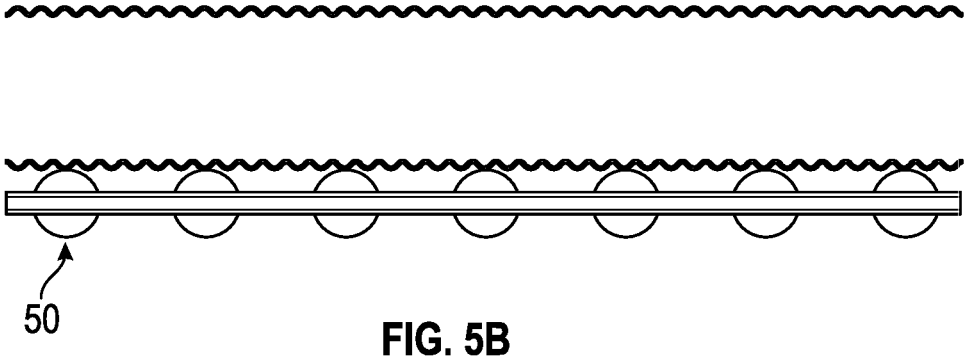
FIG. 5B illustrates the first shell of FIG. 5A on a rack.
Figure 5C:
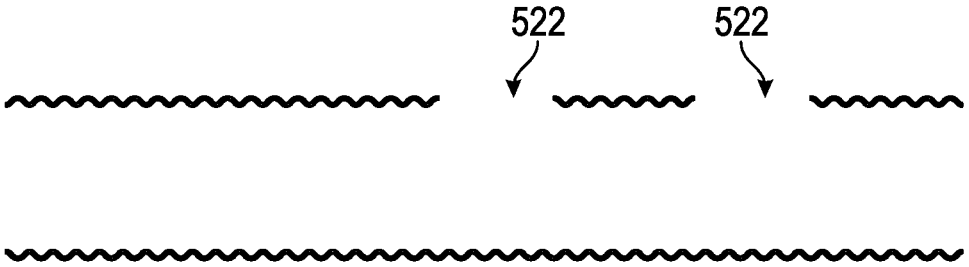
FIG. 5C illustrates a cut-out placed on the first shell according to the embodiment of the foundation pile assembly as shown in FIG. 5A.
Figure 5D:
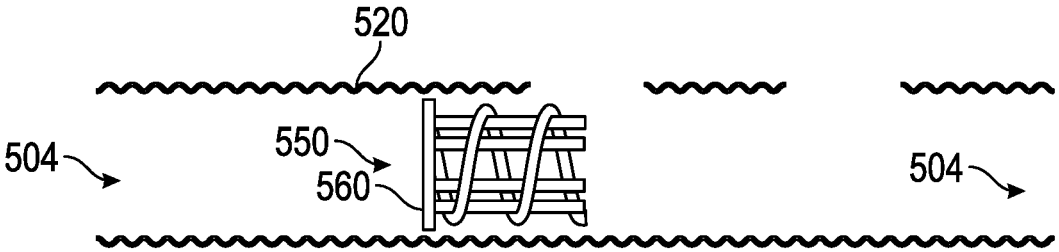
FIG. 5D illustrates an impact support element positioned in the first shell according to the embodiment of the foundation pile assembly as shown in FIG. 5A.
Figure 5E:
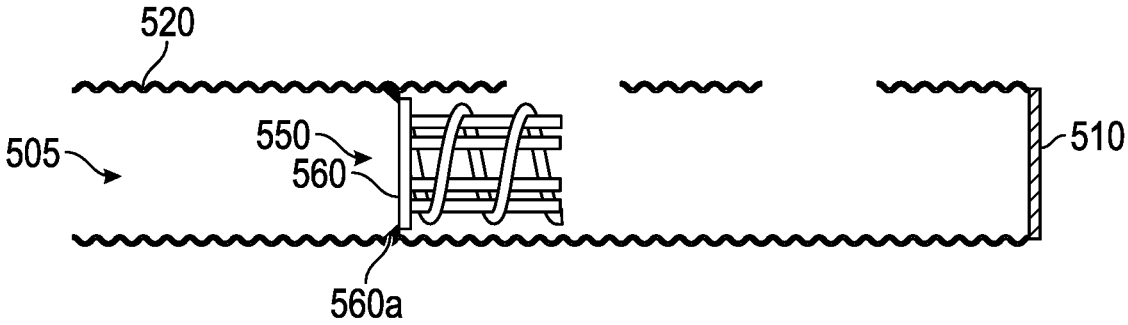
FIG. 5E illustrates an end cap attached to the first shell according to the embodiment of the foundation pile assembly as shown in FIG. 5A.
Figure 5F:
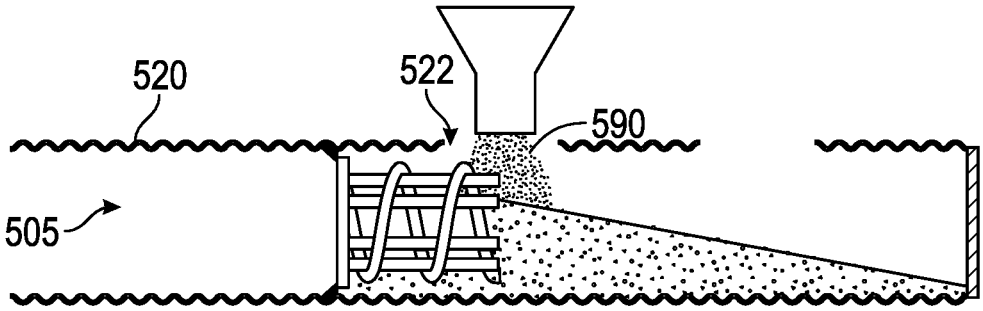
FIG. 5F illustrates filling a portion of the first shell with a first flowable material according to the embodiment of the foundation pile assembly as shown in FIG. 5A.
Figure 5G:
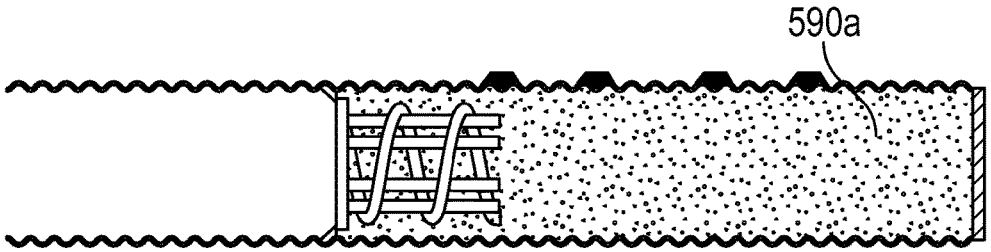
FIG. 5G illustrates the shell of FIG. 5F with an attachment piece over the cut-out portions according to the embodiment of the foundation pile assembly as shown in FIG. 5A.
Figure 5H:
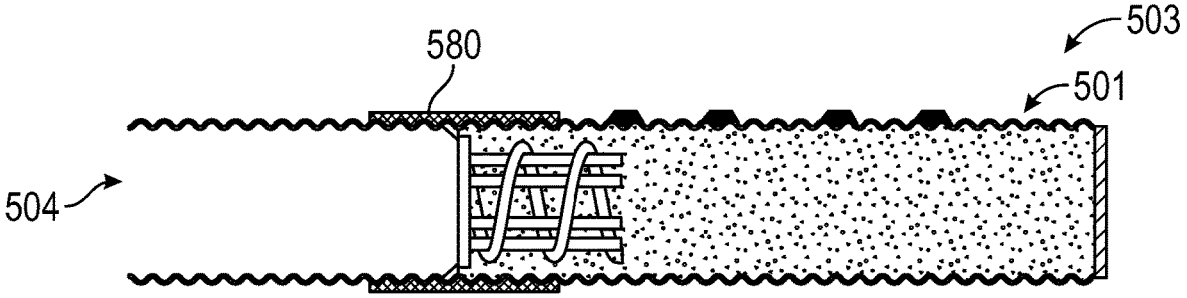
FIG. 5H illustrates reinforcing the first shell with reinforcement straps according to the embodiment of the foundation pile assembly shown in FIG. 5A.
Figure 5I:
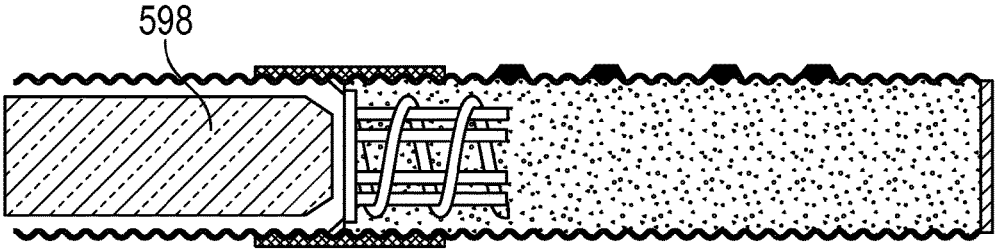
FIG. 5I illustrates placement of the mandrel in the first shell according to the embodiment of the foundation pile assembly as shown in FIG. 5A.
Figure 5J:
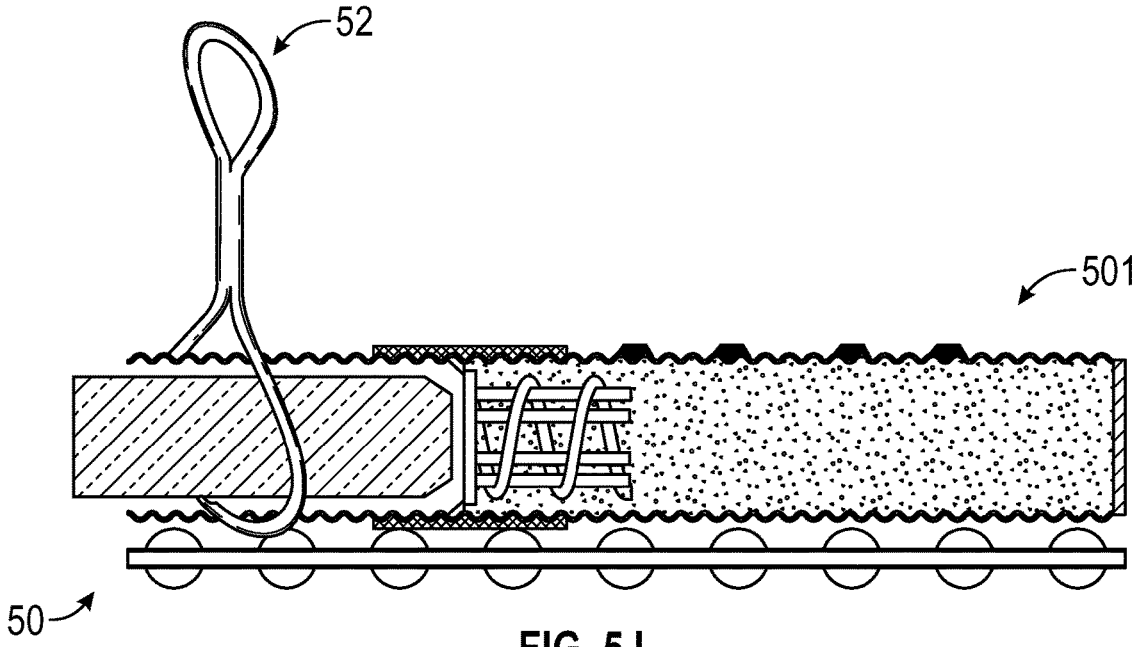
FIG. 5J illustrates attaching a first strap to the first shell according to the embodiment of the foundation pile assembly as shown in FIG. 5A.
Figure 5K:
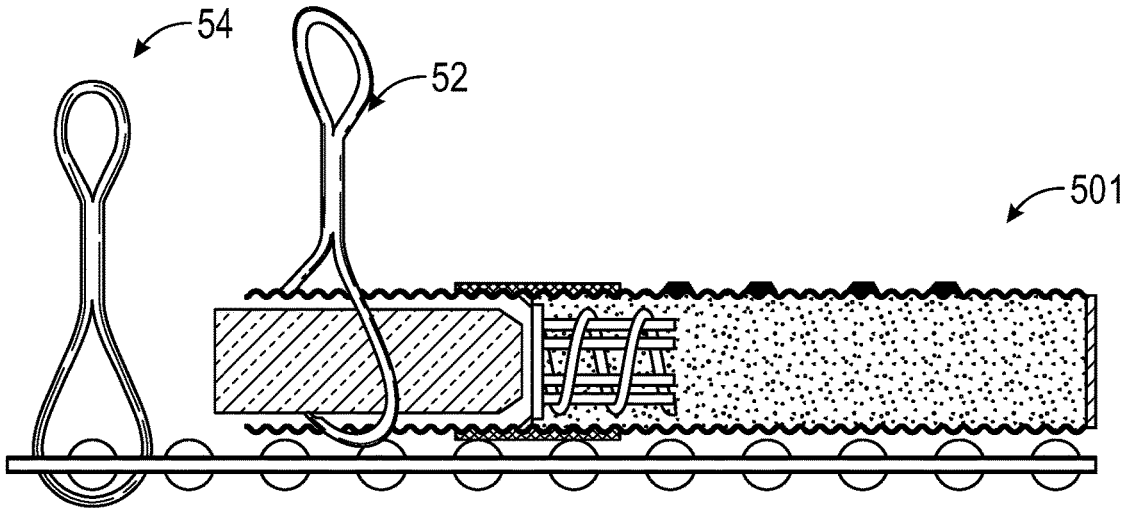
FIG. 5K illustrates a second strap around the rack according to the embodiment of the foundation pile assembly as shown in FIG. 5A.
Figure 5L:
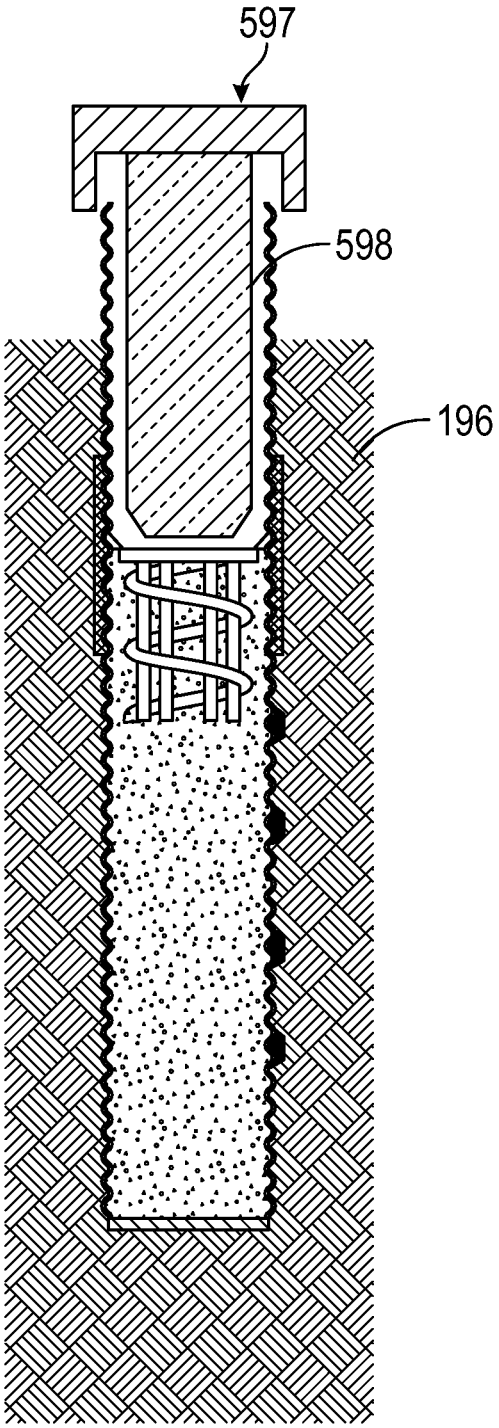
FIG. 5L illustrates driving the first shell in the subsurface soil with a driving mechanism according to the embodiment of the foundation pile assembly as shown in FIG. 5A.
Figure 5M:
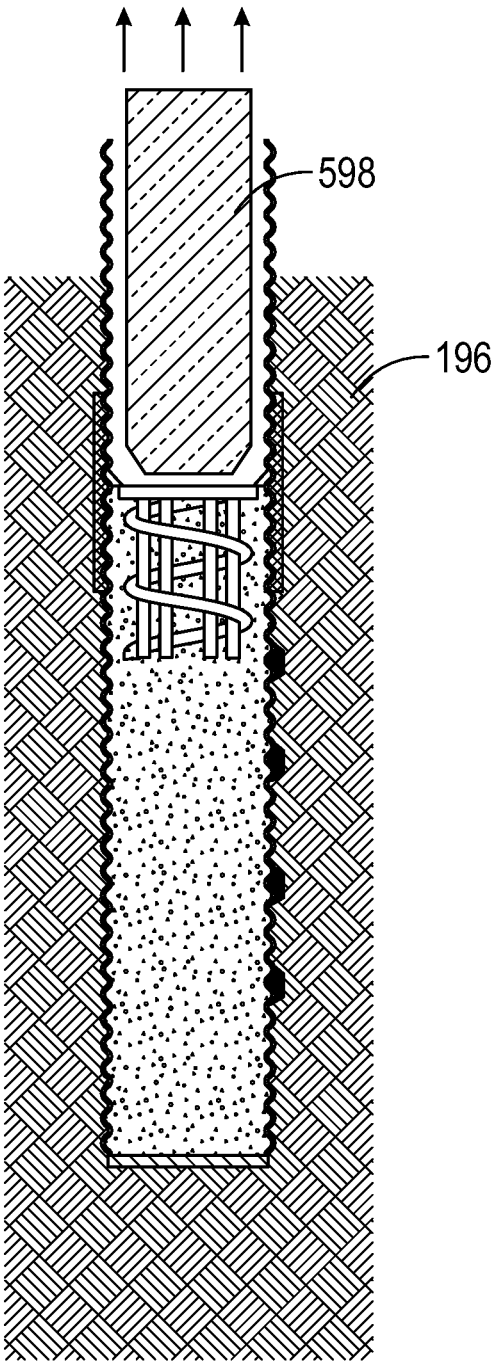
FIG. 5M illustrates removing the mandrel from the first shell according to the embodiment of the foundation pile assembly as shown in FIG. 5A.
Figure 5N:
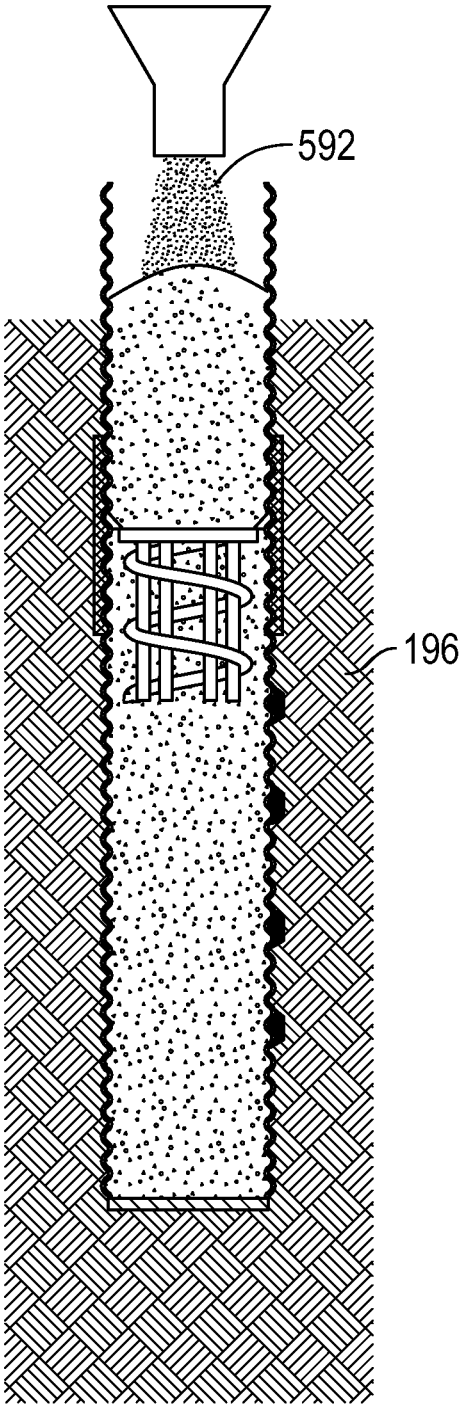
FIG. 5N illustrates filling the first shell with a second flowable material according to the embodiment of the foundation pile assembly as shown in FIG. 5A.
Figure 5O:
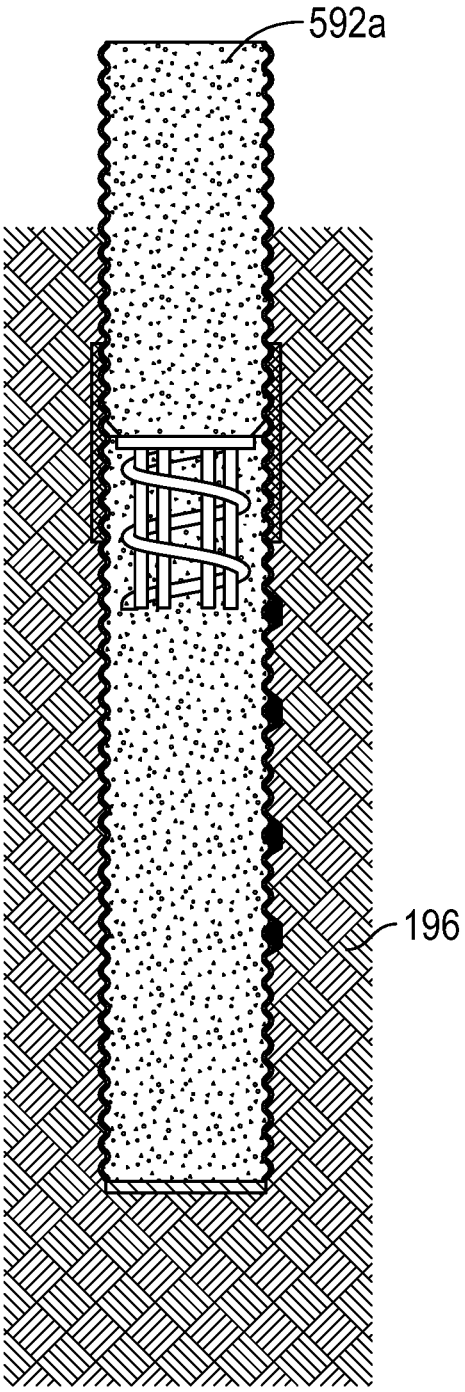
FIG. 5O illustrates a complete foundation pile assembly according to the embodiment of the foundation pile assembly as shown in FIG. 5A.

In some embodiments, the foundation pile assembly 500 can include one or plurality of pile sections 503, that can be coupled together on a rack or ground surface, or other location and orientation that is easily accessible by ground workers. The user can place a full length of a shell 520 on a horizontal or sloped rack 50 while the rack 50 is on the ground. The full length of the shell 520, or any other embodiment disclosing a full-length assembly, can be as much as or less than 100 feet or about 100 feet or as much as or less than 150 feet or about 150 feet or as much as or less than 200 feet or about 200 feet. An impact support element 550 can be inserted through a first end 504 or the second end 506. In some embodiments, the impact support element 550 can be positioned at or near mid-point of the shell length. In some embodiments, the impact support element 550 can be positioned at different locations. In some embodiments, the impact support element can be positioned within the shell so that a second end portion of the impact support element can extend past at least one of the openings, as shown in FIG. 5D, for example and without limitation. In other embodiments, the impact support element can be positioned within the shell so that an end of the second end portion of the impact support element can be approximately aligned with an edge of at least one of the openings, as shown in FIG. 5G, for example and without limitation. Optionally, in any embodiments, the impact support element 550 can be coupled with an inside of the shell 520 using one or more welds, fasteners, or other connection mechanisms 560*a*. As mentioned, the connection mechanism 560*a* can be made via one or more welds, adhesive, or any other suitable mechanism. Some embodiments of the impact support element 550 can have any components, features, or other details of any other embodiments of impact support elements disclosed herein, in any combination with any components, features, or other details disclosed herein for impact support element 550.

A cap 510 can be attached to a distal or lowermost end of the shell 520 (lowermost end refers to the end of the shell when in a driven orientation). The cap 510 can be attached to the shell 520 via one or more welds or other acceptable mechanisms. The interior of the shell 520 between about a first portion 560 of the impact support element and the inside face of the cap 510 can be filled or substantially filled with a first flowable material 590 which can be inserted in the shell 520 through one or more cut-outs or openings 522. One or more reinforcement straps 580 can be coupled to the shell 520, as per any methods or details disclosed with respect to other embodiments herein. The one or more reinforcement straps 580 can be coupled to the shell 520 via one or more welds, mechanical attachments, or other suitable mechanisms. In some embodiments, the one or more reinforcement straps 580 can be attached to the shell 520 proximate to the first portion 560 of the impact support element 550 to loft a full-length section 501. Other locations, such as locations closer to the tip of the foundation pile assembly, proximate to the cap 510, or other regions along the length of the shell, can also be used.

Once a desirable duration passes and the flowable material 590 hardens to a cure material 590*a*, in some embodiments, a mandrel 598 can be inserted through the first end 504 of the shell 520 while the shell is on a rack or on the ground or in a generally horizontal orientation, and/or before the foundation pile section is lofted. A first strap 52 and/or a second strap 54 can be used to loft the foundation pile assembly 500. The same or similar mechanisms discussed earlier can be used to drive the foundation pile assembly 500 in the subsoil 196, such as, for example and without limitation, with a driving mechanism 597. Similar to other embodiments discussed earlier, the remainder of the interior of the shell (i.e., the portion of the interior 505 between the first portion 560 and the first end 504) can be filled or substantially filled with a second flowable material 592, which can subsequently turn into a second cured material 592*a*.

Figure 6A:
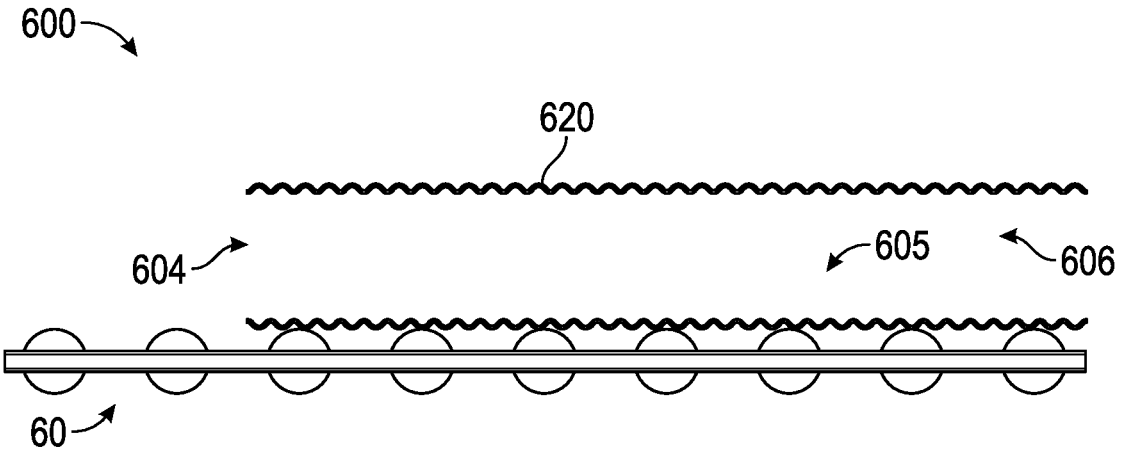
FIG. 6A illustrates a side view of a first shell according to another embodiment of the foundation pile assembly.
Figure 6B:
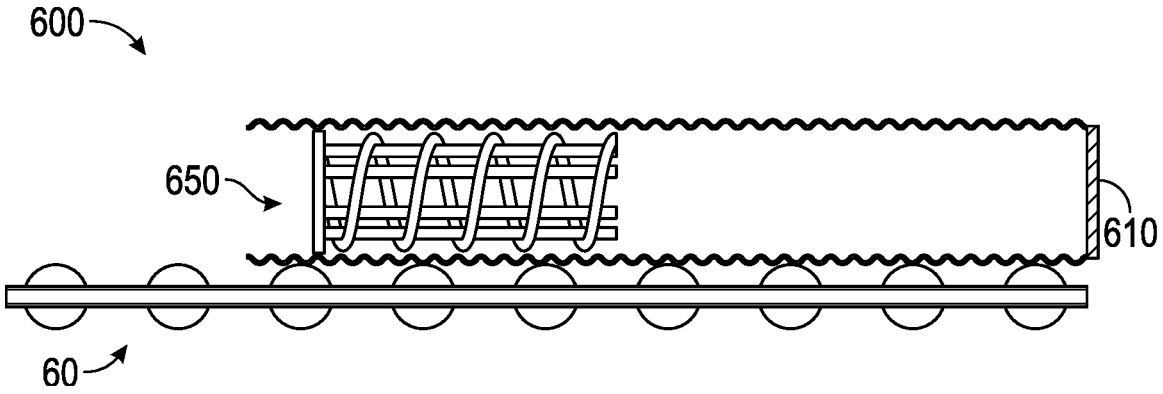
FIG. 6B illustrates placement of the impact support element and an end cap according to the embodiment of the foundation pile assembly as shown in FIG. 6A.
Figure 6C:
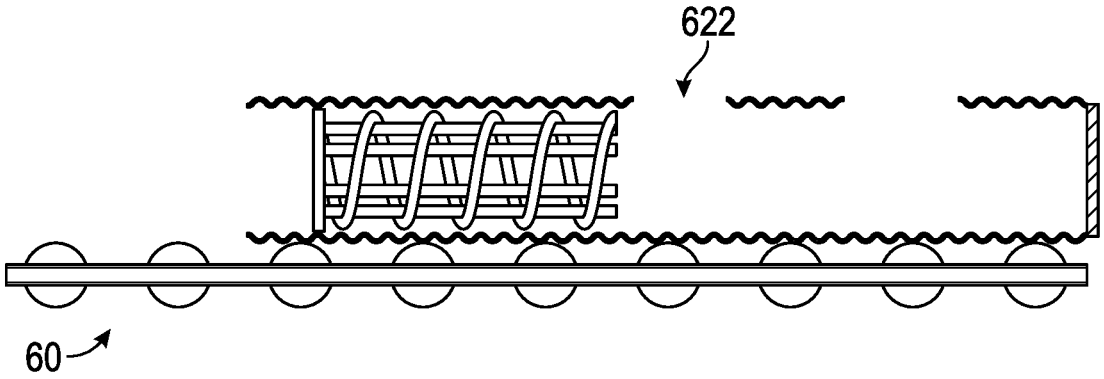
FIG. 6C illustrates cut-outs on the top surface of shell according to the embodiment of the foundation pile assembly as shown in FIG. 6A.
Figure 6D:
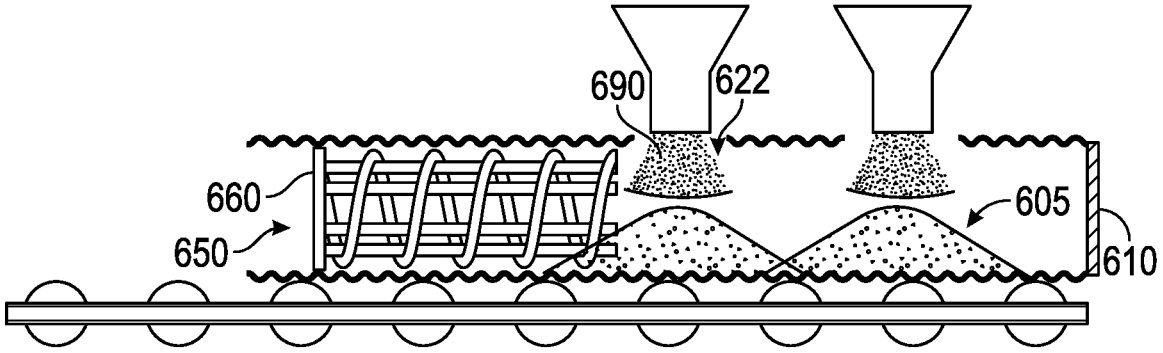
FIG. 6D illustrates filling a portion of the shell with a first flowable material according to the embodiment of the foundation pile assembly as shown in FIG. 6A.
Figure 6E:
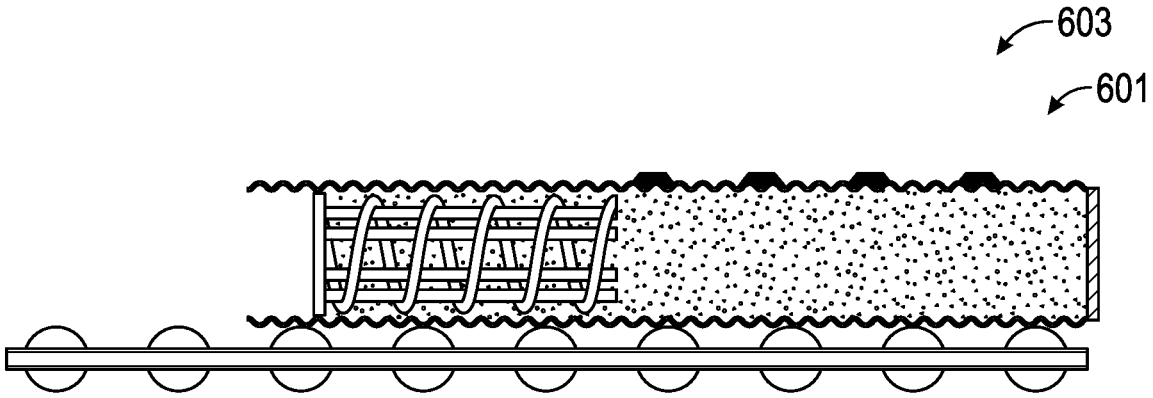
FIG. 6E illustrates attachment pieces connected to the shell according to the embodiment of the foundation pile assembly as shown in FIG. 6A.
Figure 6F:
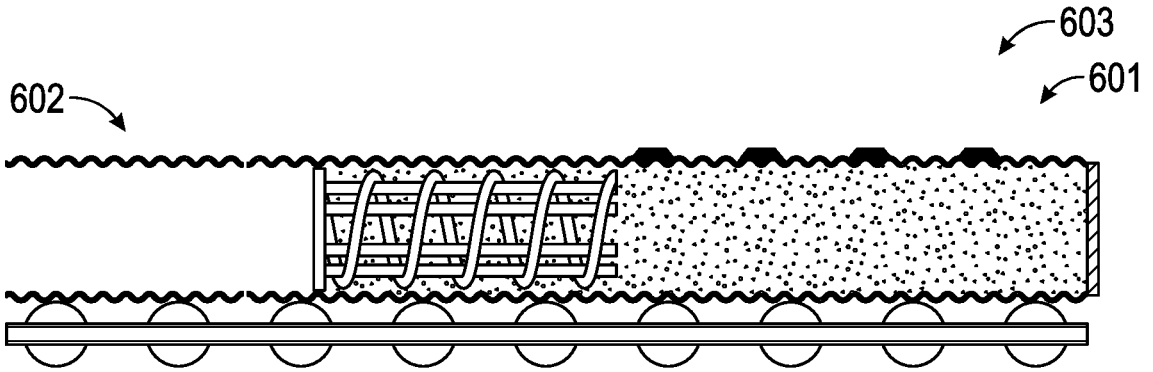
FIG. 6F illustrates a second shell on the rack according to the embodiment of the foundation pile assembly as shown in FIG. 6A.
Figure 6G:
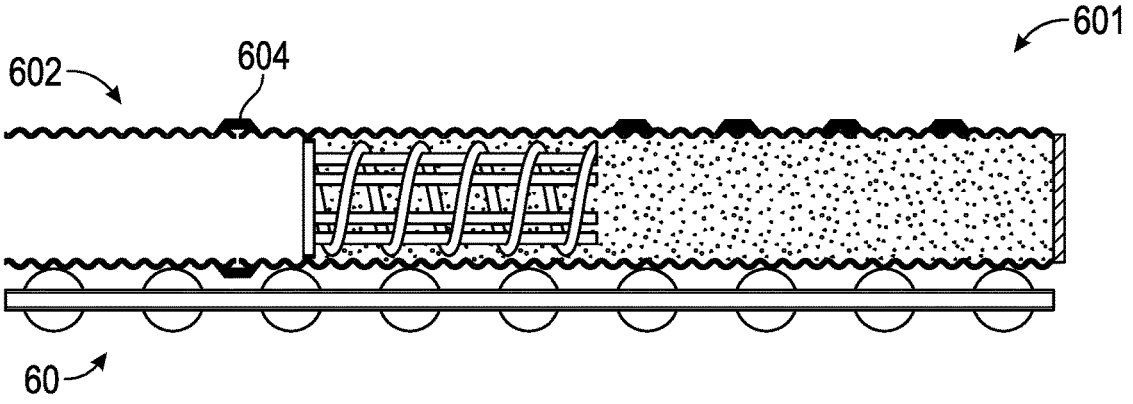
FIG. 6G illustrates connecting the first shell to the second shell according to the embodiment of the foundation pile assembly as shown in FIG. 6A.
Figure 6H:
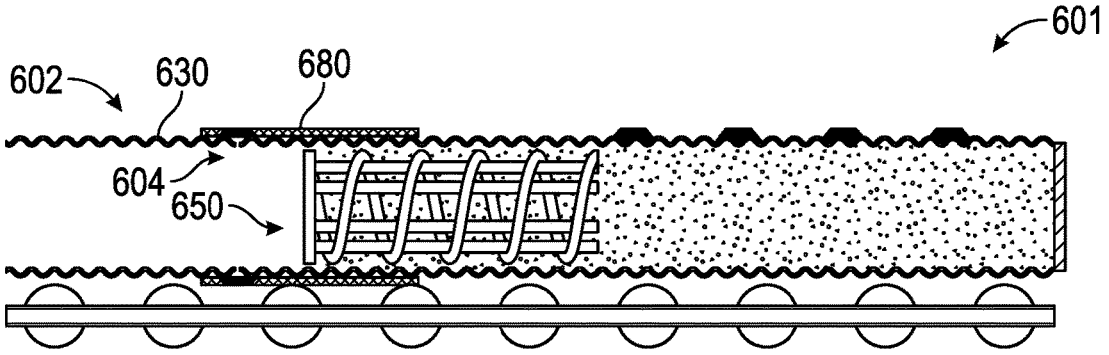
FIG. 6H illustrates placement of reinforcement straps according to the embodiment of the foundation pile assembly as shown in FIG. 6A.
Figure 6I:
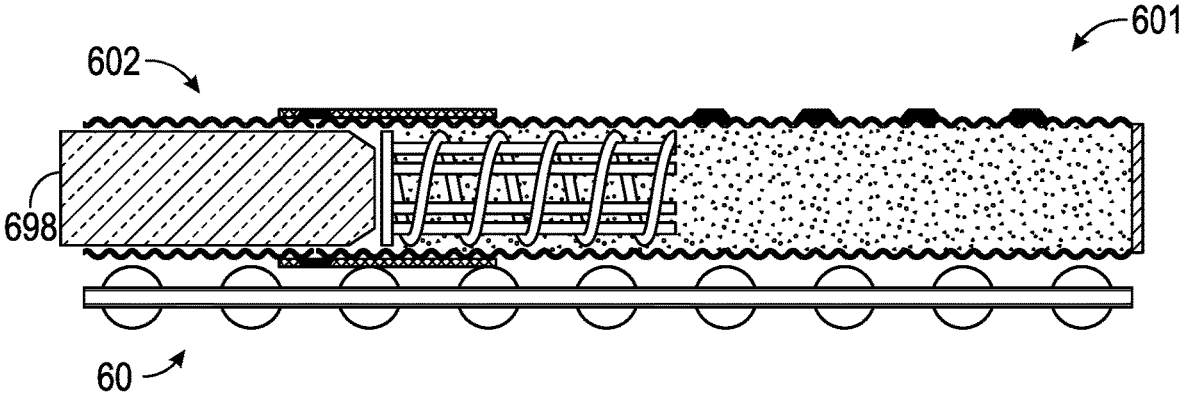
FIG. 6I illustrates placement of the mandrel in the second shell according to the embodiment of the foundation pile assembly as shown in FIG. 6A.
Figure 6J:
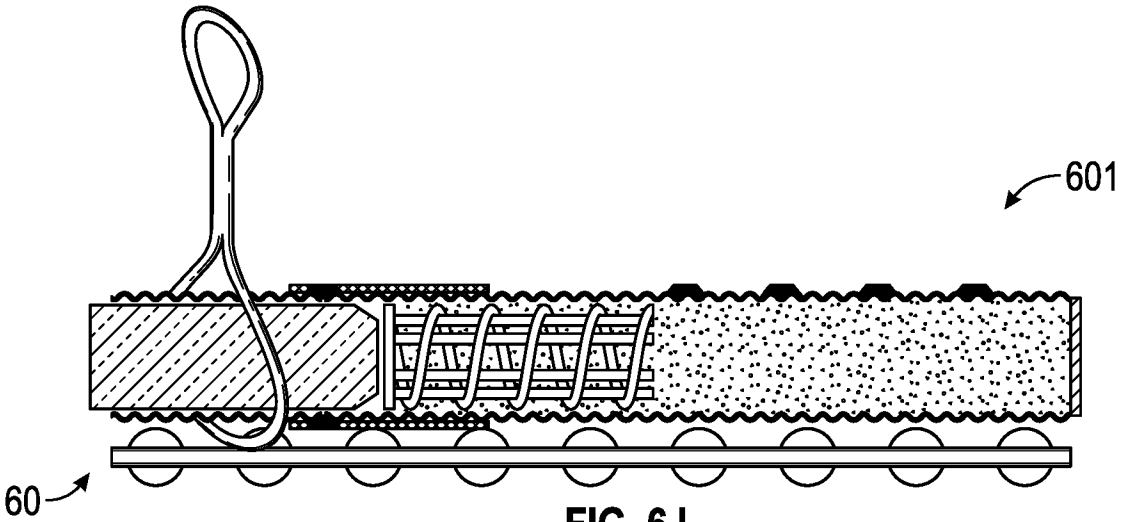
FIG. 6J illustrates a first strap around the second shell according to the embodiment of the foundation pile assembly as shown in FIG. 6A.
Figure 6K:
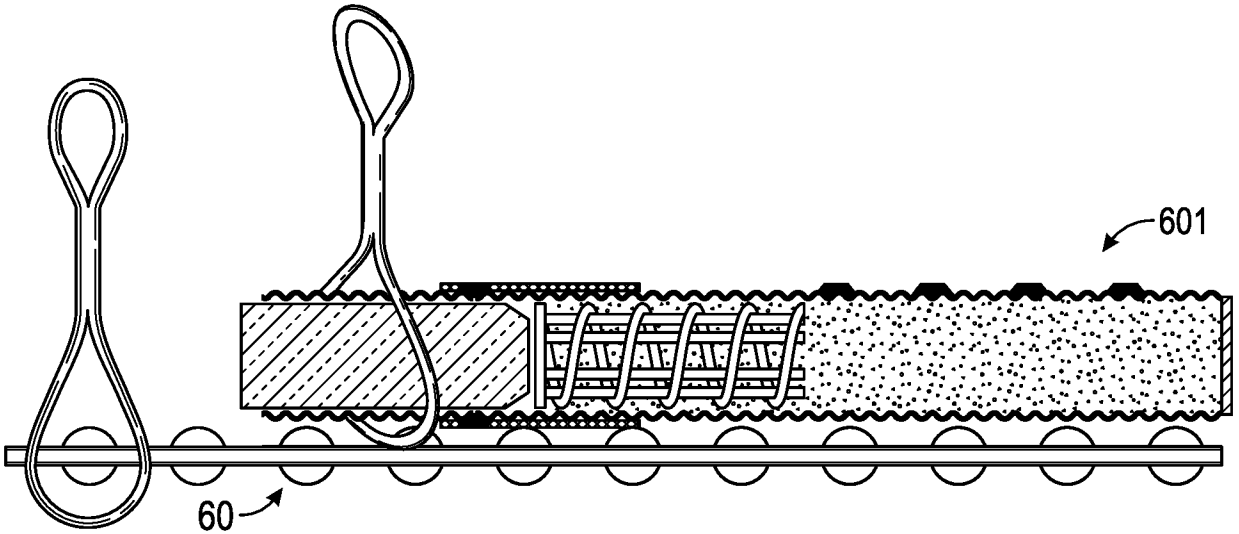
FIG. 6K illustrates a second strap around the rack according to the embodiment of the foundation pile assembly as shown in FIG. 6A.
Figure 6L:
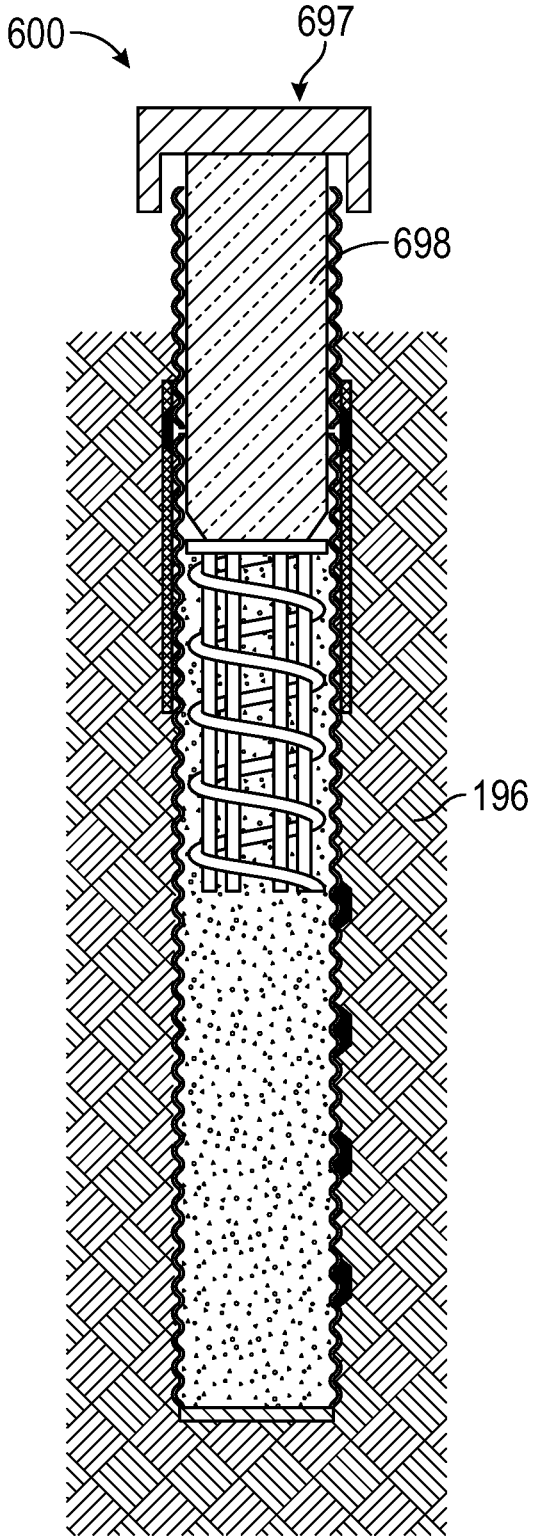
FIG. 6L illustrates a driving mechanism and mandrel driving the foundation pile assembly in the subsurface soil according to the embodiment of the foundation pile assembly as shown in FIG. 6A.
Figure 6M:
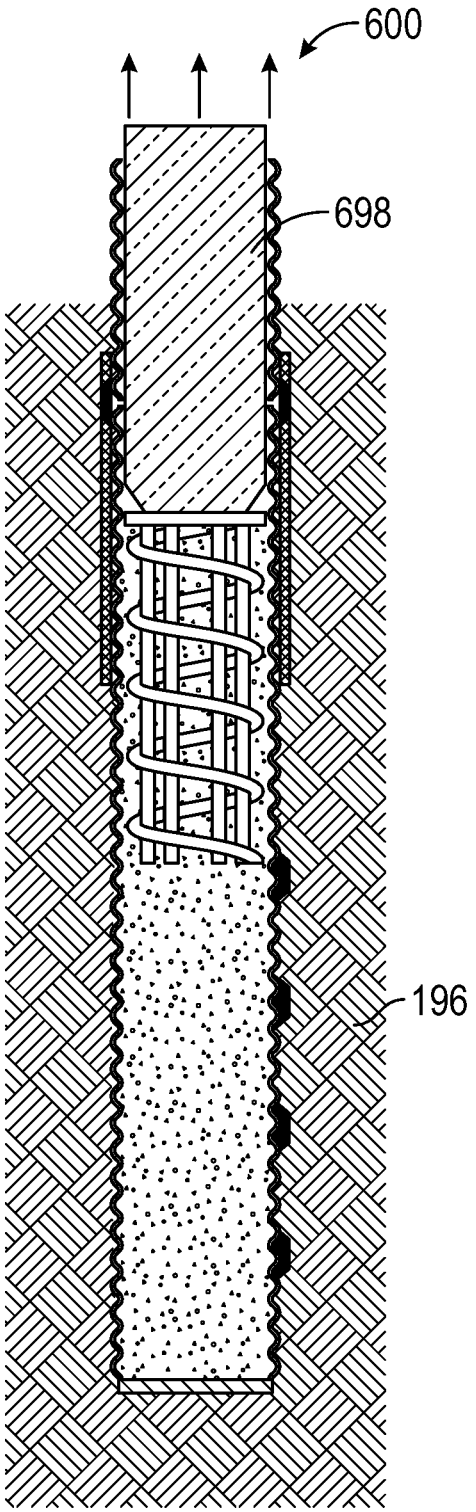
FIG. 6M illustrates removing the mandrel according to the embodiment of the foundation pile assembly as shown in FIG. 6A.

Referring to FIGS. 6A through 60, another embodiment of a foundation pile assembly 600 is illustrated. Some embodiments of the foundation pile assembly 600 can be referred to as a full-length foundation pile assembly. Any embodiments of the foundation pile sections or foundation pile assemblies shown in FIGS. 6A through 60 can have any of the components, features or other details of any of the other embodiments of the foundation pile sections or foundation pile assemblies shown or described herein in any combination with any of the components, features, or details of any of the embodiments of the foundation pile sections or foundation pile assemblies shown in FIGS. 6A through 60. Further, any other pile section embodiments or pile assembly embodiments disclosed herein can have any of the components, features or other details of any of the other embodiments shown in FIGS. 6A through 60 in any combination with any of the components, features, or details of such other foundation pile section or foundation pile assembly embodiments. Additionally, any of the fabrication or installation steps or details disclosed with regard to any other foundation pile section or foundation pile assembly embodiments disclosed herein can be used with some embodiments of the foundation pile sections or foundation pile assemblies shown in FIG. 6A through FIG. 6O and vice-versa.

In some embodiments, the foundation pile assembly 600 can include one or plurality of pile sections 603, that can be coupled together on a rack or ground surface, or other location and orientation that is easily accessible by ground workers. Some embodiments of the foundation pile section 603 can have an impact support element 650. The impact support element 650 can be inserted through a first end 604 or the second end 606 of the shell 620. In some embodiments, the impact support element 650 can be positioned adjacent or near the first end 604, or near the butt end of the shell 620. The impact support element 650 can also be positioned in other locations. Some embodiments of the impact support element 650 can have any components, features, or other details of any other embodiments of impact support elements disclosed herein, in any combination with any components, features, or other details disclosed herein for impact support element 650.

A first flowable material 690 can be inserted through one or more cut-outs 622 (also referred to herein as openings) to fill or substantially fill the interior 605 of the shell 620 between the inside face of the cap 610 and the inside face of the first portion 660 of the impact support element 650, which is the region that can be subject to more stress during the driving operation. One or more reinforcement straps 680 can be coupled to the shell and any adjacent shell at or adjacent to the first end 604 of the shell and/or at or adjacent to the impact support element 650. The reinforcement strap (s) 680 can be coupled to the shell via one or more welds, mechanical attachments, a combination of one or more attachment means, or other suitable mechanisms. The placement of the reinforcement strap 680 at this location can facilitate reinforcement of the shell 620 where the reinforcement strap(s) is/are connected to a second shell 630 while reinforcing the region around the impact support element 650.

Figure 6N:
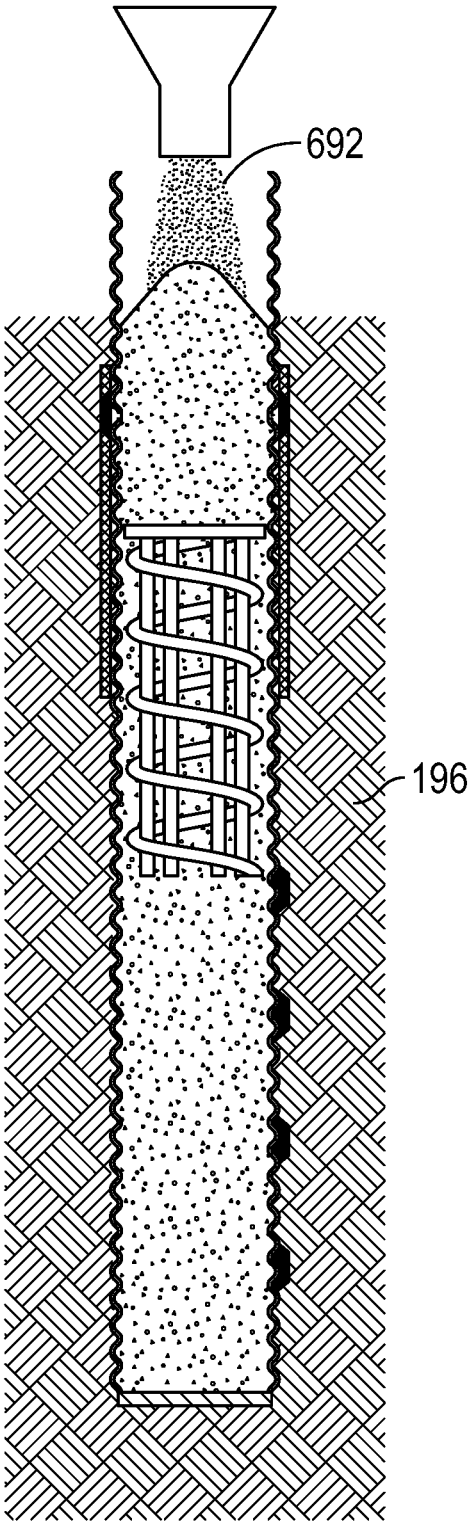
FIG. 6N illustrates placing a second flowable material according to the embodiment of the foundation pile assembly as shown in FIG. 6A.
Figure 6O:
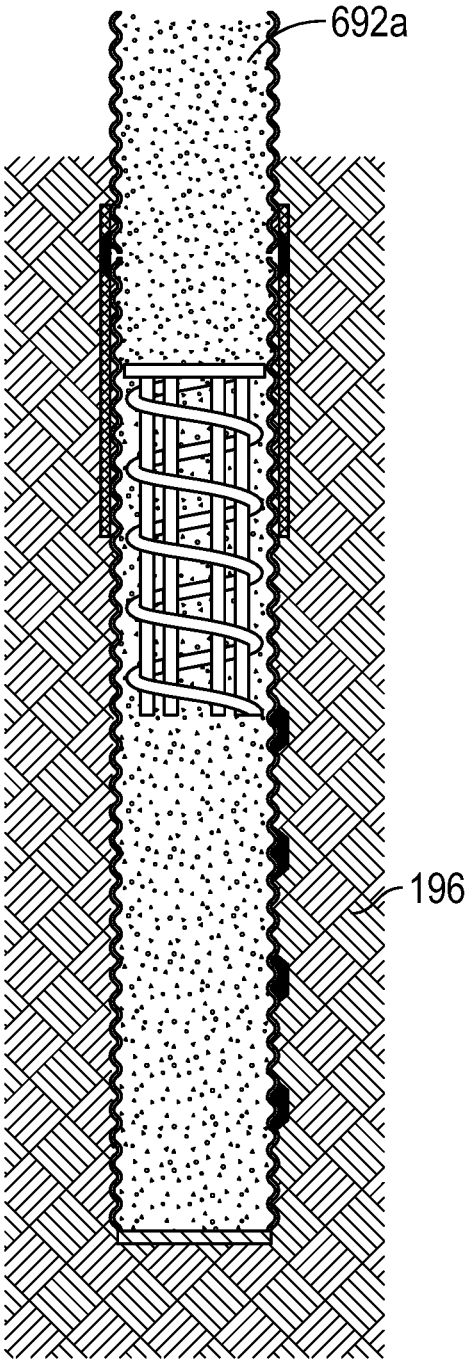
FIG. 6O illustrates a complete foundation pile assembly according to the embodiment of the foundation pile assembly as shown in FIG. 6A.
Figure 7A:
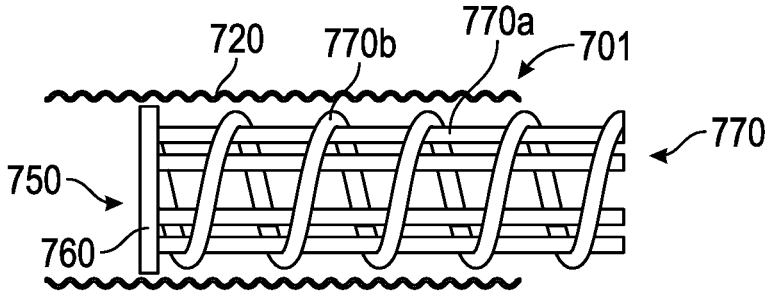
FIG. 7A illustrates a side view of a first shell with the impact support element according to another embodiment of the foundation pile assembly.
Figure 7B:
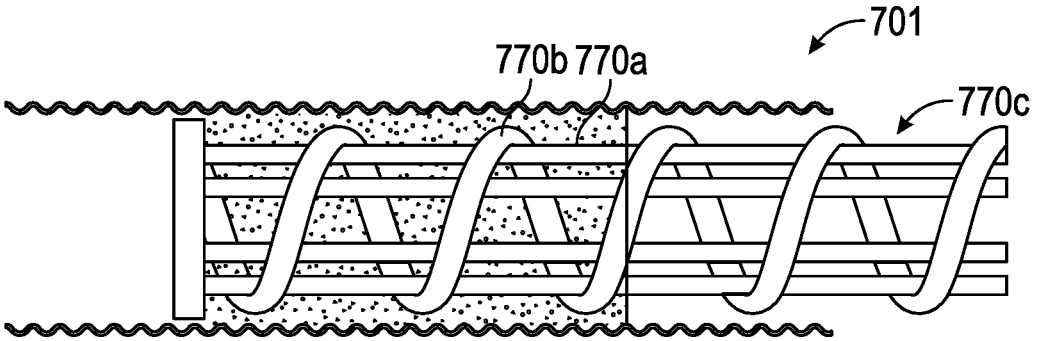
FIG. 7B illustrates filling the first shell with a first flowable material according to the embodiment of the foundation pile assembly as shown in FIG. 7A.
Figure 7C:
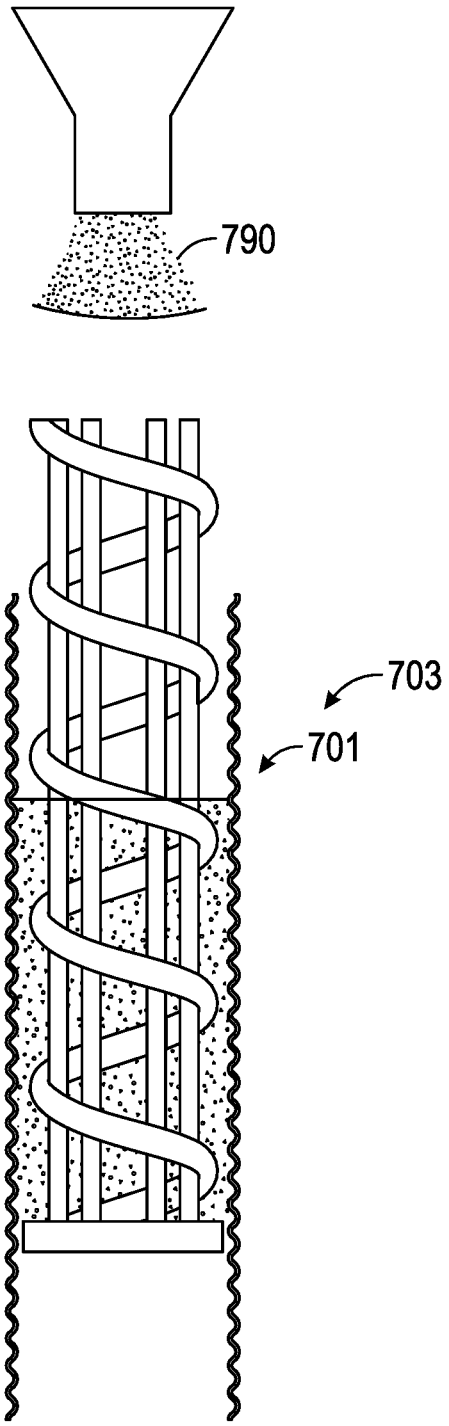
FIG. 7C illustrates another arrangement of filling the first shell with a first flowable material according to the embodiment of the foundation pile assembly as shown in FIG. 7A.
Figure 7D:
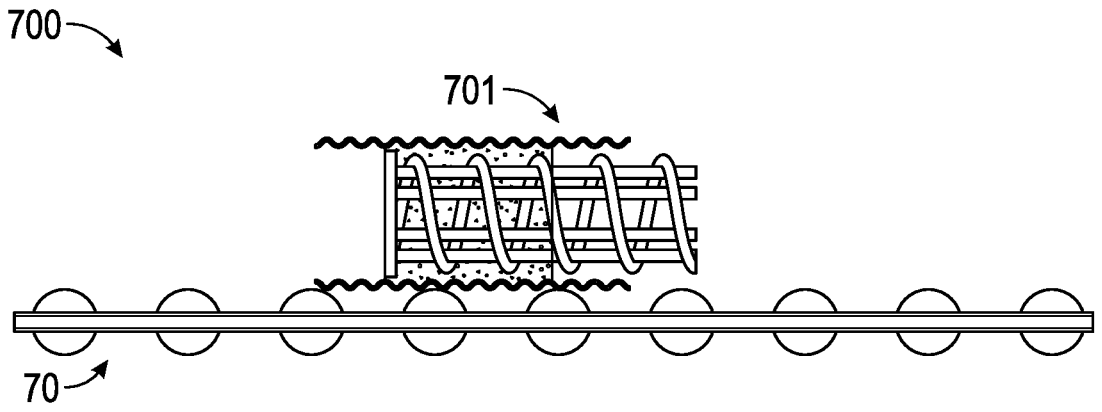
FIG. 7D illustrates placement of a first foundation portion on a rack according to the embodiment of the foundation pile assembly as shown in FIG. 7A.
Figure 7E:
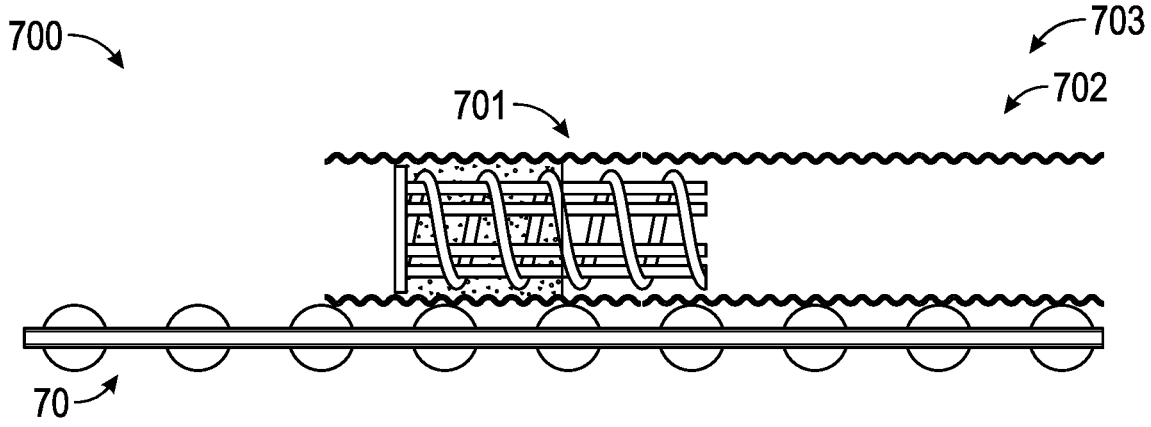
FIG. 7E illustrates a second shell on the rack according to the embodiment of the foundation pile assembly as shown in FIG. 7A.
Figure 7F:
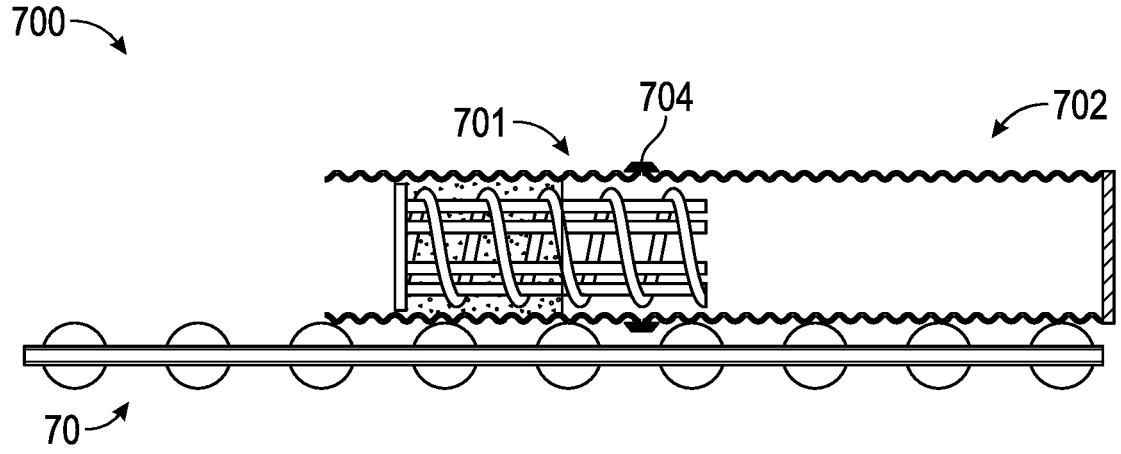
FIG. 7F illustrates attachment of a second shell to the first shell, and attachment of an end cap to the second shell, according to the embodiment of the foundation pile assembly as shown in FIG. 7A.
Figure 7G:
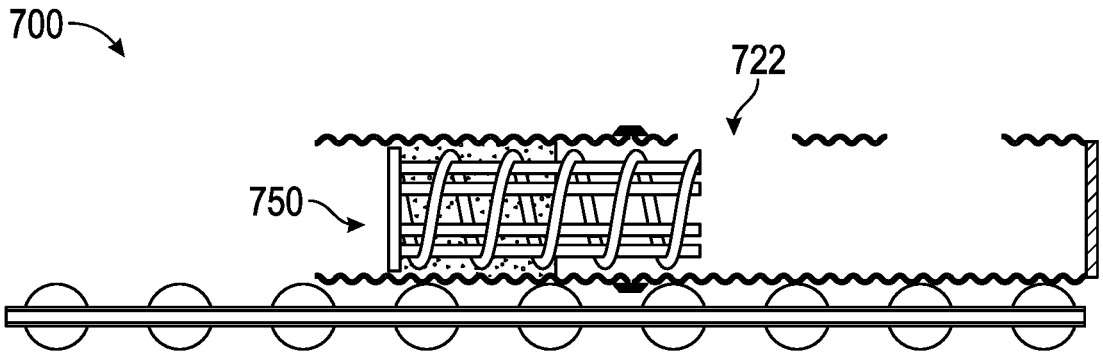
FIG. 7G illustrates the cut-outs on the top surface of the second shell according to the embodiment of the foundation pile assembly as shown in FIG. 7A.
Figure 7H:
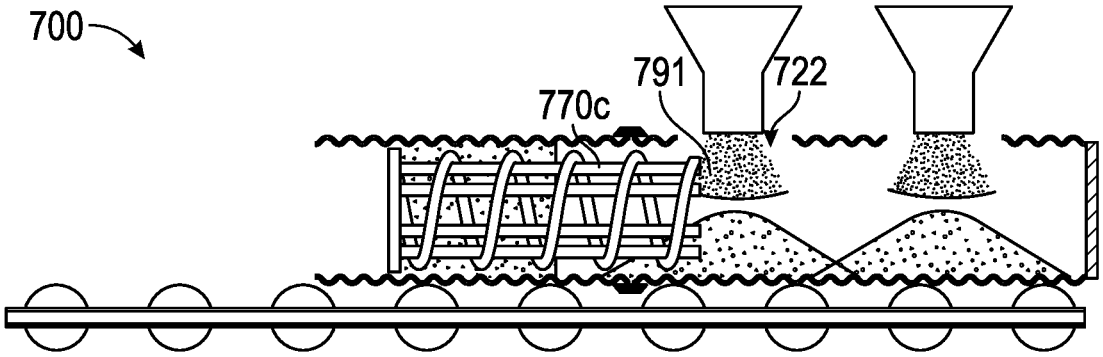
FIG. 7H illustrates filling the second shell with a second flowable material according to the embodiment of the foundation pile assembly as shown in FIG. 7A.
Figure 7I:
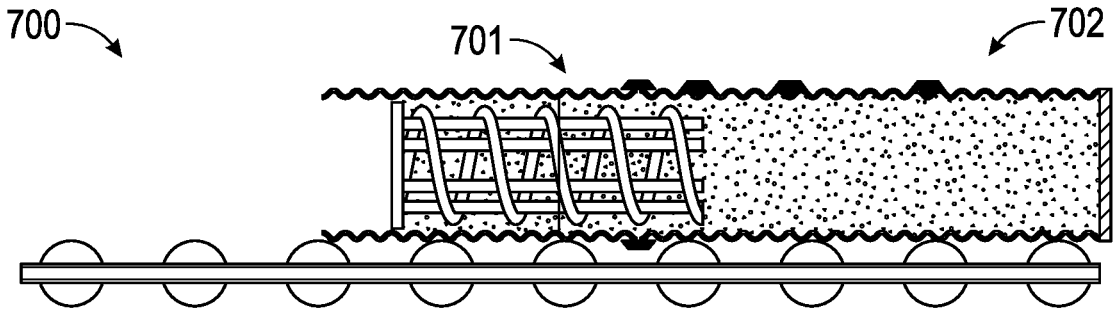
FIG. 7I illustrates an attachment piece over the cut-outs according to the embodiment of the foundation pile assembly as shown in FIG. 7A.

Once fabrication of the foundation pile section is complete (or before fabrication is complete), a mandrel 698 can be inserted in the first end 604 of the shell while the foundation pile assembly rests on the rack 60, on a ground surface, or in a generally accessible position and/or orientation. In other embodiments, the mandrel can be inserted into the shell or foundation pile section while the shell or the foundation pile section is in a generally vertical orientation or otherwise after being lofted. The foundation pile assembly, including a bottom section 601 and a top section 602 coupled to the bottom section 601, can be lofted and driven in the ground with a drive mechanism 697 in the same or similar manner as with other embodiments disclosed herein, and a second flowable material 692, which can eventually turn into second cured material 692*a*, can be advanced through the top portion of the second shell 630 as shown in FIG. 6N.

Referring to FIGS. 7A through 7I, another embodiment of a foundation pile assembly 700 is illustrated. Some embodiments of the foundation pile assembly 700 can be referred to as a full-length foundation pile assembly. Any embodiments of the foundation pile sections or foundation pile assemblies shown in FIGS. 7A through 7I can have any of the components, features or other details of any of the other embodiments of the foundation pile sections or foundation pile assemblies shown or described herein in any combination with any of the components, features, or details of any of the embodiments of the foundation pile sections or foundation pile assemblies shown in FIGS. 7A through 7I. Further, any other pile section embodiments or pile assembly embodiments disclosed herein can have any of the components, features, or other details of any of the other embodiments shown in FIGS. 7A through 7I in any combination with any of the components, features, or details of such other foundation pile section or foundation pile assembly embodiments.

The foundation pile assembly 700 can include one or plurality of pile sections 703, such as an impact assembly section 701 or a bottom section 702 that can be coupled together on a rack or ground surface, or other location and orientation that is easily accessible by ground workers. A small portion of a shell, such as the shell 720 in FIG. 7A, can be used to house the impact support element 750 in an impact assembly section 701. In some embodiments, shell 720 is a transition or sleeve that connects bottom section 702 to another section. Some embodiments of the impact support element 750 can have any components, features, or other details of any other embodiments of impact support elements disclosed herein, in any combination with any components, features, or other details disclosed herein for impact support element 750. In some embodiments, the impact support element 750 can include a first portion 760 and a second portion 770.

The length of the shell 720 can be 3 feet, about 3 feet, or more than 3 feet, or 5 feet, about 5 feet or more than 5 feet, or 7 feet, about 7 feet or more than 7 feet, or 10 feet, about 10 feet or more than 10 feet or any other desired lengths. In some embodiments, the interior space of the shell 720 can be filled with a first flowable material 790 so that a first portion 760 and some of a second portion 770 (for example, about 50%) of the impact support element 750 is surrounded with the first flowable material 790 while some, for example about 50%, of the second portion 770 remains as an uncovered rebar portion 770*c*.

The interior space of the shell 720 or at least a portion of the interior space of the shell 720 can be filled with a first flowable material 790 while the impact assembly section 701 is in a horizontal, vertical, or other convenient orientation. The user can place the impact assembly section 701 on a rack 70 and align a bottom section 702 on the rack so that the upper surface of the bottom section 702 aligns with the upper surface of the impact assembly section 701, and the lower surface of the bottom section 702 aligns with the lower surface of the impact assembly section 701. One or more attachment mechanisms 704, such as welds or other appropriate mechanisms, can be used to couple the bottom section 702 with the impact assembly section 701. A second flowable material 791 can be inserted through one or more openings 722 (which can be, but are not required to be, cutouts in the shell) to fill or substantially fill, the interior of the bottom section 702 and surround the uncovered rebar portion 770*a*. A top section (not shown) can be coupled with the impact assembly section 701. The top section and the impact assembly section 701 can be coupled to each other and reinforced. Subsequently, the top section, the impact assembly section 701, and the bottom section 702 can be lofted and driven in the subsurface soil in a same or similar manner as other embodiments disclosed herein.

Figure 8A:
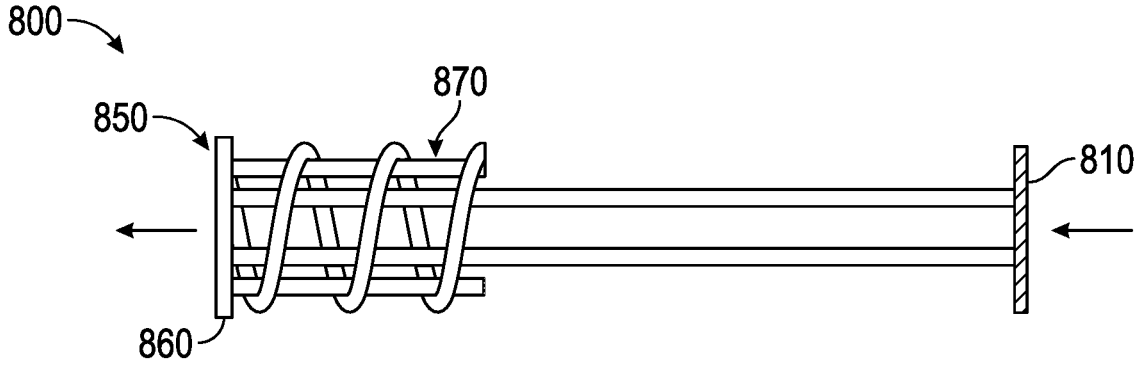
FIG. 8A illustrates an impact support element according to another embodiment of a foundation pile assembly.
Figure 8B:
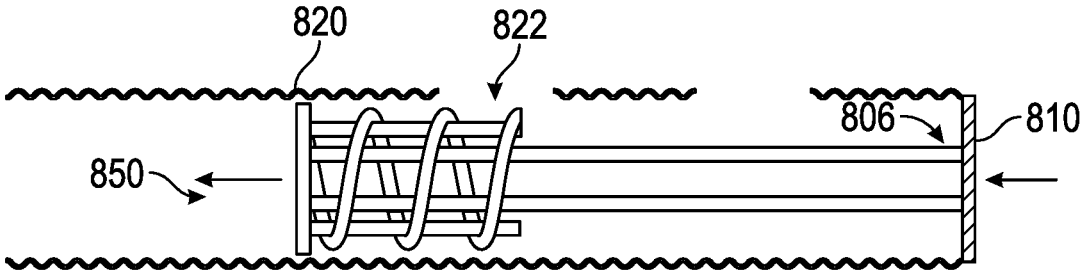
FIG. 8B illustrates placement of the impact support element in a shell according to the embodiment of the foundation pile assembly as shown in FIG. 8A.
Figure 8C:
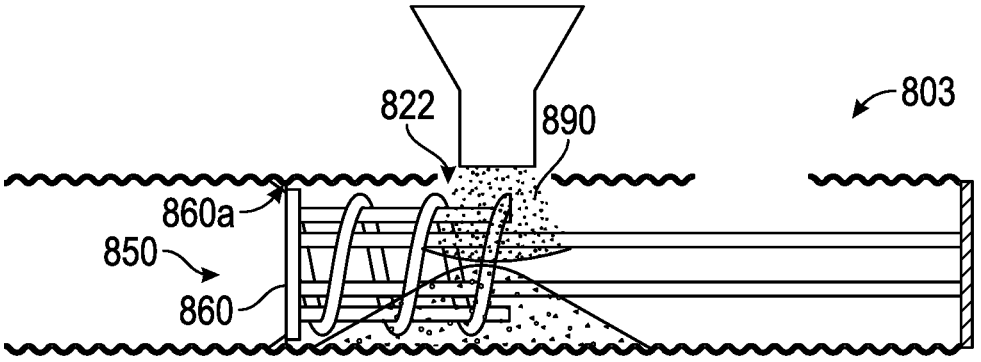
FIG. 8C illustrates filling a portion of the shell with a flowable material according to the embodiment of the foundation pile assembly as shown in FIG. 8A.

Referring to FIG. 8A through FIG. 8C, another embodiment of a foundation pile assembly 800, also referred to as full-length foundation pile assembly 800, is illustrated. Any embodiments of the foundation pile sections or foundation pile assemblies shown in FIG. 8A through FIG. 8C can have any of the components, features, or other details of any of the other embodiments of the foundation pile sections or foundation pile assemblies shown or described herein in any combination with any of the components, features, or details of any of the embodiments of the foundation pile sections or foundation pile assemblies shown in FIGS. 8A through 8C. Further, any other pile section embodiments or pile assembly embodiments disclosed herein can have any of the components, features, or other details of any of the other embodiments shown in FIGS. 8A through 8C in any combination with any of the components, features, or details of such other foundation pile section or foundation pile assembly embodiments. Additionally, any of the fabrication or installation steps or details disclosed with regard to any other foundation pile section or foundation pile assembly embodiments disclosed herein can be used with some embodiments of the foundation pile sections or foundation pile assemblies shown in FIG. 8A through FIG. 8C and vice-versa.

The foundation pile assembly 800 can include one or plurality of pile sections 803 that can be coupled together on a rack or ground surface, or other location and orientation that is easily accessible by ground workers. In some embodiments, an impact support element 850 can include a second portion 870 with one or more straight reinforcement bars that can extend in a lengthwise direction of the shell, perpendicular to the orientation of the first portion 860, and couple with a cap 810. Some of the straight reinforcement bars can be shorter than the reinforcement bars that extend to and couple with the cap 810. In this arrangement, the foundation pile section can have greater stiffness and structural support adjacent to the end cap 810 and between the end cap 810 and the shorter straight reinforcement bars of the impact support element. A coiled or curved reinforcement bar can be coupled with or extend from the first portion 860 of the impact support element and extend at least the length of the shorter straight reinforcement bars of the impact support element.

In some embodiments, while the shell is on a rack, on the ground, or in a generally horizontal orientation, the user can insert the impact support element 850 through a second end 806 of the shell 820 until the first portion 860 is at or near a mid-point of the length of the shell 820 or any other location.

One or more attachment mechanism 860*a*, such as welding or adhesive or other appropriate mechanisms, can be used to secure the impact support element 850 in a desired location. A first flowable material 890 can be inserted in the interior space of the shell 820 through one or more cut-outs or openings 822. Additional reinforcement can be attached to the outside surface of the shell 820 to further strengthen the foundation pile assembly 800 at or adjacent to the impact region, which can be around the first portion 860, or other areas. A mandrel (not shown) can be inserted while the shell 820 is on a rack, on the ground, oriented horizontally, or in another convenient position and/or location. The foundation pile assembly 800 can be lofted and driven in the subsurface soil in a same or similar manner as other embodiments of the present disclosure. As with other embodiments disclosed herein, the foundation pile assembly 800 can be lofted with the mandrel in the shell.

Figure 9A:
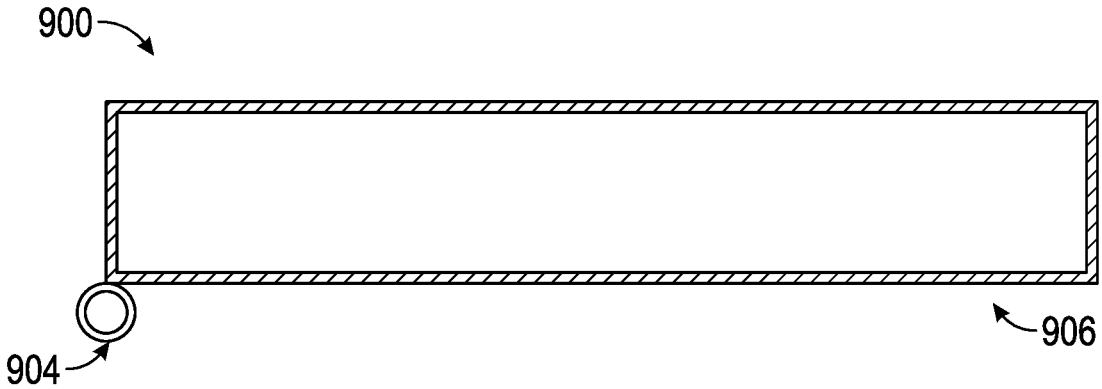
FIG. 9A illustrates a side view of a rack (which can rotate via a rotational hinge from horizontal to vertical position) according to any embodiment of the foundation pile assembly disclosed herein.
Figure 9B:
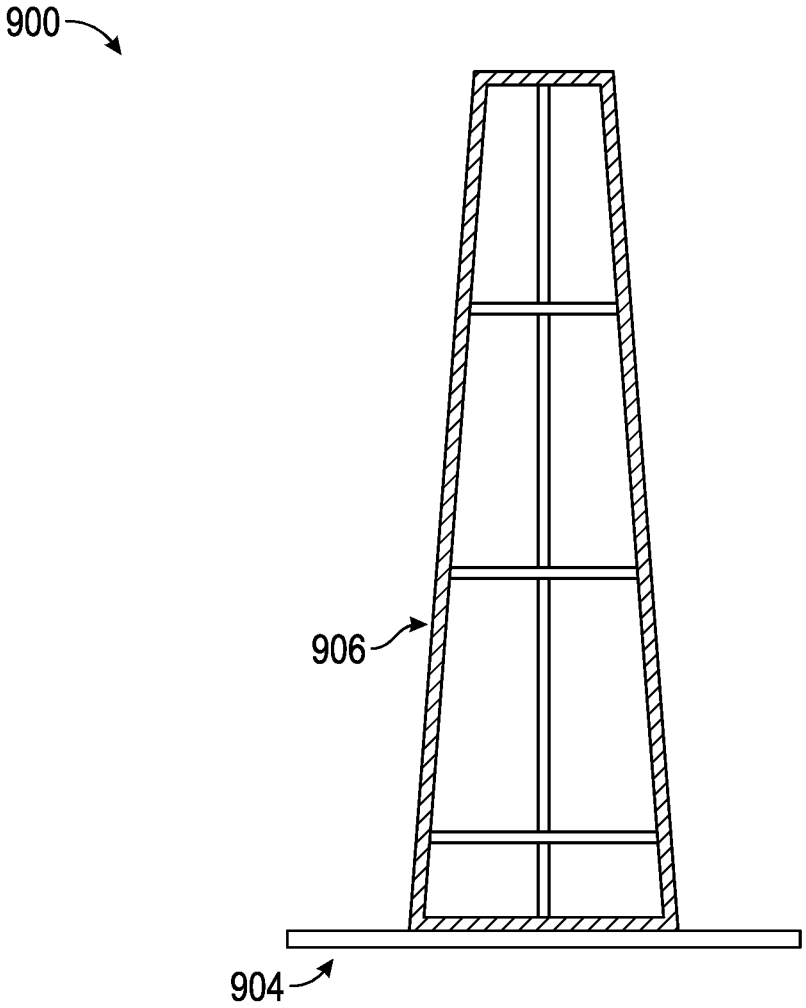
FIG. 9B illustrates a top view of the rack illustrated in FIG. 9A according to any embodiment of the foundation pile assembly disclosed herein.

Referring to FIGS. 9A and 9B, an embodiment of a rack 900 is illustrated. As discussed above, various components of the foundation pile assembly can rest on a rack in a horizontal or generally horizontal orientation before they are lofted and ready for installation in the subsurface soil. Although various figures of the present disclosure, such as the rack 10 of FIG. 1A, illustrate the rack as a series of rollers, such rollers/conveyor rollers/wheels are not necessary for a complete and functional rack. Some embodiments of the rack disclosed herein do not have rollers. In some embodiments, the rack 90 can include a number of H-beams welded or bolted together to make an isosceles trapezoidal frame, such as frame 906, with the bottom base longer than the top base. In some embodiments, the bottom base can be anchored (bolted) to portable timber mats. Some embodiments can comprise a timber mat with the approximate dimensions of about 20 feet×about 4 feet×about 1 foot. A hinge 904 can allow the frame 906 to rotate 90 degrees, or other angles as needed, upwards from the bottom base during the loft of the foundation pile assembly. Any of the embodiments of the racks disclosed herein can have any of the components, features, or other details of the embodiment of the rack 900 shown in FIGS. 9A and 9B.

Terms of orientation used herein, such as "top," "bottom," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

Several illustrative examples of foundation pile assemblies have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations can be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain embodiments, advantages, and novel features are described herein, not necessarily all such advantages can be achieved in accordance with any particular example. For example, some examples within the scope of this disclosure achieve one advantage, or a group of advantages, as taught herein without necessarily achieving other advantages taught or suggested herein. Further, some examples can achieve different advantages than those taught or suggested herein.

Some examples have been described in connection with the accompanying drawings. The figures are not drawn and/or not shown to scale, but such scale should not be limiting, since dimensions and proportions other than what are shown are contemplated and are within the scope of this disclosure. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein can be practiced using any device suitable for performing the recited steps.

For purposes of summarizing the disclosure, certain embodiments, advantages, and features of this disclosure have been described herein. Not all, or any such advantages are necessarily achieved in accordance with any particular example of the present disclosure. No embodiments of this disclosure are essential or indispensable. In many examples, the devices, systems, and methods can be configured differently than illustrated in the figures or description herein. For example, various functionalities provided by the illustrated modules can be combined, rearranged, added, or deleted. In some implementations, additional or different processors or modules can perform some or all of the functionalities described with reference to the examples described and illustrated in the figures. Many implementation variations are possible. Any of the features, structures, steps, or processes disclosed in this specification can be included in any example.

In summary, various examples of foundation pile assemblies and related methods have been disclosed. This disclosure extends beyond the specifically disclosed examples to other alternative examples and/or other uses of the examples, as well as to certain modifications and equivalents thereof. Moreover, this disclosure expressly contemplates that various features and embodiments of the disclosed examples can be combined with, or substituted for, one another. Accordingly, the scope of this disclosure should not be limited by the particular disclosed examples described above but should be determined only by a fair reading of the claims.

What is claimed is:

1. A foundation pile assembly configured to provide foundation pile support to a structure, comprising:

a first pile section comprising:

a shell having a first end, a second end, a circumferential wall extending from the first end of the shell to the second end of the shell, and an interior space within the wall;

a cap coupled with the second end of the shell, the second end of the shell configured to be a lowermost end of the shell when the first pile section is being driven into the ground; and an impact support element positioned within the interior space of the shell, the impact support element comprising:

a first portion comprising a plate of a rigid material; and a second portion coupled to the first portion, the second portion comprising a plurality of reinforcement members extending in a longitudinal axial direction from a first main surface of the first portion, wherein the impact support element is positioned within the interior space of the shell so that the plurality of reinforcement members of the second portion extend toward the second end of the shell;

wherein:

the impact support element is positioned within the interior space of the shell;

the impact support element is coupled with an inside surface of the wall of the shell in a desired position to bias the impact support element to remain in the desired position as a first concrete material is added to at least a portion of the interior space within the wall of the shell occupied by the impact support element; and the first pile section is configured such that the first concrete material is added to at least the portion of the interior space within the wall of the shell occupied by the impact support element.

2. The foundation pile assembly of claim 1, wherein the shell comprises a helically corrugated steel pipe, round steel pipe, or any combination thereof.

3. The foundation pile assembly of claim 1, comprising a second pile section, the second pile section having a shell configured to be coupled with the shell of the first pile section at the first end of the shell of the first pile section.

4. The foundation pile assembly of claim 3, wherein the first pile section is a bottom pile section and the second pile section is a top pile section.

5. The foundation pile assembly of claim 3, comprising a plurality of reinforcement straps coupled with an outside surface of the shell of the first pile section and an outside surface of the shell of the second pile section, where the shell of the second pile section couples with the shell of the first pile section so that the plurality of reinforcement straps overlap a joint between the shell of the first pile section and the shell of the second pile section.

6. The foundation pile assembly of claim 1, wherein the cap is coupled to the shell of the first pile section with one or more welds on an outside surface of the wall of the shell.

7. The foundation pile assembly of claim 1, wherein the first portion comprises a steel plate.

8. The foundation pile assembly of claim 1, wherein the second portion of the impact support element comprises a plurality of straight reinforcement bars and at least one coil shaped reinforcement bar surrounding the plurality of straight reinforcement bars.

9. The foundation pile assembly of claim 1, wherein the impact support element comprises a short structural member.

10. The foundation pile assembly of claim 1, wherein the plurality of reinforcement members of the impact support element have a generally round cross-section.

11. The foundation pile assembly of claim 1, wherein the plurality of reinforcement members is coupled to the first portion with one or more welds or other type of bond or attachment means.

12. The foundation pile assembly of claim 1, wherein the first concrete material is a high strength concrete material having a compressive strength of at least 5,000 psi.

13. The foundation pile assembly of claim 1, wherein the first pile section is configured to receive a second concrete material in the interior space of the shell of the first pile section above the first portion of the impact support element.

14. The foundation pile assembly of claim 1, wherein the first concrete material is a high strength concrete material having a compressive strength of at least 7,000 psi.

15. The foundation pile assembly of claim 1, comprising a plurality of reinforcement straps coupled with an outside surface of the shell of the first pile section adjacent to or overlapping a portion of the shell where the impact support element is positioned.

16. The foundation pile assembly of claim 1, wherein the shell has one or more openings in the wall of the shell configured to receive a flowable concrete mix therethrough and one or more covers configured to be coupled with the shell to cover the one or more openings after the concrete mix has been added to the interior space of the shell.

17. The foundation pile assembly of claim 1, wherein the impact support element is positioned within the interior space of the shell while the shell is in a generally horizontal orientation.

18. The foundation pile assembly of claim 1, wherein the first pile section is configured such that the first concrete material is added to at least the portion of the interior space within the wall of the shell occupied by the impact support element when the shell of the first pile section is in a generally horizontal orientation.

19. The foundation pile assembly of claim 1, wherein the first concrete material is added to at least the portion of the interior space within the wall of the shell occupied by the impact support element before being driven into the ground.

20. A foundation pile assembly configured to provide foundation pile support to a structure, comprising:

a first pile section comprising:

a shell having a first end, a second end, a circumferential wall extending from the first end of the shell to the second end of the shell, and an interior space within the wall; and a cap coupled with a second end of the shell, the second end of the shell configured to be a lowermost end of the shell when the first pile section is being driven into the ground;

wherein:

the first pile section comprises a reinforced portion, the reinforced portion comprising an impact support element and a first concrete material positioned within the interior space of the shell in the reinforced portion before the first pile section is driven into the ground;

the reinforced portion of the first pile section has a higher strength relative to portions of the first pile section adjacent to the reinforced portion;

the impact support element comprises:

a first portion comprising a plate of a rigid material; and a second portion coupled to the first portion, the second portion comprising a plurality of first reinforcement members extending in a longitudinal axial direction from a first main surface of the first portion, wherein the impact support element is positioned within the interior space of the shell so that the plurality of first reinforcement members of the second portion extend toward the second end of the shell;

the impact support element is positioned completely within the interior space of the shell in the reinforced portion of the first pile section so that no portion of the impact support element extends outside of the shell;

wherein the impact support element is coupled with an inside surface of the wall of the shell in a desired position to bias the impact support element to remain in the desired position as the first concrete material is added to at least a portion of the interior space within the wall of the shell occupied by the impact support element.

21. The foundation pile assembly of claim 20, wherein the impact support element is coupled with an inside surface of the wall of the shell in a desired position to bias the impact support element to remain in the desired position as the first concrete material is added to at least a portion of the interior space within the wall of the shell occupied by the impact support element.

22. The foundation pile assembly of claim 20, wherein the first concrete material is added to at least the interior space within the wall of the shell of the reinforced portion of the first pile section while the shell is in a horizontal position.

23. A method for making a foundation pile assembly, comprising:

providing a first shell of a first pile section, wherein the first shell comprises a first end, a second end opposite the first end, a circumferential wall extending from the first end of the first shell to the second end of the first shell, and an interior space within the wall;

coupling an end cap to the second end of the first shell, the second end of the shell configured to be a lowermost end of the shell when the first pile section is being driven into the ground; and positioning an impact support element within the interior space of the first shell, the impact support element comprising a first portion comprising a plate of a rigid material and a second portion coupled to the first portion, the second portion comprising a plurality of reinforcement members extending in a longitudinal axial direction from a first main surface of the first portion, wherein the impact support element is positioned within the interior space of the first shell so that the plurality of reinforcement members of the second portion extends toward the second end of the first shell; and coupling the impact support element with an inside surface of a wall of the first shell in a desired position to bias the impact support element to remain in the desired position as a first flowable material is added to at least a portion of the interior space within the first shell occupied by the impact support element.

24. The method of claim 23, wherein the method comprises:

creating at least one closeable opening on an exterior surface of the first shell;

inserting the first flowable material into the interior space of the first shell through the at least one closeable opening such that the first flowable material substantially fills the interior space between the end cap and the first portion of the impact support element while the first shell of the first pile section is in a generally horizontal orientation; and coupling a cover member to the first shell to cover the at least one closeable opening.

25. The method of claim 23, further comprising securing a first plurality of reinforcement straps on the first shell adjacent to the impact support element.

26. The method of claim 23, comprising lofting and aligning the foundation pile section over a desired location and driving the foundation pile section in a subsoil.

27. The method of claim 23, comprising coupling a second shell of a second foundation pile section to the first shell of the first foundation pile section when the first end of the first shell of the first foundation pile section is above a surface of the ground and the second end of the first shell of the first foundation pile section is in the ground.

28. The method of claim 27, comprising coupling a second plurality of reinforcement straps to an outside surface of the first shell and the second shell such that the second plurality of reinforcement straps span between the first shell and the second shell.

29. The method of claim 27, comprising inserting a driving unit through an interior space of the second shell until the driving unit contacts the first portion of the impact support element of the first foundation pile section and applying a driving force to the driving unit until the second pile foundation section reaches a desirable depth in the ground.

30. The method of claim 29, comprising filling the interior space of the second shell with a second concrete material after the driving unit has been removed.

* * * * *